US005801943A

United States Patent [19]

Nasburg

[11] Patent Number: 5,801,943

[45] Date of Patent: Sep. 1, 1998

[54] TRAFFIC SURVEILLANCE AND SIMULATION APPARATUS

[75] Inventor: Robert E. Nasburg, Palos Verdes Estates, Calif.

[73] Assignee: Condition Monitoring Systems, Long Beach, Calif.

[21] Appl. No.: 398,770

[22] Filed: Mar. 6, 1995

Related U.S. Application Data

[63] Continuation-in-part of Ser. No. 96,769, Jul. 23, 1993.

[51] Int. Cl.[6] ..... G08G 1/01

[52] U.S. Cl. ..... 364/436; 364/439; 340/910

[58] Field of Search ..... 364/436, 439; 340/905, 910

[56] References Cited

U.S. PATENT DOCUMENTS

| | | | |
|---|---|---|---|
| 3,920,967 | 11/1975 | Martin et al. | 364/437 |
| 4,023,017 | 5/1977 | Cesari | 235/150 |
| 4,325,057 | 4/1982 | Bishop | 340/539 |
| 4,628,309 | 12/1986 | Allias | 340/825.54 |
| 4,791,571 | 12/1988 | Takahashi et al. | 364/436 |
| 4,847,772 | 7/1989 | Michalopoulos et al. | 364/436 |
| 5,173,691 | 12/1992 | Summer | 340/905 |
| 5,278,554 | 1/1994 | Marton | 340/910 |
| 5,283,573 | 2/1994 | Takatou et al. | 340/937 |
| 5,296,852 | 3/1994 | Rathi | 340/933 |
| 5,349,520 | 9/1994 | Hickman | 364/424.01 |
| 5,396,429 | 3/1995 | Hanchett | 364/436 |
| 5,416,711 | 5/1995 | Gran et al. | 364/436 |
| 5,448,484 | 9/1995 | Bullock et al. | 364/439 |
| 5,519,618 | 5/1996 | Kastner et al. | 364/439 |

OTHER PUBLICATIONS

Adolf May, *Traffic Flow Fundamentals* at 167–177, published by Prentice Hall, Englewood Cliffs, NJ (1990), pp. 167–177, Chapters 6 and 13.

R.E. Nasuburg, *Tracking and Control Systems* (Chapter 5), of vol. 4 *the Infrared and Electro–Optical Systems Handbook*, SPIE Optical Engineering Press, Bellingham, WA (1993).

S.S. Blackman, *Multiple–Target Tracking with Radar Application* Chapter 4, pp. 262–274 and 402–421, Artech House, Norwood MA (1986).

P. Maybeck, *Stochastic models, estimation, and control;* 1979; Academic Press; NY, NY.

D. Hately and I. Pirbhai; *Strategies for Real–Time System Specification;*1988, Dorset House, NY, NY.

R. Haralick and L. Shapiro, *Computer and Robot Vision;* 1992; Addison–Wesley; Reading, MA; Chapter 2,3,4,9 and 10.

W. Pratt, *Digital Image Processing;* 1991; Wiley; NY, NY; Section 18.1.

N. L. Seed and A.D. Houghton, Background Updating for Real –Time Image Processing at TV Rates, 1988.

K. Fukunaga, *Introduction to Statistical Pattern Recognition;* 1972; Academic Press; NY, NY.

Ullman, *Principles of Database Systems;* 1980, Computer Science Press; Potomac, Maryland; Chapters 2, 10.

W. Leutzback, *Introduction of the Theory of Traffic Flow;* 1988; Springer–Verlag; Berlin, Germany.

(List continued on next page.)

*Primary Examiner*—Vincent N. Trans
*Attorney, Agent, or Firm*—Sereboff & Buyan

[57] ABSTRACT

A wide area surveillance system for application to large road networks is described. The system employs smart sensors to identify plural individual vehicles in the network. These vehicles are tracked on an individual basis, and the system derives the behavior of the vehicle. Furthermore, the system derives traffic behavior on a local basis, across roadway links, and in sections of the network. Processing in the system is divided into multiple processing layers, with geographical separation of tasks.

29 Claims, 35 Drawing Sheets

OTHER PUBLICATIONS

Y. Bar–Shalom and T. Fortmann; *Tracking and Data Association;* 1988; Academic Press, San Deigo, CA.

J. Munkres, Algorithms for the Assignment and Transportation Problems; Siam J. Control; vol. 5, Mar. 1957, pp. 32–38.

E. Pfannerstill, Automatic Monitoring of Traffic Conditions by Reidentification of Vehicles. In Proc. IEEE Conf. on Road Traffic Monitoring, Report 299, 1989, pp. 172–175.

H. Goldstein, *Classical Mechanics,* Addison–Wesley, Reading, MA (1950).

M.H. DeGroot, *Optimal Statistical Decisions,* pp. 324–379 McGraw–Hill, New York, NY (1970).

Waters Information Services, Inc., "Hughes says ex–employees stole intellectual property," Jun. 7, 1993, pp. 1, 2, 4 and 6.

Context Diagram - MultiSensor Advanced Tracking System

0 - MultiSensor Advanced Tracking System (MATS)

1 - Track Node 1

1.1.1 - Track Node Database Management 1.1.1.1 - Update Database 1.1.2 - Local Trackng 1.1.2.1 - Local Track Filter 1.1.2.1.1 - Update Tracks 1.1.2.2 - Generate Track Innovations 1.1.3 - External Track Node Interface 1.1.3.3 - Link Time Estimation 1.1.3.3.1 - Link Time Filter 1.1.3.3.2 - Generate Link Time Innovations Figue 17

1.2.2 - Overlapped Local Tracking 1.2.4 - Other Track Node Interface

4 - Analyze Wide Area Flow 4.1 - Analyze Link Flow 1-2

4.4 - Analyze Section Flow 4.4.1 - Section Flow Assessment A

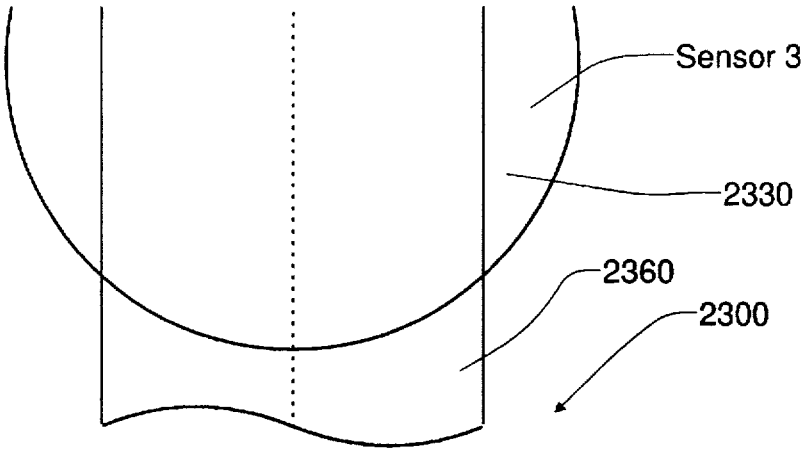
Figure 23
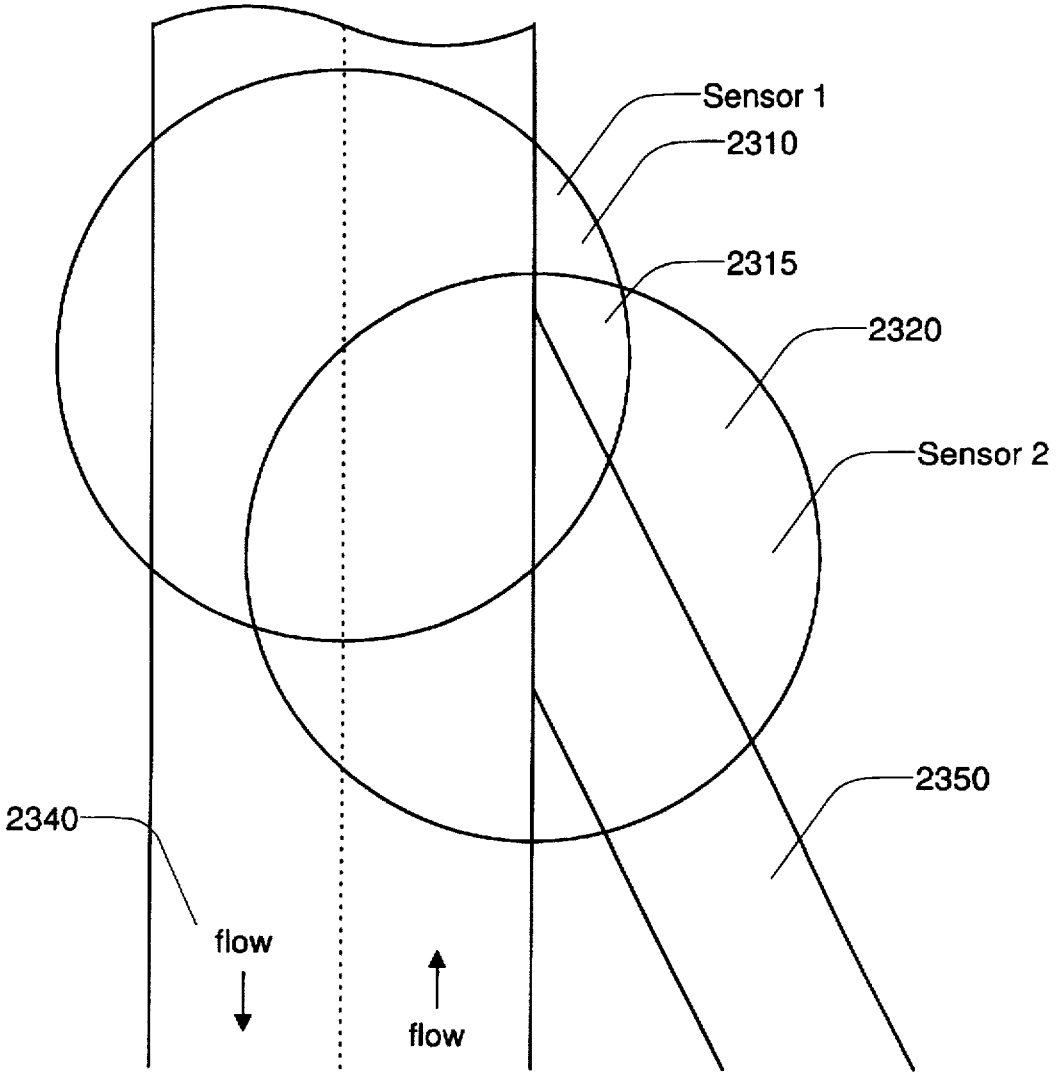

Copyright 1995 CMS

TRAFFIC SURVEILLANCE AND SIMULATION APPARATUS

CROSS-REFERENCE TO RELATED APPLICATIONS

This application is a continuation-in-part of application Ser. No. 08/096,769 filed Jul. 23, 1993.

BACKGROUND OF THE INVENTION

1. Field of the Invention

The present invention relates generally to traffic surveillance systems.

2. Description of Related Art

Numerous types of sensors for vehicle detection are available which provide information about vehicles in a local area of the roadway. An inductive loop detector is the most prevalent of these due to low cost and maturity of technology, but it typically can only monitor a small area. In practice, a loop is embedded in a lane of a roadway, and the loop magnetically senses when a large mass of metal passes over it. By placing two loops a known distance apart, the speed of a vehicle across the two loops can be measured with limited accuracy. Loops therefore provide vehicle count and speed at a specific point in each lane to the traffic manager. Ten lanes of a freeway typically require ten sets of loops.

Other technologies have been developed to replace loops. These sensors are generally in the testing stage, and include microwave sensors, radar and laser radar sensors, piezoelectric sensors, ultrasonic sensors, and video processor loop replacement (tripwire) sensors. All of these sensors typically detect vehicles in a small area of the roadway network.

Video processor loop replacement sensors, also known as tripwire sensors, simulate inductive loops. With a tripwire sensor, a traffic manager can designate specific small areas within a video camera's field of view. In use, a traffic manager typically electronically places the image of a loop over the roadway video. A video processor determines how many vehicles pass through the designated area by detecting changes within a detection box (image of a loop) as a vehicle passes through it. Like inductive loops, multiple tripwire sensors can be placed in each lane, allowing these systems to determine both vehicle counts and speeds.

Tripwire sensors are being integrated experimentally with a tracking capability derived from tracking technology used for missile guidance. These systems continuously track a vehicle detected within the designated area while the vehicle is in the video camera's field of view (FOV).

Inexpensive RF transponders have been developed for use in electronic toll collection systems. When interrogated by an RF reader at the side of a roadway, RF transponders supply a unique identification signal which is fed to a processing station. It is understood that this system detects and identifies a given vehicle as it enters a toll area. After a vehicle is identified, the vehicle owner is debited for the proper amount of toll automatically.

Another technology being proposed for automated toll collection is the use of image processors to perform automated license plate reading. As with the RF transponders, a specific vehicle is identified by the system at the entrance to a toll road or parking area. Both the RF transponders and image processors provide vehicle identification and vehicle location information for a very limited area and have generally only been used for automatic debiting.

The desire for wide area traffic surveillance data has prompted several academic explorations of ways in which the data could be obtained. There has been proposed a correlation technique based on using millimeter wave radar reflection signals for reidentification of groups of vehicles. In a related study, patterns of groups (or platoons) of vehicles were obtained from inductive loop data, and correlated to determine a group travel time. Processing of the group data appeared to be limited to standard correlation techniques based on examination of a pattern at a first point and waiting until a similar pattern appeared at a second point, for example further down a highway. As long as most of the vehicles remained in the group with the same relative speeds throughout the stretch of highway being monitored, and as long as sufficient data processing capability was available, useful data was obtained. Usage of this technique appears to be limited to short stretches of limited-access freeways where densities are such that vehicles do not change lanes or pass each other very often.

The surveillance capability of existing individual vehicle sensors used for traffic monitoring typically covers a local region of less than 200 feet in length. Information provided by such sensors includes the numbers of vehicles and velocities of individual vehicles in the detection region. When used in an urban network, even if sensors are closely spaced (every ¼ to ½ mile), traffic managers typically have, at best, a disjointed picture of the condition of the network. Generally this picture indicates where congestion might already be occurring because, for example, vehicles are not moving very fast, and there are a lot of them in a local area. However, this information has limited the ability of traffic managers to quickly predict or prevent the onset of congestion or to rapidly dissipate it.

Wide area traffic surveillance is the core of advanced traffic management systems which are necessary components of an intelligent highway vehicle system (IVHS). The stated goals of advanced traffic management systems are:

- proactive real-time traffic management to prevent congestion and incidents;
- rapid incident detection and efficient incident management;
- improved infrastructure planning and utilization of existing transportation assets.

The payoff to the United States for the implementation of advanced traffic management systems has been estimated to be billions of dollars as a direct consequence of reduced loss of time (vehicle delay hours) due to improved congestion management; improved safety due to less congestion and fewer secondary collisions; improved fuel economy in urban areas due to shorter travel times; and less air pollution in urban areas due to shorter travel times.

The wide area traffic surveillance problem is difficult to solve due to the number and density of vehicles to be observed. The problem is compounded by the need to perform the task at thousands of locations in the US alone, which makes it necessary to perform the task with simple and inexpensive hardware. Furthermore, the cost of communicating the information to the traffic management facility where it can be assimilated and distributed is also significant, particularly in the freeway case where the sensors can be miles from the traffic operation center. In addition, traffic managers have invested heavily in some areas installing various types of vehicle detection sensors. They wish to integrate the information from all these sensors with the information from a wide area traffic surveillance sensor. A wide area traffic surveillance system which will be successful in solving the traffic problem should address all these issues.

Video surveillance has generally been limited to measurements of volume counts of vehicles and limited flow information under the simplest conditions such as free flowing traffic on straight stretches of freeway. For reasons largely unrelated to these limitations, over time, installation and maintenance costs for video-based surveillance systems have decreased. For some applications, it is believed that such systems are more cost-effective than systems based on inductive loop detectors buried in the roadway.

Many theories have been developed for describing traffic behavior. One theory, implemented as a macromodel, considers aggregate measures of traffic behavior. Another theory, implemented as a micromodel, considers kinematic models for individual vehicles.

A number of traffic micromodels have been developed and are used by traffic engineers for the analysis and explanation of roadway conditions. One typical traffic micromodel is known as the GM car following micromodel, named after research performed by General Motors. The GM car following micromodel is described in Adolf May, *Traffic Flow Fundamentals* at 167–177, published by Prentice Hall, Englewood Cliffs, N.J. (1990), which is incorporated herein by reference. The users of vehicle tracking systems and simulations are typically traffic engineers. The GM micromodel is both intuitive and simple to setup for typical traffic engineers.

The GM micromodel describes kinematics for a vehicle on an unrestricted roadway in terms of the vehicle's acceleration. The effect of the distance and velocity differences between the vehicle and a vehicle leading it are included, enabling this micromodel to describe the interaction between vehicles in congested traffic. According to the GM micromodel, a driver's decision to accelerate or decelerate is based upon the gap between the driver's vehicle and a car ahead.

However, the GM car-following micromodel does not describe vehicle kinematics in complex interchanges. In interchanges and intersections, the kinematics are influenced not only by vehicle spacing but also by the possibility of vehicles merging and by road geometric events like stop signs and turning lanes.

Tracking system architecture and the role of micromodels for location prediction in applications aside from traffic monitoring are described in R. E. Nasburg, *Tracking and Control Systems* (Chapter 5), of 4 *The Infrared and Electro-Optical Systems Handbook*, SPIE Optical Engineering Press, Bellingham, Wash. (1993), which is incorporated herein by reference. These tracking systems employ detection sensors of various types and computers to process the detection information.

Automated flow assessment may be implemented through a single stage decision/estimation tracking algorithm. In accordance with a single decision/estimation algorithm, past estimates of an object's position are used with present data in the estimation of the object's position and velocity. For complex tracking environments the single stage decision/estimation approach can have an undesirable rate of failure. For example, video tracking using pixel level correlation may break down in environments which provide many options for many tracked objects. Selection of an appropriate algorithm becomes critical, and may not be sufficient to overcome errors in pixel level correlation when, for example, multiple objects are overlapped. Consequently, a bad decision/estimation can occur. In systems using the single stage algorithm this bad decision/estimation will be used in the next decision/estimation, hence degrading its quality. A sequence can thus occur where the first bad decision leads to another bad decision and to final loss of track. Early small errors lead to larger errors until total failure occurs. For simple environments without confusion in the correlation, small errors can be overcome leading to stable tracking, but this is not necessarily true for complex environments.

In vehicle tracking, several situations arise in which single stage algorithms may prove unreliable, including:

a) intersections and complex interchanges where the vehicle's path is uncertain due to the possibility of a turning movement;

b) merges between two vehicle streams;

c) lane changing; and d) weaving sections.

For radar tracking (e.g., of aircraft) and other surveillance systems this problem has been overcome by using a multiple hypothesis tracking approach. Radar tracking systems are described in S. S. Blackman, *Multiple-Target Tracking with Radar Application* at 262–274 and 402–421, Artech House, Norwood, Mass. (1986) and is incorporated herein by reference. It was recognized that error build-up could occur when using single stage algorithms in these systems. In the multiple hypothesis approach, when a situation arises where the track is not well defined, the decision step is delayed until enough data is available so that a good decision can be made, hence avoiding error build-up. During this delay time, hypotheses are generated for each possibility. The multiple hypothesis approach uses multiple data sets in its decision/estimation, leading to a higher quality decision. Typically, one of the generated hypotheses is determined to be a winner based upon a predefined stopping rule. The tracks associated with the winning hypothesis are continued, and the tracks associated with the non-winning hypothesis are eliminated.

The multiple hypothesis approach works well when a confusing environment is transitory, that is, after a short amount of time the confusion abates. For example, when a vehicle changes lanes, for some period the vehicle will be between lanes. During this period, it is difficult to make a high quality decision as to which lane the vehicle is in. The vehicle could be changing lanes or it might have temporarily wandered out of its historically normal lane. If however, a short amount of time is allowed to pass the vehicle will either complete the lane change or it will return to its normal lane and the lane decision can be accomplished with ease. The multiple hypothesis approach is robust for this example since it allows the decision to be delayed until it can be made with high reliability.

In typical multiple hypothesis tracking systems, multiple hypotheses are generated when the data association process is not able to assign tracks to detections with high quality. Every possible assignment between the tracks and the detections become the set of hypotheses. The tracks and hypotheses are thus considered in a batch manner. This tends to lead to a large number of hypotheses and is likely to be computationally cumbersome.

Although the multiple hypothesis tracking approach typically leads to higher quality tracking it often leads to significant implementation problems. For aircraft tracking systems, implementation problems caused by hypothesis compounding are major issues for the system developer. If a confusing environment exists the multiple hypothesis approach results in generation of a hypothesis for each possibility, thus compounding the data structures and adding to computational load. On the next data set if a confusing environment still exists the multiple hypothesis approach will add additional hypothesis—further aggravating the data structure and further adding to the computational load.

Complexity and computational loading can grow at an exponential rate which does not lead to a practical implementation. Accordingly, the typical techniques for using multiple hypothesis tracking have generally not been considered for vehicle tracking.

SUMMARY OF THE INVENTION

It is an object of the present invention to provide an improved traffic monitoring system with the capability of monitoring traffic throughout a large area. One specific application for a wide area traffic surveillance system in accordance with the present invention is to monitor a major urban freeway where traffic moves along numerous lanes in each direction and along entrance and exit ramps, with large amounts of merging behavior disrupting the oncoming flow and creating incidents. To effectively monitor the freeway, traffic managers need information over several miles of the freeway and ramps. The information needed includes: whether traffic is flowing normally based upon time of day; whether there is an incident (e.g. a traffic accident); how many lanes are impacted by an incident; and how far away the incident is from the traffic detector locations. Freeway surveillance problems often occur on major urban freeways and often up to 50 miles away from the locus of traffic congestion, such as an urban center. It is therefore an object of the present invention to provide an improved monitoring system capable of providing this information.

Another application for a wide area traffic surveillance system in accordance with the present invention is for monitoring a major arterial street which carries traffic. It is desirable that the wide area traffic surveillance system provide the traffic manager with a picture of the entire traffic situation. The surveillance should not be limited to an intersection, but should span the entire route of the artery from an intersection to an adjacent intersection. Traffic managers are especially interested in, within about 250 feet on either side of each intersection, the type of traffic and queue length in each lane of the artery, individual vehicle and group velocities, and left- and right- turning and lane changing behavior. Traffic managers are also interested in the flow between intersections, and whether the artery is normal or congested. Traffic managers would also like to know the locations and progress of large trucks and buses approaching intersections to adjust the timing of traffic signals (e.g. stop lights) to minimize congestion which these vehicles often cause. It is therefore an objective of the present invention to provide the wide area traffic surveillance with the capability to identify (that is, "fingerprint"), classify and track individual vehicles throughout a large area.

Another situation which benefits from a wide area traffic surveillance system in accordance with the present invention is a complex freeway interchange, such as a diamond interchange. In a diamond interchange, there are multiple entrances and exits from a major artery to a major freeway. Traffic signals control the flow of traffic between the freeway and the artery. It is therefore an object of the present invention to provide the measurement of traffic flows from many different directions and grade separations at the same time. It is a further object that the traffic signals be controlled to route traffic onto and off of the freeway without causing congestion on the artery. Similarly, it is a further object to control traffic flow such that congestion on arteries near freeway exits does not force cars to queue up onto the freeway. It is an object to provide a wide area traffic surveillance system which integrates the outputs of multiple sensors so that a traffic manager can assess and manage the entire situation.

A similar situation involves the management of traffic over a large commercial district such as a large airport where numerous ingress and egress streets must be monitored for both airport and local traffic. Part of the wide area traffic surveillance involves monitoring traffic to various terminals and parking areas. Here, it is an object of the present invention to provide an integrated traffic situation which is presented to an airport traffic manager to allow the management of congestion at peak times and rapid detection and clearing of incidents.

It is an object that the wide area traffic surveillance information cover an area as wide as possible, fingerprint and classify individual vehicles, while being both dynamic and real-time. A static measurement of an area can be used to assess whether congestion has occurred, but it generally will not suffice to warn of the onset of congested conditions. Non real-time, stored wide area data are of historical significance or useful in planning but will not be useful in proactively reducing congestion in a dynamic traffic situation.

The illustrated system of the present invention can provide dynamic wide area measurements of traffic flow for real-time proactive traffic control. The illustrated system of the present invention can provide effective wide area traffic surveillance through an integrated picture of the entire road network, showing such information as areas where heavy traffic flow will soon cause congestion, whether high occupancy vehicle (HOV) lanes are functioning properly, where on-ramp metering or signal light timing needs adjustment to lessen congestion, and which alternative routes could be suggested to motorists and the news media to reduce their travel times.

The illustrated embodiment of the present invention includes a system capable of performing wide area traffic surveillance and the methods for processing gathered data to achieve this. Accordingly, vehicle fingerprints and detection information from multiple sensors are used to provide:

1. dynamic flow characterization of traffic over a wide area,
2. link time (the time it takes for a vehicle to travel from one sensor to another),
3. origin/destination pair measurements across an urban network,
4. rapid detection and characterization of incidents in the network,
5. arrival times of express buses, hazardous material trucks, and other heavy vehicles at various points in the network,
6. effectiveness of ramp metering and signal light control algorithms, and
7. effectiveness of high occupancy vehicle lanes.

This traffic information is preferably provided in real time.

The illustrated embodiment of the present invention includes a processing architecture and organization which efficiently reduces raw data from multiple traffic sensors into the above flow information. The architecture of the system is such that minimal roadside hardware is required, minimizing maintenance cost and maximizing reliability. This is partially accomplished in the illustrated embodiment by partitioning the architecture into two major components, data collection and preprocessing by a plurality of smart sensor interfaces (SSIs), and data management by a multi-sensor advanced tracking system (MATS). A wide area traffic surveillance system in accordance with the illustrated embodiment of the invention utilizes a plurality of SSIs for data gathering and the MATS for data management.

The SSI reduces raw sensor data to individual vehicle detections and fingerprints. The SSIs are preferably implemented in both hardware and software. In the preferred embodiment, the SSIs transmit preprocessed data to the MATS. Due to the low bandwidth requirement between the SSIs and MATS, the SSIs can be located remotely at the roadside. Preferably, a single sensor capable of supplying individual vehicle fingerprints is attached to each SSI.

The MATS is a computer processing architecture preferably implemented with general purpose computer hardware. FIG. 36 shows a typical hardware implementation of a MATS. The MATS reduces vehicle detections and fingerprints provided by the SSIs into the desired flow information. The MATS utilizes a layered processing architecture to control complexity, simplify system integration, and reduce software maintenance costs. The MATS processes data supplied by each SSI to characterize the flow local to the sensor attached to that SSI. The MATS then analyzes flow on the roadway links between sensors. Finally, the MATS combines local and link characterizations to assess flow conditions over the wide area. The MATS processing architecture allows the MATS to be implemented in a central location or to be distributed across multiple processing nodes. This is enabled by the low bandwidth requirements between the MATS processing modules.

Current vehicle detection technology is generally limited to providing traffic information over a very limited local area. According to the illustrated embodiment of the present invention, local inputs from currently installed sensors, sensors which are installed specifically for use with the system, and sensors that may be developed in the future, are integrated into a wide area traffic surveillance system structured to provide the high level network-wide information needed for advanced traffic management. Existing sensors which can provide fingerprinting information, such as video processing systems, RF transponders, and license plate readers, along with data from loop and other non-fingerprint type sensors, may be linked by SSIs into the MATS to provide individual vehicle link time measurements over complex and large traffic areas.

The processing architecture of the invention is designed to allow the link time estimation to take place dynamically, in real time, utilizing processing equipment which is economically acceptable to the traffic management market. The output of the system provides the link time estimates in various formats which are easily integrated into current and future traffic management systems. A general description of the inerrelation between the various components of a traffic surveillance system which may be used to carry out this invention is described by my co-pending U.S. patent application Ser. No. 08/096,769, filed Jul. 23, 1993.

It is a further object to provide the above-described information for complex and multilane intersections and interchanges, curved stretches of roadway, and widely varying traffic conditions (weaving and merging behavior, congested flow, etc.). It is yet a further object to accomplish this in a system which traffic engineers can easily set up and use. It is a further object to provide for the implementation of a micromodel, needed in the tracking approach, which is efficient and may be operated in real time. An additional object is to provide real time flow information in the form of iconic graphical displays which show the motion of vehicles in real time so that operators can quickly assess the traffic situation.

To meet these objectives, a micromodel applicable to complex interchanges is provided. This micromodel enables implementation of low-cost tracking and simulation systems with an efficient traffic micromodel which can be integrated into tracking systems and simulations for all possible complex road geometries.

The micromodel provides the traffic engineer with an intuitive and efficient method for describing or modeling complex traffic intersections and interchanges so that the kinematic behavior of all vehicles within that interchange can be predicted. Parameters provided as inputs by the traffic engineer are mapped directly to a set of differential equations governing the movement through time of all vehicles within the interchange. The result is a compact dynamic model usable in vehicle tracking applications and in graphic simulations, including real time simulations, of vehicles as they proceed through the interchange.

The dynamic model of this invention is an improvement of the GM car following micromodel and produces an expression for each vehicle's acceleration. The micromodel of the invention uses both the gap between vehicles and the influences of the roadway's geometry in its expression for the vehicle's acceleration. In this manner the kinematic behavior of all vehicles throughout a complex interchange can account for group behavior of multiple cars and the influence of the roadway's geometric events.

The micromodel of the invention partitions a vehicle's behavior into two cases—a merging case and a nonmerging case. The nonmerging case is further divided into four sub-cases or regions, based on the gap between a given vehicle and the vehicle leading it and the gap between the vehicle and any roadway geometric event that the vehicle is approaching. An expression for vehicle acceleration is given for each region in terms of these gaps. Merging is modeled by modifying the region acceleration equations when merging is present.

There is further provided a multiple hypothesis tracking method for performing the local tracking function. The method can be used with a wide variety of vehicle detection mechanisms ranging from video detection to magnetic loop presence detectors. This method can be used with a single detection sensor or with multiple detection sensors thereby fusing detection data from the individual sensors.

In accordance with the multiple hypothesis tracking method of the invention, the decision of which of multiple possible paths a vehicle may be taking is delayed until sufficient vehicle detection data is available. Further in accordance with the method, the number of hypotheses is limited and hypotheses are terminated as quickly as possible. Situations requiring multiple hypothesis are detected based on well defined events. After each cycle of the tracking process, the stopping rule is checked to see if any hypotheses can be eliminated. If the stopping rule has been satisfied then the winning hypothesis is selected and all tracks associated with the winning hypothesis are accepted as normal tracks to be continued. Other tracks associated with the rejected hypotheses are terminated and flushed from further consideration.

The multiple hypothesis method of the invention uses multiple hypotheses for local events. Tracks not included in the local event are not included in the multiple hypothesis process. This helps to reduce the computational requirements of the multiple hypothesis method of the invention.

DESCRIPTION OF THE DRAWINGS

These and other advantages of the present invention are best understood with reference to the drawings, in which:

FIG. 23 is a partial elevation of a portion of a highway having a plurality of sensors;

DETAILED DESCRIPTION OF THE PREFERRED EMBODIMENT

Overview of the Processing Approach

This section provides a detailed description of a system according to one aspect of the invention. It first presents the general approach to solving the traffic surveillance problem used by the system. After this orientation the details of the system are described using data flow diagrams.

The embodiment described is a processing architecture composed of both hardware and software modules interconnected to produce the traffic surveillance capability. One aspect of the following description is the definition of the processing modules (functions) and how they are interconnected. There are a number of well known algorithmic approaches that implement many of the functions. Additional detail is provided for functions when required or when modification of algorithms common in the signal and data processing literature is needed.

Figure 1:
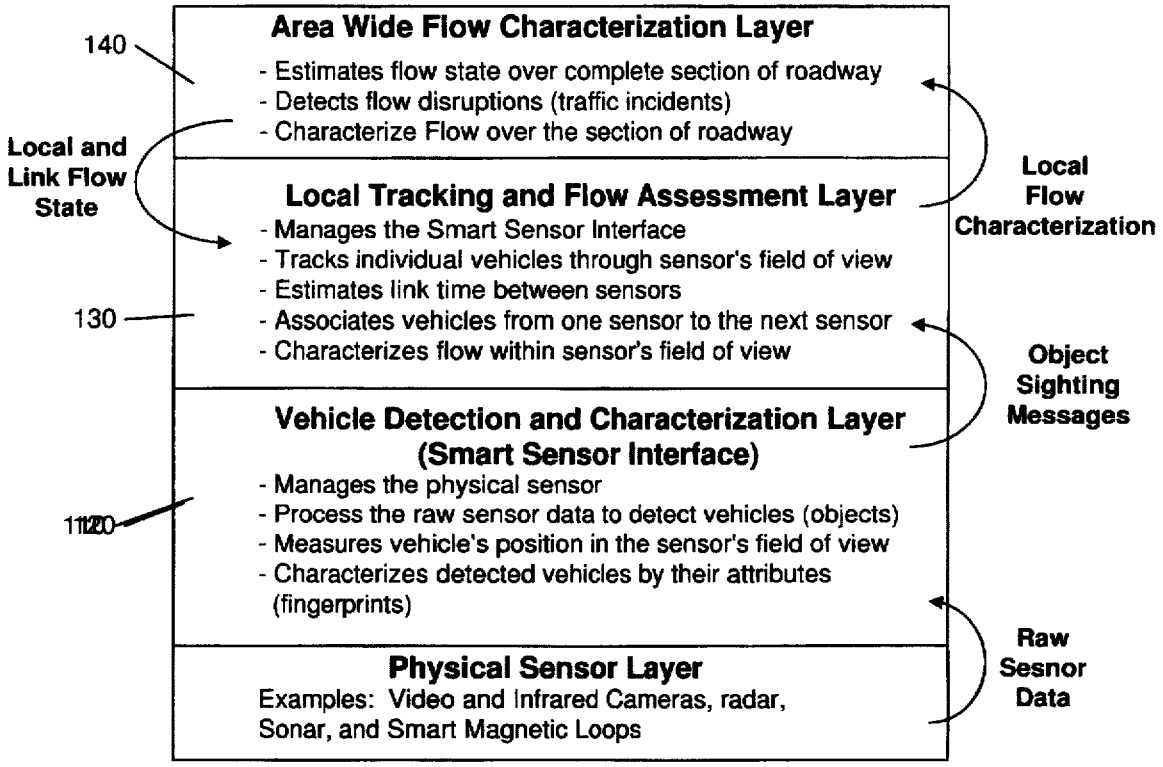
FIG. 1 is a block diagram of a wide area traffic surveillance system in accordance with the present invention.

Referring now to FIG. 1, there is shown a block diagram of a wide area traffic surveillance system according to the invention, depicted as a layered processing structure. This figure shows the system divided into four major layers: a physical sensor layer 110, a vehicle detection and characterization layer 120, a local tracking and flow assessment layer 130, and an area wide flow characterization layer 140. The vehicle detection and characterization layer 120 will also be referred to herein as the "SSI layer." The local tracking and flow assessment layer 130 will also be referred to herein as the "bottom MATS layer." The area wide flow characterization layer 140 will also be referred to herein as the "top MATS" layer. It is this layering and the geographic modularization within each layer that facilitates implementation of the system's traffic surveillance with a software/hardware architecture that is structured for relatively easy fabrication and integration.

The lowest layer of the system is the physical sensor layer 110. The physical sensor layer 110 comprises a plurality of sensors. These sensors may be video cameras, infrared cameras, radar, sonar, RF transponders, license plate readers, or any other sensor which preferably provides fingerprints. For example, a video camera may provide a fingerprint in the form of a video signature for each vehicle which passes through the camera's FOV. This video signature must be unique enough to allow that particular vehicle to be located using the raw video data from one camera's frame to the next. Techniques for using video cameras in this way are described in R. Nasburg, Tracking and Control Systems; *The Infrared and Electro-Optical Systems Handbook*, Chapter 5 of Volume 4; 1993; SPIE-The International Society for Optical Engineering, which is incorporated herein by reference. In addition, loop and other non-fingerprint type sensors may be used in this layer for ancillary information.

The next layer in the system is the SSI layer 120. The SSI layer 120 comprises a plurality of SSIs. Preferably, each SSI is attached to a single sensor, with the SSI receiving raw data input from its attached sensor. The SSIs process raw sensor data to detect vehicles within each sensor's FOV. An SSI characterizes each detected vehicle by the vehicle's location within the attached sensor's FOV and by the vehicle's fingerprint.

The SSIs reduce raw sensor data into objects that represent the vehicles. The objects are communicated to the bottom MATS layer 130 as "Object Sighting Messages" (OSMs). Because communication of OSMs to the MATS from the SSIs does not require a significant communication capability, the SSIs may be located remote from the MATS. Since the OSMs contain the basic information needed for traffic surveillance, the SSI layer 120 performs the first step in conversion of the sensors' data into the overall flow assessment.

The bottom MATS layer 130 converts OSMs from the SSI layer 120 into a first stage of traffic flow information. The bottom MATS layer 130 develops flow information for individual vehicles by reduction of the data from the SSI layer 120. Flow information developed at the bottom MATS layer 130 includes vehicle velocity, vehicle densities, vehicle classification (e.g. motorcycle, car/pickup, truck, bus, etc.), vehicle behavior (e.g. lane changes), and link times. In addition, a path history is developed for individual vehicles. To develop a path history, a list of sensors which have sensed a particular vehicle is entered in a database. The path histories may be used to assess flow patterns within the roadway system.

Flow within a sensor's FOV is referred to herein as "local flow". The bottom MATS layer 130 produces for each SSI, a micro model description of local flow. Micro models are described in A. May, *Traffic Flow Fundamentals;* 1990; Prentice-Hall; Englewood Cliffs, N.J.; Chapter 6, which is incorporated herein by reference. The bottom MATS layer 130 communicates the local flow information to the top MATS layer 140 for further processing. To communicate this information, the bottom MATS layer 130 aggregates the individual vehicle flow characteristics into macro parameters. This conversion between individual vehicle detections and micro and macro descriptions is the data reduction produced by the bottom MATS layer 130.

The top MATS layer 140 uses a macro model to describe flow over an entire section of roadway. Macro models are described in A. May, *Traffic Flow Fundamentals*; 1990; Prentice-Hall; Englewood Cliffs, N.J.; Chapter 13, which is incorporated herein by reference. The top MATS layer 140 communicates aggregate link flow information to the bottom MATS layer 130, which is useful to the local tracking activity of the bottom MATS layer 130. Information communicated by the top MATS layer 140 to the bottom MATS layer 130 includes estimated average flows into each sensor's FOV and the velocity profiles on the roadway links between a particular sensor and any adjacent sensors.

The top MATS layer 140 assesses flow over each link of interest. It uses modern estimation theory to fit a macro model of the velocity and density of vehicles in each link to the local flow measurements developed in the bottom MATS layer 130. The bottom MATS layer 130 hence acts as a data source for the model fitting of the top MATS layer 140. Other aggregate flow information (ancillary information) such as data from magnetic loops is also employed in the model fitting process. The result of this processing is a flow assessment for each link in terms of state variables, typically velocity and vehicle density. State variables are described in P. Maybeck, *Stochastic models, estimation, and control;* 1979; Academic Press; New York, N.Y., which is incorporated herein by reference.

A further function performed at the top MATS layer 140 is an assessment of the macro flow for flow anomalies such as traffic incidents which interrupt the normal flow of a link. Rapid detection and assessment of traffic incidents and other flow disturbances is accomplished by the top MATS layer 140 through a model fitting process. Micro flow assessment is performed at the bottom MATS layer 130 to detect flow anomalies based on individual vehicle behavior (such events as a vehicle pulling onto the roadside, an accident within a sensor's FOV, or a malfunctioning of a signal).

In the following sections data flow diagrams, FIGS. 2–22, are used to describe how the processing layers described above are implemented in the preferred embodiment. The use of data flow diagrams is described in D. Hatley and I. Pirbhai; *Strategies for Real-Time System Specification;* 1988, Dorset House, New York, N.Y., which is incorporated herein by reference. Data flow diagrams were chosen since they provide an efficient method of describing the processing functions by organizing the description hierarchically. Each layer of the hierarchy is broken down into the major functions (processes) implementing the functionality of that layer and the data interconnects between functions. This description starts at the top level and proceeds down through the different levels of the hierarchy to the elementary levels. Minor functions that would be obvious to those of ordinary skill in the art or that do not contribute to understanding of the system or its best mode have been eliminated in the data flow description.

Description of the Context Diagram

Figure 2:
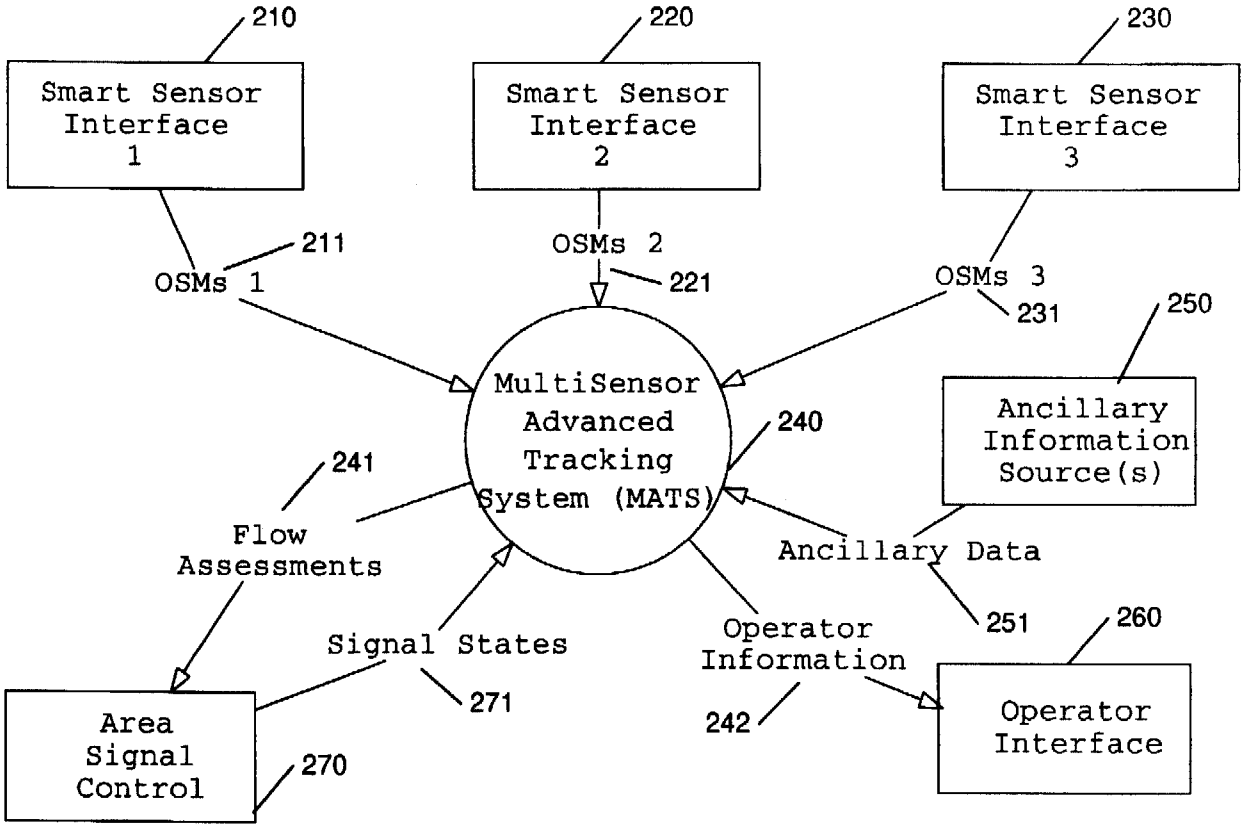
FIG. 2 is a data flow diagram of the wide area surveillance system of FIG. 1.

Referring now to FIG. 2, there is shown a data flow diagram of the wide area surveillance system of FIG. 1. As explained, the local tracking and flow assessment layer 130 and the area wide flow characterization level 140 comprise the MATS 240. FIG. 2 shows the relationship between the MATS 240, a plurality of SSIs 210, 220, 230 and other systems and information sources external to the MATS 250, 260, 270. Although the SSIs 210, 220, 230 are part of the wide area traffic surveillance system of the present invention, FIG. 2 focuses on the MATS 240 since description of the SSIs 210, 220, 230 can be separated from the description of the MATS 240. Thus, the connection of the SSIs to sensors is not shown in the drawings. However, the sensors attached to the SSIs 210, 220, 230 will be referred to as sensor 1, sensor 2 and sensor 3, respectively.

In FIG. 2, three SSIs, SSI 1 (210), SSI 2 (220), and SSI 3 (230) are shown. The system can employ any number of SSIs. Three SSIs are used in this description since the generalization from three SSIs to a number likely to be practiced is straight forward to those of ordinary skill in the art. The significant features of the system can be explained using three SSIs.

In FIG. 2, information sources have been divided into two different classes. Information sources that provide fingerprinting information are represented by the SSIs 210, 220, 230 along the top of the diagram. These information sources 210, 220, 230 provide, as OSMs 1 (211), OSMs 2 (221), and OSMs 3 (231), respectively, information about the individual vehicles which allows them to be located from sensor output sample to sensor output sample and from sensor location to sensor location. In particular, the OSMs from a particular SSI will preferably contain a record for each vehicle detected by the SSI within the attached sensor's FOV. Although a vehicle's record will depend on the type of sensor and the SSI, it will preferably contain the following information about the vehicle:

(1) Vehicle location in the sensor's FOV;

(2) Lane containing the vehicle;

(3) Time tag of the vehicle detection, that is, time that the sensor's output was sampled by the SSI;

(4) Attributes (fingerprint) for the vehicle; and (5) Quality measure of the vehicle's detection.

The other information sources 250, 270 shown in FIG. 2 do not provide fingerprinting information. These sources of information include an ancillary information source 250 and an area signal control 270.

The ancillary information source 250 may comprise any number of sources, but for simplicity is referred to as a single source. The ancillary information source 250 may be provided, for example, by magnetic loop counts and derived velocities. Although the ancillary information source 250 generally does not provide fingerprints, it does provide information usable in flow assessment. The ancillary information source 250 transfers information to the MATS 240 in an ancillary data flow 251.

The area signal control 270 includes the controllers for traffic signal lights, traffic advisory signs, traveler's information radios and systems, and other mechanisms that can influence traffic flow in real time. The area signal control 270 transfers data in a signal states data flow 271. The transferred information includes the state of the traffic signals (red, yellow, green) and the state of traffic advisory signs within salient sections of roadway.

Other non-real-time information such as the condition of the roadway, locations of roadway maintenance, and weather conditions which may also be fed to the MATS 240 are not shown to further simplify this description. The other information used in the MATS 240 preferably includes the geometric layout of the roadway and sensor locations. Although this information is not shown in the data flow descriptions, those of ordinary skill in the art will understand the use and incorporation of such information into the MATS 240.

There are two information sinks shown in FIG. 2. An information sink is an item which receives a data flow. One sink is the area signal control 270, which receives, preferably in real time, the flow assessment developed by the MATS 240, in a traffic flow assessments data flow 241. Flow information is dependent on the area signal control's 270 requirements and could include vehicle density and velocity functions, along links, or large areas, shock wave location and velocity, vehicle queue lengths, location of emergency vehicles and heavy trucks, location and severity of incidents, traffic flow patterns through intersections, etc. This high quality real-time traffic flow information may be used to provide proactive traffic control.

The other information sink shown is the operator interface 260. The operator interface 260 is sent flow information needed by the traffic management personnel for real-time traffic condition assessments, and flow information to be stored for use in traffic planning studies. This information is transferred by the MATS 240 in an operator information data flow 242. Preferably, the system can provide to operators any flow information available within the system's processing layers. This includes information at the micro level (information about individual vehicles) and at the macro level (information from the top MATS layer 140). To reduce internal communication bandwidths within the computer facilities used for the MATS 240, operator information is preferably provided only on demand. For example, if the operator requests vehicle queue lengths from a particular roadway location, the MATS 240 extracts the desired data from its processing stream and routes the data to the operator interface 260 for display. This approach minimizes the data bandwidth within the MATS 240 needed to support traffic information.

Some flow conditions or data need to be continuously monitored for the operator by the MATS 240. One such condition is traffic incidents. To monitor for traffic incidents the operator develops a monitoring script defining for what data to perform automatic condition monitoring and reporting. For example, the monitoring script might instruct the MATS 240 to monitor the queue length of a particular freeway entrance ramp. If the queue length of the selected ramp grows above a defined length, the MATS 240 will send a message to the operator interface 260 along with the freeway flow states. The operator can then request additional data and/or take other action. Preferably, the monitoring script may be changed or modified by the operator in real time.

Description of the Smart Sensor Interfaces

The SSIs 210, 220, 230 are used to interface each sensor capable of supplying fingerprint information about individual vehicles to the MATS 240. In this description, the three SSI's 210, 220, 230 are identical. Each SSI 210, 220, 230 performs the first stage in reduction of raw sensor data into flow assessment by detecting individual vehicles in the attached sensor's FOV and measuring the vehicle's fingerprint. Each SSI 210, 220, 230 thus reduces raw sensor data into OSMs (Object Sighting Messages) for output, respectively OSMs 1 (211), OSMs 2 (221), OSMs 3 (231). The OSMs 211, 221, 231 contain information quantifying each detected vehicle and its fingerprint.

Each SSI 210, 210, 230 is preferably implemented as a hardware module with firmware and application software to execute the SSI's functionality. This implementation has the advantage of low production cost with flexibility for software upgrades. Each SSI 210, 220, 230 preferably contains hardware to interface with the attached sensor, firmware and software to detect vehicles and measure a vehicle's fingerprint, a real-time clock to attach the time (time tag) of the vehicle detections, and an interface to a communications system which links the SSIs 210, 220, 230 to the MATS 240. Communication between the SSIs 210, 220, 230 and the MATS 240 is preferably two way, to enable management of the SSIs 210, 220, 230 by the MATS 240.

The system can be used with any SSI that meets the requirements of detection of individual vehicles and generation of a vehicle's fingerprint. That is, the system does not restrict the SSI to video or microwave sensors. Suitable sensors include radar sensors, imaging infrared sensors, video cameras, smart loop sensors, smartcard readers, and license plate readers.

Each of the sensor types listed have advantages and disadvantages. For example, video sensors can be used by the system and also for real-time surveillance by a human operator, hence reducing system cost by getting double duty from a sensor. Video sensors provide very good fingerprinting information due to the wide diversity of vehicle shapes and colors. A disadvantage of video sensors are their inability to operate in heavy fog. Radar sensors can operate in fog but are costly and do not provide the quality of fingerprinting information available in a video data stream.

To illustrate the functionality of an SSI, an example using a video camera is given. In this case, the SSI's software removes uninteresting areas of the scene (non-roadway areas) as defined during setup of the SSI. Video FOV's tend to include both roadway and non-roadway areas. By eliminating the non-roadway areas from further processing, SSI hardware requirements are reduced.

The SSI scans the roadway part of the video sensor's image to detect vehicles. The video sampling rate may be, for example, one frame per second. Preferably, the video sampling rate is variable and is based upon the particular conditions of the network. Several approaches common to image processing can be used for vehicle detection. Automated image processing is described in R. Haralick and L. Shapiro, *Computer and Robot Vision;* 1992; Addison-Wesley; Reading, Mass.; Chapter 2, 3, and 4 and W. Pratt, *Digital Image Processing;* 1991; Wiley; New York, N.Y.; Section 18.1 and N. L. Seed and A. D. Houghton, Background Updating for Real-Time Image Processing at TV Rates, 1988 which are incorporated herein by reference. The imagery associated with detected vehicles is then analyzed to develop a set of features or attributes that quantify a particular vehicle's fingerprint. The extracted attributes thus represent the fingerprint. Approaches from image processing and pattern recognition can be used for generation of the vehicle's attributes. Several such approaches are described in R. Haralick and L. Shapiro, *Computer and Robot Vision;* 1992; Addison-Wesley; Reading, Mass.; Chapter 9 and 10 and K. Fukunaga, *Introduction to Statistical Pattern Recognition;* 1972; Academic Press; New York, N.Y. which are incorporated herein by reference. For a video camera, typical attributes could include vehicle image size, average grey level, normalized red, green and blue average values, shape moments, and grey level spread between maximum and minimum grey level values of the vehicle's image.

An OSM sent to the MATS 240 from an SSI which is coupled to a video sensor is preferably composed of the time (time tag) that the sensors data stream was sampled and a record for each vehicle detected. The vehicle's record preferably includes:

(1) the vehicle's location in the sensor's FOV (2) the attributes quantifying the vehicle's fingerprint; and (3) the detection quality factor quantifying the likelihood that the vehicle was detected correctly.

Description of the MATS Data Flow Diagrams

This section provides the data flow diagrams (DFDs) that describe the functions and architecture of the MATS component of the system. This description will be made with reference to the system as applied to an example roadway area. Referring now to FIG. 23, there are shown two lanes 2300 of a multilane divided highway of the roadway area. The highway includes a first local area 2340, a second local area 2360, and an on ramp 2350. For monitoring the highway 2300, there are provided three sensors, sensor 1, sensor 2, and sensor 3, having corresponding FOVs, sensor 1 FOV 2310, sensor 2 FOV 2320, and sensor 3 FOV 2330. Sensor I FOV 2310 and sensor 2 FOV 2320 overlap in an overlap region 2315. Sensor 3 FOV 2330 is in the upstream area 2360 from traffic coming from the sensor 1 FOV 2310 and the sensor 2 FOV 2320. The region of the highway between the sensor 1 FOV 2310 and sensor 3 FOV 2330 comprises a link. The sensor FOVs define a registration point for each sensor, which is the point in the FOV at which the sensor is able to detect with sufficient accuracy a vehicle entering or exiting the FOV.

Multisensor Advanced Tracking System

Figure 3:
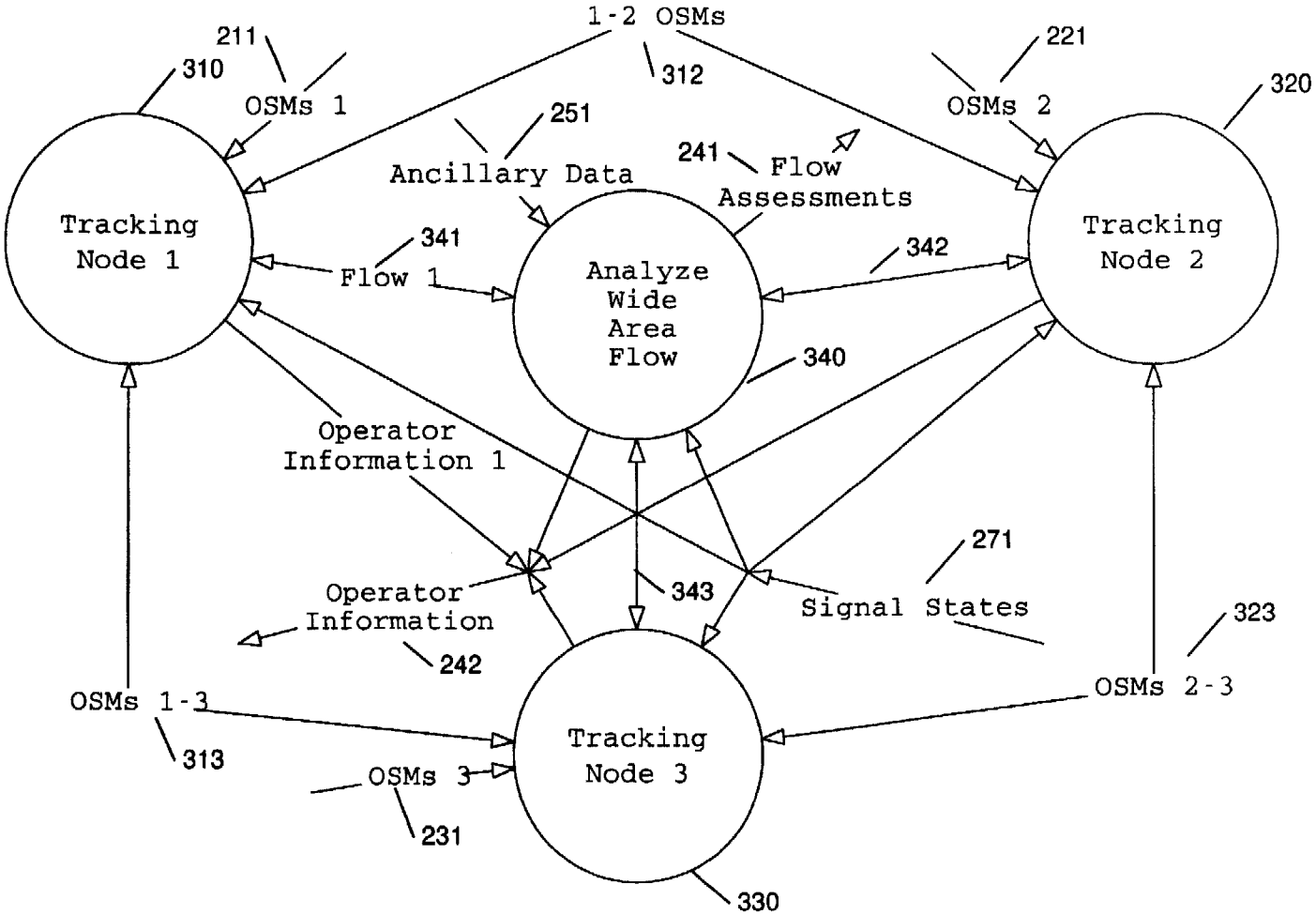
FIG. 3 is a data flow diagram of the MultiSensor Advanced Tracking System (MATS)

Referring now to FIG. 3, there is shown a data flow diagram of the MATS 240. This figure shows all the functions that occur both at the top MATS layer 140 and the bottom MATS layer 130. The functions of the top MATS layer 140 are implemented as a process called analyze wide area flow 340. The functions of the bottom MATS layer 130 are implemented in three processes entitled tracking node 1 (310), tracking node 2 (320), and tracking node 3 (330). Data flows between the analyze wide area flow process 340 and the tracking nodes 310, 320, 330 through flow 1 (341), flow 2 (342) and flow 3 (343), respectively. The particular data which flows between the analyze wide area flow process 340 and the tracking nodes is discussed below.

FIG. 3 illustrates the geographical partitioning of the system. For example, SSI 1 (210) provides data through the OSMs 1 data flow (211) directly into tracking node 1 (310). Tracking node 1 (310) provides an understanding, at the individual vehicle level, of the flow within the FOV of sensor 1. Tracking node 1 does not directly receive data from any other SSI. Similarly, tracking node 2 (320) is fed directly from SSI 2 (220), and tracking node 3 (330) is fed directly from SSI 3 (230). Hence, in the preferred embodiment each tracking node is geographically diverse or partitioned from the other tracking nodes. The system thereby achieves simplified processing in the bottom MATS layer 130 of the processing structure though modularization.

In the described embodiment, in addition to OSMs 1 (211), there are two other data flows coming into tracking node 1 (310)—one coming from tracking node 2 (320) and the other one coming from tracking node 3 (330)—designated as OSMs 1-2 (312) and OSMs 1-3 (313), respectively. The OSMs 1-3 (313) represents the fact that, in this embodiment, a section of the roadway 2300 links sensor 1 with sensor 3. Consequently, vehicles identified by sensor 1, will after a period of time (link time) transition down the roadway link and appear in the sensor 3 FOV. The OSMs 1-3 data flow 313 carries the object information representing the flow of vehicles across the link. Consequently, tracking node 3 (330) receives and processes OSMs coming from its own SSI 3 (230), OSMs 3 (231), along with object handovers from tracking node 1 (310). Furthermore, since sensor 1 and sensor 2 are overlapping, then OSMs are passed between tracking node 1 (310) and tracking node 2 (320) by a data flow called OSMs 1-2 (312).

Tracking node 1 (310) determines if a vehicle will proceed down a highway link and potentially enter the sensor 3 FOV 2330. If a vehicle is flowing down a link between the sensor 1 FOV 2310 and the sensor 3 FOV 2330, then tracking node 1 (310) will identify that event, extract the vehicle identification from its own internal database, and send the vehicle identification to tracking node 3 (330) for update of the tracking activity at tracking node 3 (330). The exchange of vehicle information between each of the tracking nodes is one of the important features of the illustrated system. It is by this mechanism that the link time, the amount of time required by a vehicle to transition from one sensor location to the next sensor location, is preferably measured. This is an important parameter for assessing the overall flow at the top layer of the processing layers.

Further, by exchanging vehicle information between the tracking nodes, origination-destination pairs can be assessed. In other words, a tracking node ID is attached to a vehicle's database record as the vehicle proceeds through the sensor 1 FOV 2310 of sensor 1. When the vehicle appears in the sensor 3 FOV 2330, an ID is supplied to the vehicle at tracking node 3 (330), and so forth, throughout the entire system. In this way, location sighting data can be accumulated for each vehicle as it proceeds through the entire highway system. The location sighting data is an important statistic allowing traffic origination and destination to be assessed and measured.

The flow assessments developed at the highest layer of the processing structure flow down into the tracking nodes to aid the internal tracking algorithms. Items of ancillary data 251 useful within the tracking nodes 310, 320, 330 flow from the highest layer (FIG. 3) represented by the analyze wide area flow process 340 to the tracking nodes 310, 320, 330. Also, signal states 271 from the area signal control 270 flow into the tracking nodes. Further, information about the individual vehicle flows is aggregated in the tracking nodes and sent to the analyze wide area flow process 340 where it is utilized in the top MATS layer 140 assessment of the flow along the entire roadway. Preferably, operators may obtain upon demand information at an individual vehicle level which has been accumulated within the tracking nodes and sent to the operator interface 260.

The analyze wide area flow process 340 provides within the top MATS layer 140 an understanding and assessment of the flow along the entire section of roadway. Information utilized by this process includes aggregated individual flow information 341, 342, 343 from each of the tracking nodes 310, 320, 330, hence, from each of the sensors. This aggregated information is used within the process 340 to model the flow by use of a macro modeling technique. Macro modeling techniques are described in A. May, *Traffic Flow Fundamentals;* 1990; Prentice-Hall; Englewood Cliffs, N.J.; Chapter 13, which is incorporated herein by reference. The resulting flow information is fed back to the area signal control 270 through the flow assessment data flow 241 and back to the operator through the operator information data flow 242. As with the tracking nodes 310, 320, 330, the operator interface data is produced from the analyze wide area process 340 on demand.

In the descriptions to follow, only tracking node 1 (310) will be described. Tracking node 2 (320) and tracking node 3 (330) are substantially identical in functionality to tracking node 1 (310), except where explained below.

Tracking Node 1 (310)

Figure 4:
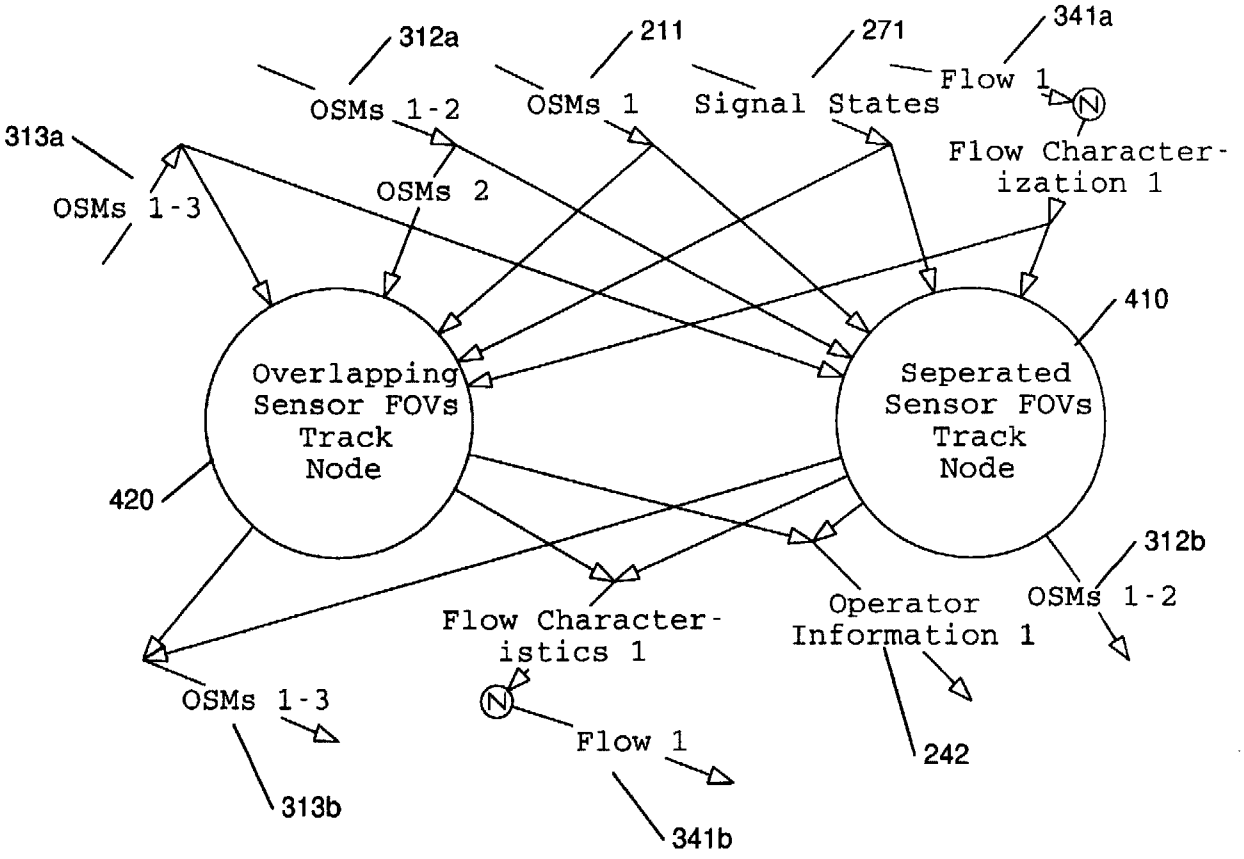
FIG. 4 is a data flow diagram of a tracking node in the MATS of FIG. 3.

Referring now to FIG. 4, there is shown a data flow diagram of tracking node 1, as a model of tracking nodes in the system. In particular, this diagram shows that the tracking node is separated into two cases, an overlapping sensor FOVs tracking node 420 and a separated sensor FOVs tracking node 410. Both of these subsidiary tracking nodes are preferably included within each primary tracking node, since a particular sensor, such as sensor 1 may have an overlapping FOV with some sensors (i.e. sensor 2) and have a separate FOV from other sensors (e.g. sensor 3).

Recall that in this example, sensor 1 FOV 2310 and sensor 2 FOV 2320 overlap. Thus, the overlapping sensor FOVs tracking node 420 receives OSMs from SSI 1 (210) through data flow OSMs 1 (211), and tracking node 2 through data flow OSMs 1-2 (312*a*). The separated sensor FOVs tracking node 410 receives OSMs from: SSI 1 (210) through data flow OSMs 1 (211); tracking node 2 (320) through data flow OSMs 1-2 (312*a*); and tracking node 3 (330) through data flow OSMs 1-3 (313*a*).

In FIG. 4, a further breakdown of the data flows between the tracking node 310 and the analyze wide area flow process 340 can be seen. The data 341 a received by the tracking node 310 are characterizations of the wide area flow. The data 341*b* transmitted by the tracking node 310 to the analyze wide area flow process 340 are characteristics of the traffic flow.

Regardless of whether sensor 1 and sensor 2 have overlapping FOVs, and so long as they are at least linked, OSMs from tracking node 1 (310) will be transmitted by OSMs 1-2 (312) to tracking node 2 (320). A similar configuration applies with respect to sensor 3.

Separated Sensor FOVs Tracking Node 410

Figure 5:
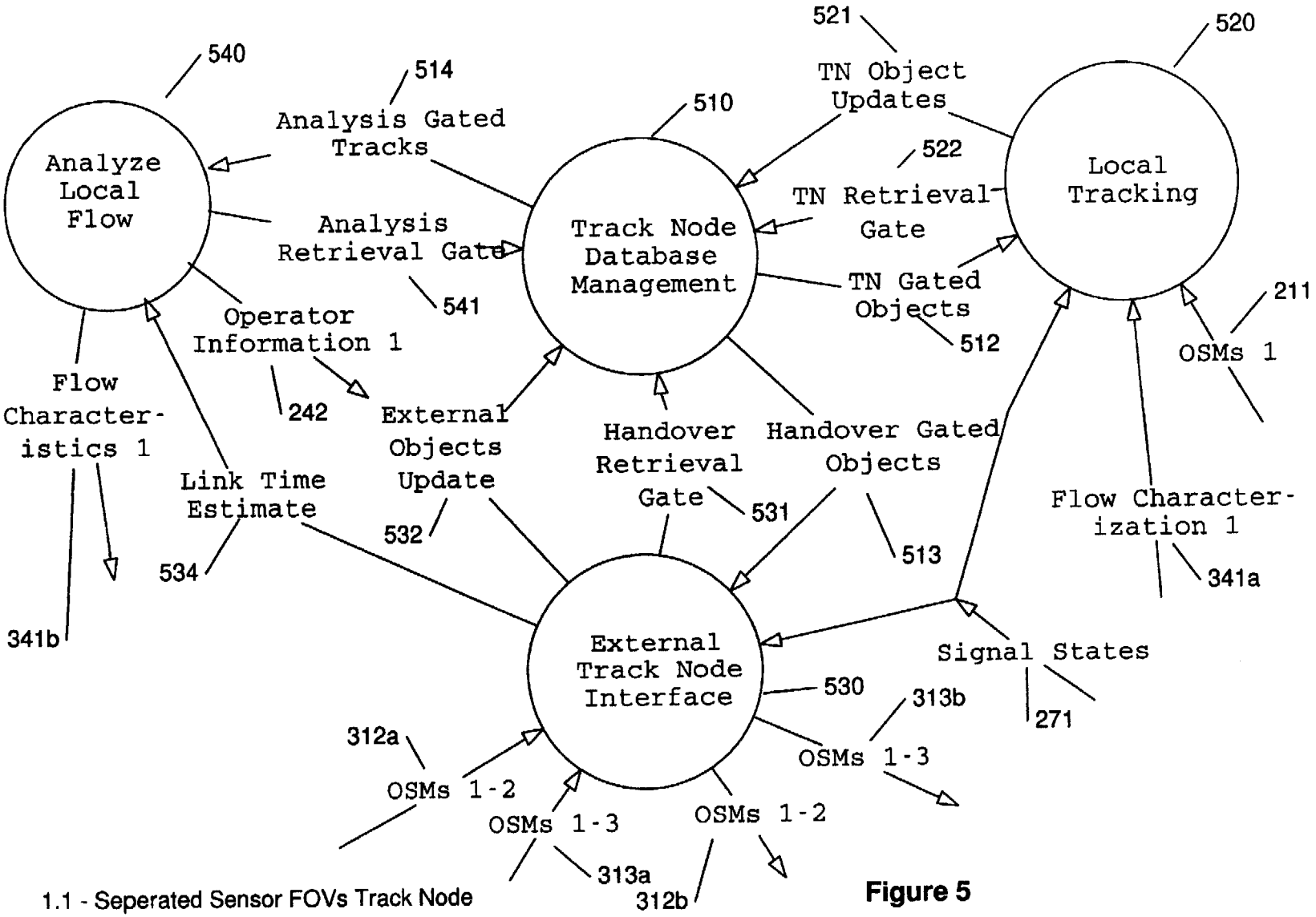
FIG. 5 is data flow diagram of a separated sensor FOVs tracking node of the tracking node of FIG. 4.

Referring now to FIG. 5, there is shown a data flow diagram of the separated sensor FOVs tracking node 410. The separated sensor FOVs tracking node 410 includes: a tracking node database manager 510, a local tracking process 520, an external tracking node interface 530, and an analyze local flow process 540. Other tracking nodes to this tracking node are called "external tracking nodes," and processing for this tracking node is called "local."

The external tracking node interface 530 handles the interface or OSM handover to the other tracking nodes. Hence, the external tracking node interface 530 receives data through OSMs 1-2 (312*a*) and OSMs 1-3 (313*a*), and transfers data through OSMs 1-2 (312*b*) and OSMs 1-3 (313*b*). The external tracking node interface 530 also estimates link time and transfers this information through a link time estimate data flow 534 to the analyze local flow process 540.

The analyze local flow process 540 provides analysis of the local flow in order to extract operator information and flow characterization for the top MATS layer 140. For example, this process 540 might aggregate tracks over a given time period as a measure of local flow for that time period. The flow characterization is sent on the flow characteristics data flow 341*b*. The information produced by the analyze local flow process 540 is described more fully in the description of the analyze wide area process 340, below. The operator information which may comprise any local flow information which the operator requests, as described above, is sent on the operator information data flow 242.

The local tracking process 520 provides the local tracking functionality. This process converts OSMs from OSMs 1 (211) into a description of a flow of an individual vehicle through the sensor's FOV. The description of the movement of an individual vehicle through a particular sensor's for FOV is called a "track" herein. Local tracking 520 is the step which converts data from the sensor associated with the tracking node, here sensor 1, into vehicle flow information.

The concept utilized in this DFD explanation is centered around a database, implemented in the tracking node database manager 510. All object information is kept as records within the database. A database record preferably includes the following data:

(1) Object Source Registration point time tag;
(2) Predicted time of arrival within sensor FOV;
(3) Time tag of the object sighting;
(4) Location in the sensor FOV of the vehicle;
(5) Lane (or pseudo lane) in which the vehicle was found;
(6) Attributes quantifying the vehicle's fingerprint;
(7) ID of each sensor that has detected the vehicle;
(8) Track ID identifying the track to which the vehicle belongs;
(9) Track characteristic including track split or track merge;
(10) Track quality;
(11) Flow information (velocity, acceleration) for this vehicle;
(12) Vehicle classification (for example, pedestrian, motorcycle, car/pickup, truck, bus, etc.) of this vehicle; and
(13) Vehicle behavior such as lane changing.

The tracking node database manager 510 is used by the other processes 520, 530, 540 of the tracking node. In this architecture the database serves as the data memory for the objects (vehicles) found by the SSS. This requires that the database be constructed for concurrent operation. Concurrently operating databases are described in J. Ullman, *Principles of Database Systems;* 1980, Computer Science Press; Potomac, Md.; Chapter 10, which is incorporated herein by reference. The other processes 520, 530, 540 operate on records (objects) within the database to develop flow information and to update the database. Thus, the processes transfer data (i.e. communicate) through the database. The substance of these exchanges and the related data flows are discussed below. In this data flow diagram, only the link time estimate 534 is communicated directly from the external tracking node interface 530 to the analyze local flow process 540. This allows the other processes to run autonomously, thereby simplifying software design.

The other processes 520, 530, 540 generate retrieval specifications or queries to obtain information from the database, and provide updates to the database. Information retrieved from the database in response to queries for objects are called "gated objects" herein. Information retrieved from the database to queries about local flow of specific objects are called "gated tracks" herein. The local tracking process 520 and the external tracking node interface 530 have the dual roles of users of information from the database and updates of the information in the database. The external tracking node interface 530 receives object sighting information from the other tracking nodes as explained above, processes that information, and places the information into the database with the appropriate tagging. Further, the external tracking node interface 530 queries the database to see if an object is predicted to enter the FOV of a subsequent tracking node or sensor; if so, the external tracking node interface 530 forms an OSM and sends that particular information out on the appropriate data flow (here OSMs 1-2 or OSMs 1-3).

The local tracking process 520 is responsible for stringing together tracks through data association of objects in the tracking node database. This process converts individual OSMs into strings of objects forming tracks which represent the flow for an individual vehicle. This is important since the tracks form the basis of flow characterization. Forming individual vehicle tracks allows characterization of the vehicle's velocity and the vehicle's merging or turning behavior. Classification of vehicles such as motorcycle, car, pick-up, truck, and emergency vehicle is also implemented by the local tracking process 520.

Tracking Node Database Manager 510

Figure 6:
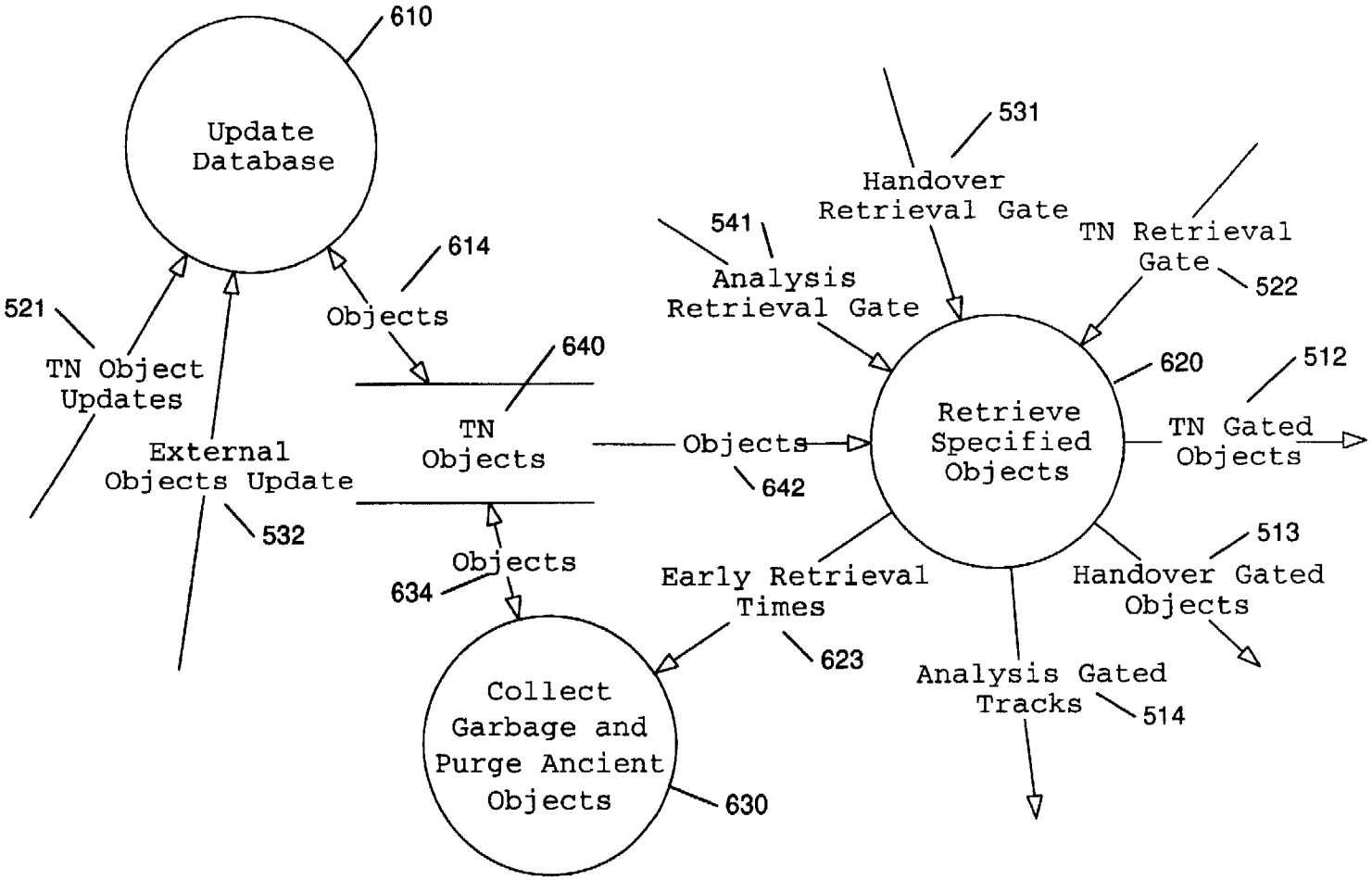
FIG. 6 is a data flow diagram of a tracking node database management process of the separated sensor FOVs tracking node of FIG. 5.

Referring now to FIG. 6, there is shown a data flow diagram of the tracking node database manager 510. FIG. 6 also shows a portion of the database used for storage of the tracking node's objects—TN objects 640. The tracking node database manager 510 includes an update database process 610, a retrieve specified objects process 620, and a collect garbage and purge ancient objects process 630.

The update database process 610 is straightforward. This process 610 takes update information from the local tracking process 520 and the external tracking node interface 530, converts the update information into object updates, and updates the object's records in TN objects 640.

The primary function of the database is retrieval of objects needed for data association and flow analysis. This function is performed by the retrieve specified objects process 620. The retrieve specified objects process 620 receives specifications from the analyze local flow process 540 referred to as the analyze retrieval gate 541, from the local tracking process 520 referred to as the TN retrieval gate data flow 522, and from the external tracking node interface 530 referred to as the handover retrieval gate data flow 531.

The retrieve specified objects process 620 takes these retrieval specifications, retrieves all objects meeting the specification, and sends the objects back to the requesting process. The objects are sent back on any of three data flows: a TN gated objects data flow 512, a handover gated objects data flow 513, or an analysis gated tracks data flow 514. The local tracking process 520 receives tracking node gated objects on the TN gated objects data flow 512. The external tracking node interface 530 receives handover gated objects on the handover gated objects data flow 513. The analyze local flow process 540 receives analysis of gated tracks on the analysis gated tracks data flow 514.

For example, another tracking node might send through the handover retrieval gate data flow 531 the following specification "Retrieve all objects with sensor ID =23 and time tags between 12245 and 12319". The retrieve specified objects process 620 would obtain these objects from the data store 640 and return them to the other tracking node via the external tracking node interface 530 through the handover gated objects data flow 513.

The collect garbage and purge ancient objects process 630 is responsible for the management of the database structure. Objects are deemed ancient in the sense that the objects have left the FOV of the sensor or are so old that they are no longer of interest to the tracking activities. This function goes through the database and purges records meeting the ancient specification, which keeps the storage requirements within bounds.

The other function carried out by the collect garbage and purge ancient objects process 630 is the garbage collection function. Garbage collection is described in J. Ullman, *Principles of Database Systems;* 1980, Computer Science Press; Potomac, Md.; Chapter 2 which is incorporated herein by reference. If this system is to be used for long-term operation, the structure of the database can become inefficient. The database can be filled with memory areas that are unused. If errors occur, this can compound the database storage problem. Garbage collection is a database function which periodically analyzes the database structure, the memory utilization, how records are linked together within the database, and does database compaction and structure correction. It also purges records within the database which no longer fit the database structure due to errors or other abnormal database events. This process 630 is run in a background mode, awakening periodically for a cleaning operation on the database. The update database process 610, and the retrieve specified objects process 620 functions are run on demand. When data is received on an appropriate data flow, these processes run; otherwise, they remain in stasis.

Update Database 610

Figure 7:
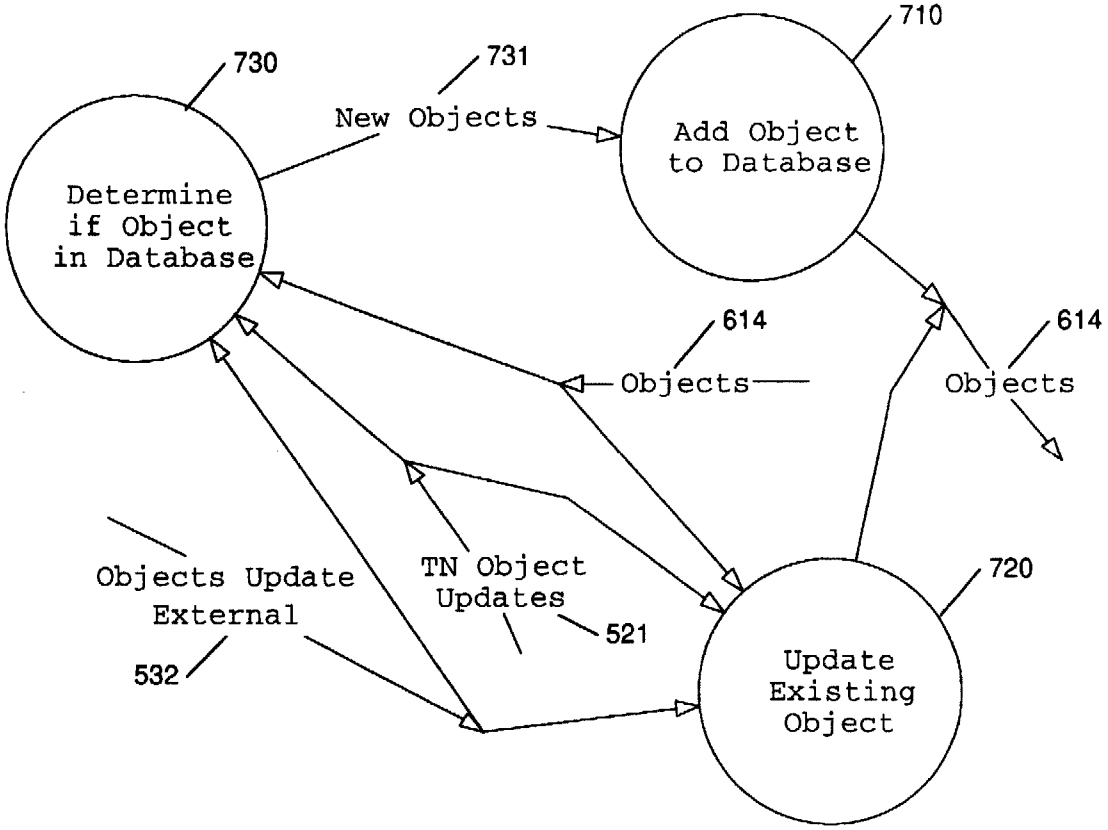
FIG. 7 is a data flow diagram of an update database process of the tracking node database management process of FIG. 6.

Referring now to FIG. 7, there is shown a data flow diagram of the database update process 610. In the update process 610, either a new object will be added to the database by an add object to database process 710, or an existing object will be updated by an update existing object process 720. The decision of whether to add a new object or update an existing object is performed by a determine if object in database process 730.

An object may be received by the determine if object in database process 730 from any of two sources: an external objects update data flow 532, or a TN object update data flow 521. The external object update data flow 532 transfers objects from the external tracking node interface 530 (FIG. 5); such objects comprise object sighting information received from other tracking nodes. These objects represent vehicles which are likely to enter the FOV of the sensor associated with this tracking node. The TN object update data flow 521 transfers objects from the local tracking process 520 (FIG. 5). These objects relate to vehicles which are in the FOV of the sensor associated with this tracking node.

In processing objects received from either data flow 521, 532, first, the determine if object in database process 730 determines whether or not an object to be updated exists in the database. If not, the object is termed a new object and the add object to database process 710 is invoked. This process 710 is responsible for formulating a new record for the database, initializing that record, attaching all of the identification criteria to identify that object to be associated with this particular node, and installing the new record in the database.

If the update object coming in from either the external objects update data flow 532 or the TN objects data flow 521 is found in the database, then this object, with new information developed from one of the feeding processes, is updated within the database itself by the update existing object process 720.

Local Tracking 520

Figure 8:
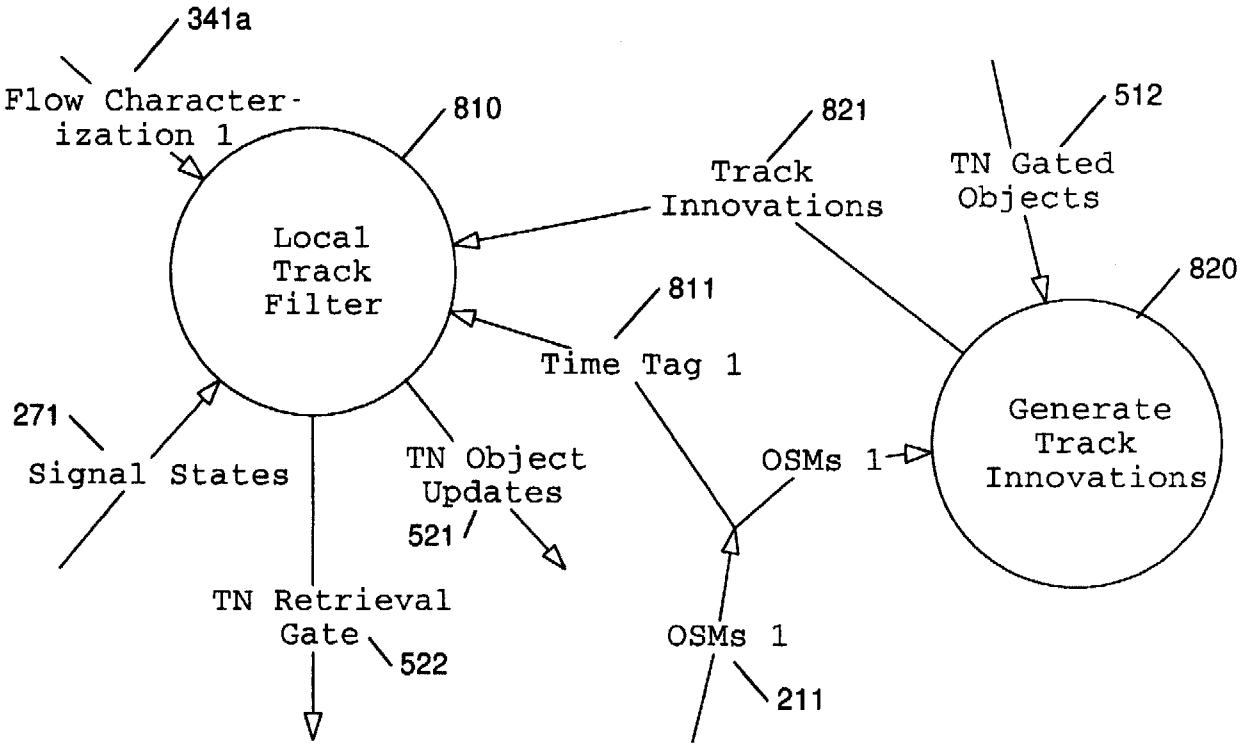
FIG. 8 is a data flow diagram of a local tracking process of the separated sensor FOVs tracking node of FIG. 5.

Referring now to FIG. 8, there is shown a data flow diagram of the local tracking process 520. Local tracking 520 includes a local track filter process 810 and a generate track innovations process 820. A track innovation is defined herein as the difference between a vehicle's measured location and the location predicted for the vehicle based upon the vehicle's track, local flow, and area flow. At a high level, the generate track innovations process 820 can be thought of as a function which analyzes the OSMs coming in from SSI 1 (210) on the OSMs 1 data flow (211) together with objects from the TN gated objects data flow 512. The generate track innovations process 820 correlates those two data sources into track innovations which are then transferred to the local track filter 810 by a track innovations data flow 821. The local track filter 810 uses the track innovations from the track innovations data flow 821 to produce the TN object updates data flow 521 for updating the database with the latest object information. Details on these two functions are given below.

Local Track Filter 810

Figure 9:
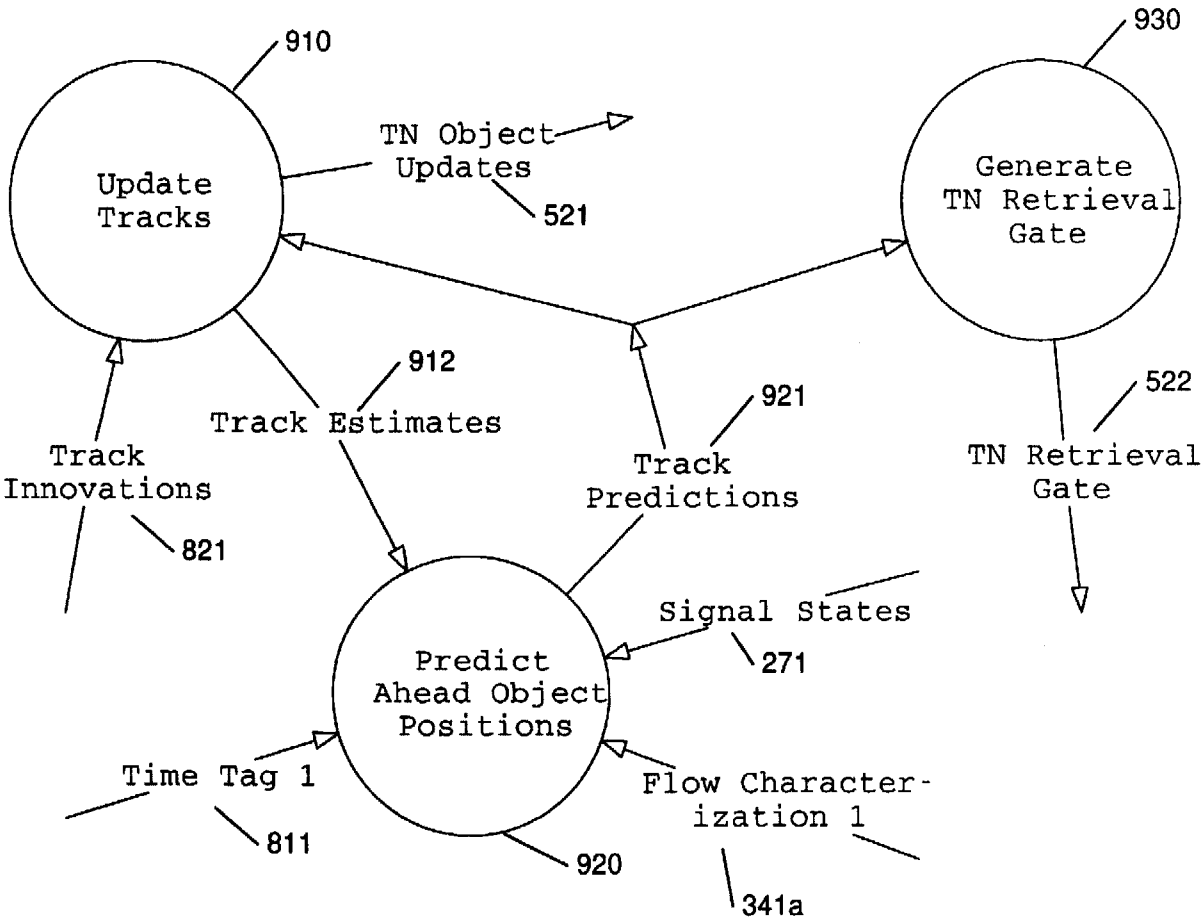
FIG. 9 is a data flow diagram of a local track filter process of the local tracking process of FIG. 8.

Referring now to FIG. 9, there is shown a data flow diagram of the local track filter 810. The local track filter 810 includes: an update tracks process 910, a predict ahead object positions process 920, and a generate TN retrieval gate process 930. The local track filter 810 is a predictor-corrector Kalman-like filter. The update tracks process 910 forms the correction part. The predictor part is implemented by the predict ahead object positions process 920. The measurement component of the Kalman loop is embedded in generation of the innovations which is supported by the generate TN retrieval gate process 930.

When a new OSM is received from SSI 1 (210), a time tag 1 data flow 811, which is extracted from the OSMs 1 data flow (211), holds the time used for prediction of all present tracks within the update tracks process 910. The predict ahead object positions process 920 predicts track positions (921) based upon: (a) track estimates transferred from the update tracks process 910 through a tracks estimates data flow 912, (b) characterization of the flow within the area of sensor 1 provided by the flow characterization data flow 341 a from the top MATS layer 140, and (c) the signal states 271. These track predictions are based on a micro model for the vehicles within the field of view of sensor 1. Such micro models are described in W. Leutzbach, *Introduction to the Theory of Traffic Flow;* 1988; Springer-Verlag; Berlin, Germany and A. May, *Traffic Flow Fundamentals;* 1990; Prentice-Hall; Englewood Cliffs, N.J.; Chapter 6 which are incorporated herein by reference. Track estimates 912, signal states 271, and flow characterization 341*a* are inputs to this model. The model provides the track predictions 921 which are used in the next track update and for gating of the database retrieval.

Along with the predicted locations of each of the vehicles included in the track predictions data flow 921 are variance measures for these tracks which are also generated in the predict ahead object positions process 920. These variances are calculated using standard Kalman update procedures utilizing a variance for the track estimates which is included along with object information in the track estimates data flow 912 coming from the update tracks process 910. Such techniques are generally described in P. Maybeck, *Stochastic models, estimation, and control;* 1979; Academic Press; New York, N.Y.; Chapters 9, 10, and 12 of Volume 2 which is incorporated herein by reference.

Predicted track locations and their variances flow to the generate TN retrieval gate process 930 through the track predictions data flow 921. This process 930 is responsible for generating the TN retrieval gate data flow 522 which contains the specification for the retrieval sent to the tracking node database manager 510. The tracking node database manager 510 retrieves all vehicles (objects) specified by the TN retrieval gate message 522 and sends the objects through the TN gated objects data flow 512 to generate track innovation process 820 (FIG. 8). The generate TN retrieval gate process 930 defines the retrieval specification so that all objects within the tracking node database 640 which can be associated with the track predictions will be retrieved from the database.

The description of the update tracks process 910 is provided in the next section.

Update Tracks 910

Figure 10:
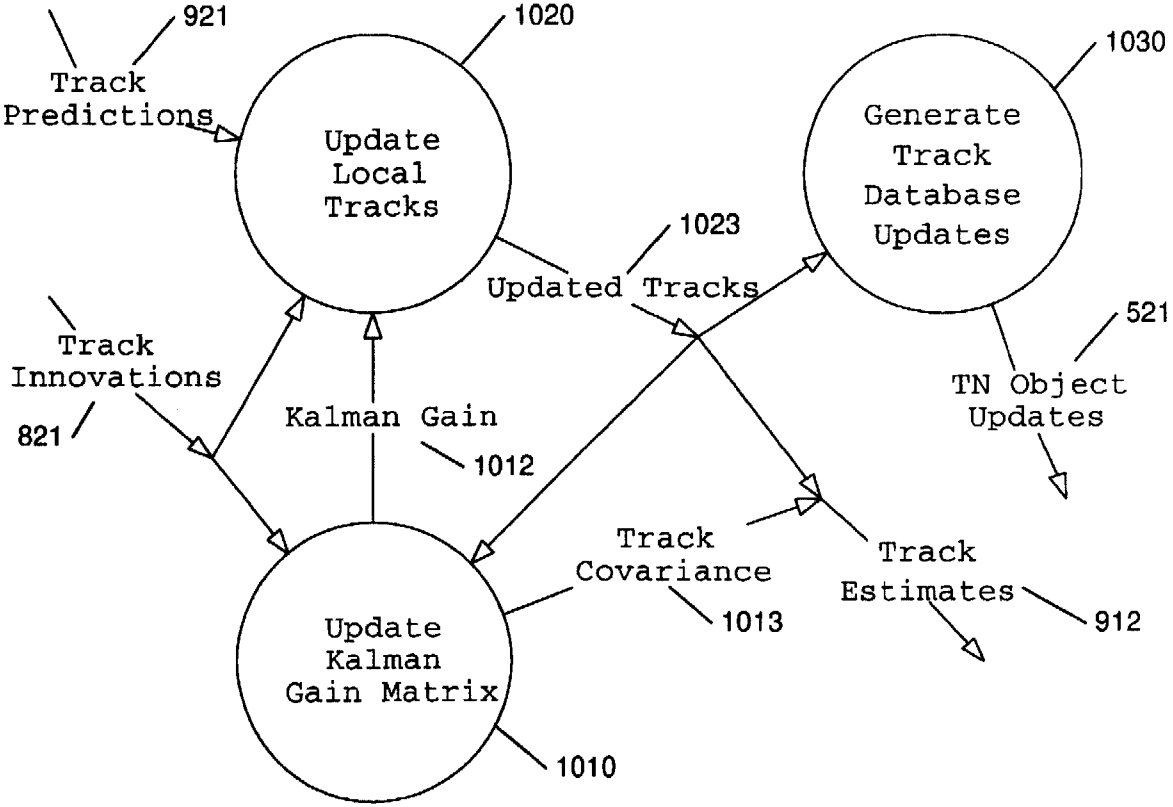
FIG. 10 is a data flow diagram of an update tracks process of the local track filter of FIG. 9.

Referring now to FIG. 10, there is shown a data flow diagram of the update tracks process 910. The update tracks process 910 includes an update local tracks process 1020 which implements a Kalman-like update strategy. The update local tracks process 1020 utilizes track innovations transferred by the track innovations data flow 821 and Kalman gain calculations transferred through a Kalman Gain data flow 1012 provided by an update Kalman gain matrix process 1010 to correct the track predictions, thus obtaining the updated tracks data flow 1023. A quality measure for each innovation is developed in the generate track innovations process 820 (FIG. 8) and is included in the track innovations data flow 821. The quality measure or probability of correct assignment is utilized by the update local tracks process 1020 during the track updates. Quality measure and probability of correct assignment are described in P. Maybeck, *Stochastic models, estimation, and control;* 1979; Academic Press; New York, N.Y.; Chapters 9, 10, and 12 of Volume 2; and Y. Bar-Shalom and T. Fortmann; *Tracking and Data Association;* 1988; Academic Press, San Diego, Calif. which are incorporated herein by reference. For example, if the probability of a correct assignment is low then the resulting innovation for this track would be lightly weighted compared to innovations having a high probability of correct assignment. This process also contains track splitting and track merging logic to handle the case of unresolved vehicles within the sensor's FOV.

The update Kalman gain matrix process 1010 generates both the Kalman gain 1012 utilized in the update local tracks process 1020 and track covariance matrices 1013 which is included in the track estimate data flow 912. The update Kalman gain matrix process 1010 and the track covariance data flow 1013 can be computed using the extended Kalman filter update strategy and the innovation quality measures. Such computations are described in P. Maybeck, *Stochastic models, estimation. and control;* 1979; Academic Press; New York, N.Y.; Chapters 9, 10, and 12 of Volume 2; and Y. Bar-Shalom and T. Fortmann; *Tracking and Data Association;* 1988; Academic Press, San Diego, Calif.; Section 9.4. which are incorporated herein by reference. The updated Kalman gain 1012 is utilized in the update local tracks process 1020 for the updating tracks on the next set of OSMs. messages.

The generate track database updates process 1030 takes the updated tracks including their confidence measures and generates the message for updating or refreshing the database. This message is sent out on the TN objects updates data flow 521 to the database. A typical TN objects update message preferably contains for each object addressed by the update tracks process 910 the following information: track ID, updated vehicle classification, updated vehicle position, velocity, and acceleration, lane or pseudo lane(s) vehicle determined to be in, updated vehicle attributes, updated track quality, track characteristics, and vehicle behavior.

The generate track database updates process 1030 takes the other information developed by the generate track innovations process 820 and included in the track innovations data flow 821 that was not utilized in the track update and updates the database with it. This information includes:

(1) new objects not associated with existing tracks;

(2) track splits and track merges;

(3) multiple models and multiple track hypothesizes; and (4) other possibilities extracted during the assignment operation.

Generate Track Innovations 820

Figure 11:
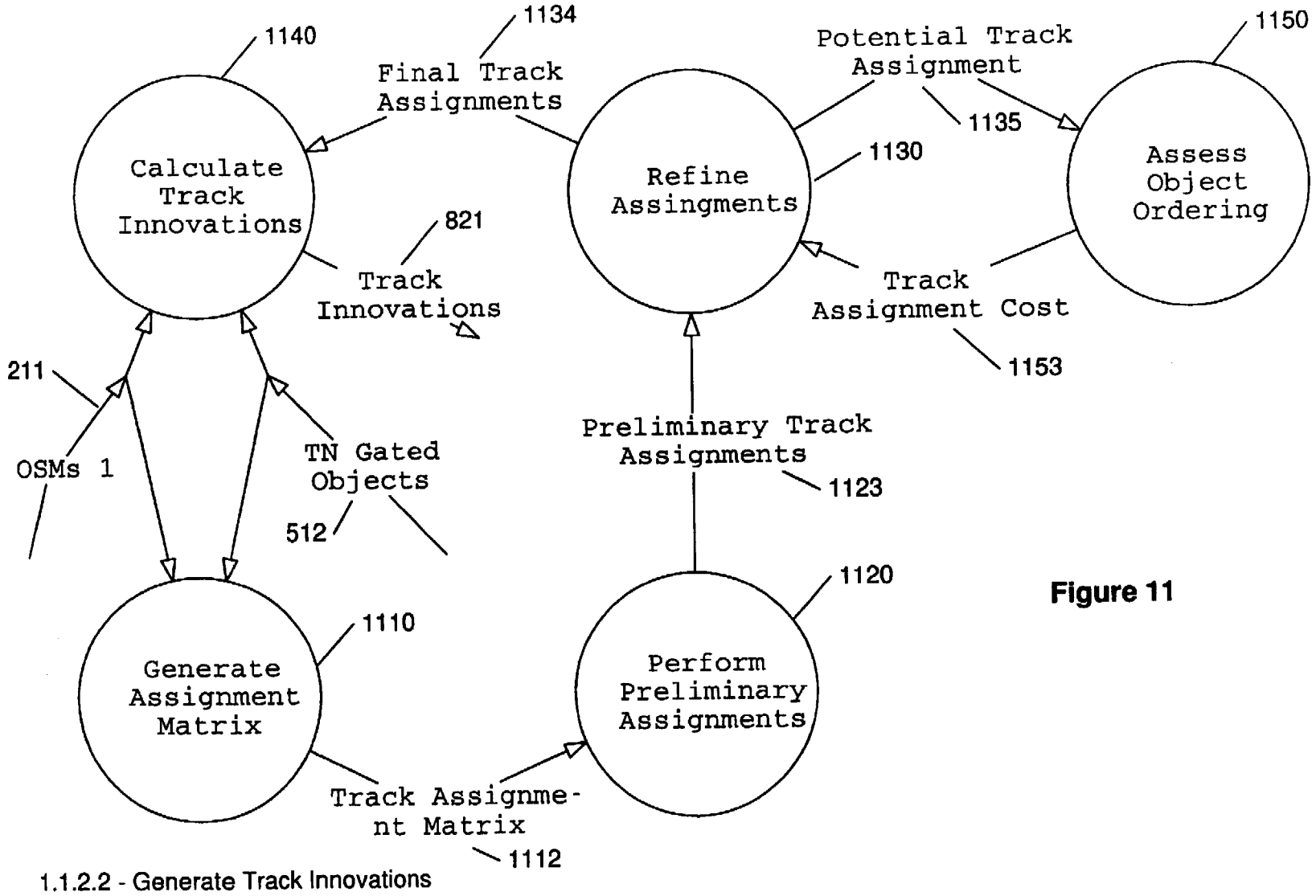
FIG. 11 is a data flow diagram of a generate track innovations process of the local tracking process of FIG. 8.

Referring now to FIG. 11, there is shown a data flow diagram of the generate track innovations process 820. This function 820 is composed of five processes which operate on OSMs from SSI 1 (210) on the OSMs 1 data flow 211, and on the TN gated objects 512 retrieved from the database. These processes include a generate assignment matrix process 1110, a perform preliminary assignments process 1120, a refine assignments process 1130, a calculate track innovations process 1140, and an assess object order process 1150. The generate track innovations process 820 correlates object data sources through a data association algorithm in order to calculate the track innovations used in the update tracks process 910. Data association algorithms are described in Y. Bar-Shalom and T. Fortmann; *Tracking and Data Association;* 1988; Academic Press, San Diego, Calif. which is incorporated herein by reference.

Track innovations are used for updating or correcting the tracks by the update tracks process 910 (FIG. 9). In order to generate track innovations, objects from the OSMs 1 data flow 211 are first associated with (assigned to) TN gated objects from the tracking node database manager 510 transferred through the TN gated objects data flow 512 (FIG. 5). The first step in producing track innovations is the generation of an assignment matrix in the generate assignment matrix process 1110. Assignment matrices are described in S. Blackman, *Multiple-Target tracking with Radar Applications;* 1984; Artech House; Norwood, Mass.; Chapter 4, which is incorporated herein by reference. The generate assignment matrix process 1110 generates an array which measures the distance (feature distance) between each object in OSMs 1 and each object in TN gated objects 512. The result is a track assignment matrix which is transferred through the track assignment matrix data flow 1112 to the perform preliminary assignments process 1120.

Each element of the assignment matrix contains the distance between an object from OSMs 1 (211) and an object transferred by the database manager 510 from the TN gated objects data flow 512. The distance can be a standard distance measure typically utilized in multitarget tracking which measures the similarity of two objects based on object attributes and locations. Vehicle tracking is in one sense simpler than classical multi-target tracking, because vehicles do not easily change their order as they go though the FOV of a sensor. That is, if vehicle A leads vehicle B at the time of one sensor's output sample, then vehicle A is more likely to lead vehicle B at the time of a later sensor's output sample. On the short term, the order of vehicles on the roadway tends to remain constant. This can be a significant source of information to be utilized in the association process. One way to utilize this information is to compare the objects before and after within the same lane in generating the distance measure. Hence, the time difference between the object and the preceding and post object, along with their attribute distances, are also utilized in generating the distance which is included in the track assignment matrix.

The completed assignment matrix is included in the track assignment matrix data flow 1112 which is transferred to the perform preliminary assignments process 1120. This process 1120 utilizes information in the track assignment matrix to generate an initial or preliminary assignment of vehicles identified in the OSMs 1 data flow 211 and the TN gated objects data flow 512. Since for a single sensor's FOV, the number of objects is relatively small, an optimal assignment algorithm can be utilized to perform preliminary assignments process 1120. Assignment algorithms are described in J. Munkres, Algorithms for the Assignment and Transportation Problems; SIAM J. Control; Volume 5, March, 1957, pp 32–38 which is incorporated herein by reference. The resulting assignments and the assignment matrix are placed on a preliminary tracking assignments data flow 1123 and transferred to the refine assignments process 1130.

As explained above, the perform preliminary assignments process 1120 utilize an assumption on the order of vehicles within a lane. This assumption is reflected in the preliminary trade assignments. The assumption is that the vehicle order remains exactly the same from OSMs 1 to TN gated objects. This is not always true, especially in situations where lane changing can occur. The possibilities of lane changing need to be assessed, and the assignments need to be modified if it is determined that lane changing has occurred. An approach to this is to form multiple models for the vehicle's path, each model representing one possible path. On a roadway there are a limited number of possible paths which makes this approach practical. Based on this multiple model representation a multiple hypothesis tracking filter can be utilized. Multiple models and their use are described in Y. Bar-Shalom and T. Fortmann; *Tracking and Data Association*; 1988; Academic Press, San Diego, Calif.; Section 4.3 and 7.4 which is incorporated herein by reference.

The preliminary tracking assignments flowing from the perform preliminary assignments process 1120 into the refine assignments process 1130 form a starting point to assess whether or not the object ordering is correct or whether lane changing has or could have occurred. Thus, a multiple model representation is required. The refine assignments process 1130 assesses the possibility of lane changing or order changes within the flow of objects. The refine assignments process 1130 is implemented by generating heuristically the set of possible alternative assignments (hypotheses) which are different than the preliminary track assignments. These are referred to as multiple hypotheses. These potential or different hypotheses are transferred to an assess object ordering process 1150 through a potential track assignment data flow 1135. The assess object ordering process 1150 assesses the quality or the "goodness" of that alternate hypothesis and returns back to the refine assignments process 1130 the track assignment cost or the quality of that potential hypothesis. Logic within the refine assignments process 1130 then selects from the set of hypotheses the best hypothesis, forming a final track assignments data flow 1134. For each object within the OSMs 1 data flow 211 or the TN gated objects data flow 512, the refine assignments process 1130 will select from the following list of possibilities:

(1) a single assignment (i.e. one object to one existing track);

(2) a null assignment (i.e. the object associates with no other object, it is a new object);

(3) merged object (i.e. the object has merged with other objects);

(4) split track (i.e. the object has broken away from another object with which it was merged);

(5) multiple model object(s) (i.e. the object could be continued on more than one path thus requiring the tracker to carry multiple models for this object); or (6) extinguished track (i.e. object(s) can no be associated with this track).

The calculate track innovations process 1140 calculates track innovations for the update tracks process 910 based upon the final track assignments. Based on the final assignments, the calculate track innovations process 1140 computes a probability of correct assignment which is attached to each of the innovations and flows out on the track innovation data flows 821 to the update tracks process 910. For objects for which multiple models are being maintained, the calculate track innovations process 1140 calculates an innovation for each model. For the other objects this process 1140 transfers the information to the track innovations data flow 821 that is needed for the generate track database updates process 1130.

External Tracking Node Interface 530

Figure 12:
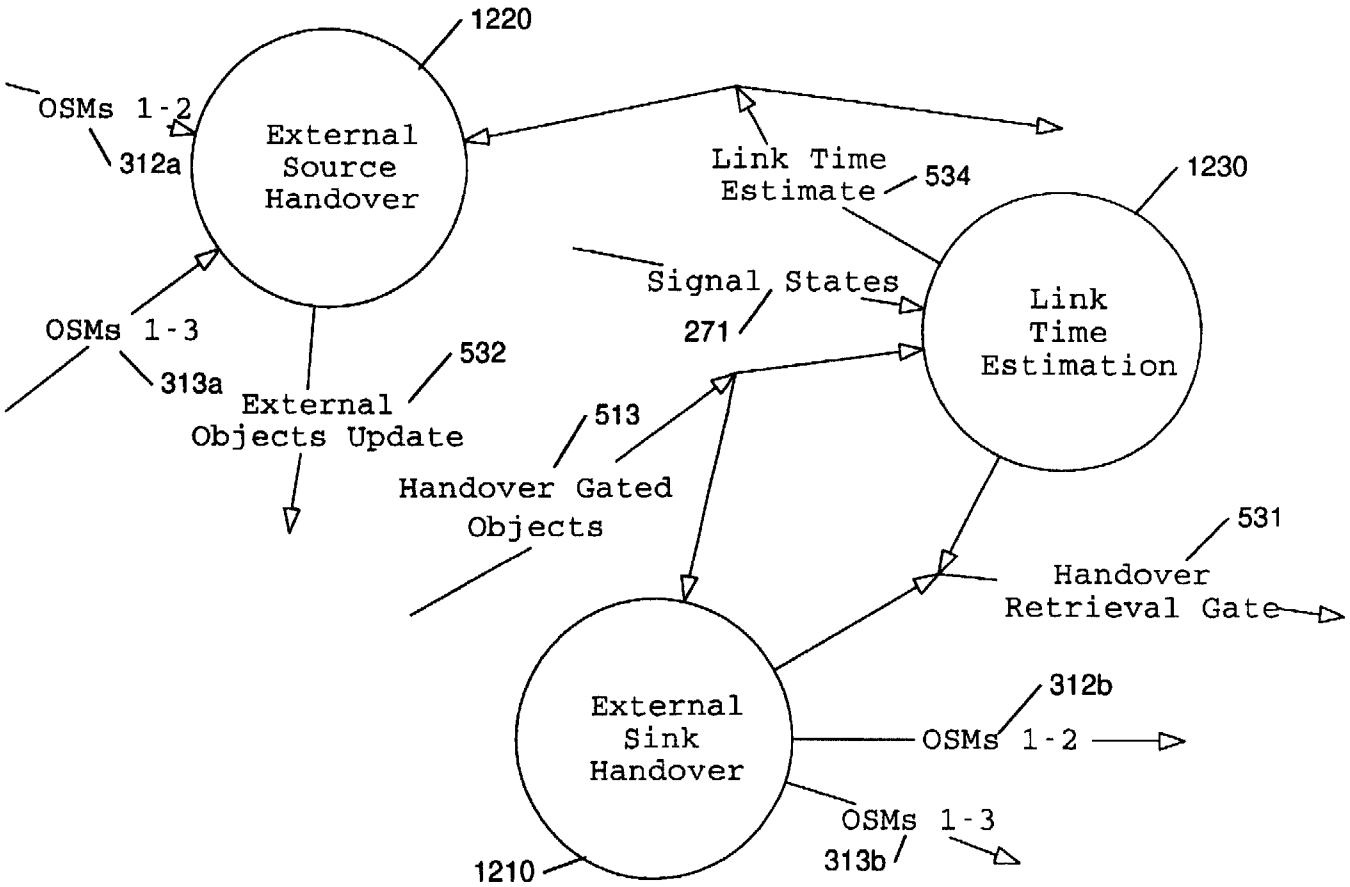
FIG. 12 is a data flow diagram of an external tracking node interface of the separated sensor FOVs tracking node of FIG. 5.

Referring now to FIG. 12, there is shown a data flow diagram of the external tracking node interface 530 discussed with reference to FIG. 5. This process includes an external sink handover 1210, an external source handover 1220, and a link time estimation process 1230. Two of the processes, the external sink handover 1210 and the external source handover 1220, handle formatting and extraction of data from the database. The link time estimation process 1230 performs processing needed to support an extraction function of the external source handover 1220.

The external sink handover 1210 is responsible for analyzing the database, detecting when an object is leaving sensor 1 FOV (2310), and determining based on the object's track, whether or not the object is on a lane or pseudo lane that will take it into the FOV of one of the other sensors. If that object can geometrically transition over the road system and get to one of the other sensors, then the external sink handover 1210 extracts the object from the database, formats it, and sends it to the appropriate tracking node where it can be later picked up, associated, and placed into a track as it goes through the FOV of that sensor.

The external sink handover 1210 operates in a background mode generating handover retrieval gate specifications through the handover retrieval gate data flow 531 to the tracking node database manager 510. The database manager 510 retrieves the objects, as explained above, and transfers the gated objects back to this process 1210 through the handover gated objects data flow 513. Then the external sink handover process 1210 analyzes these gated objects to see if they meet the requirements for a handover to another tracking node. For example, if an object is detected to be in the sensor 1 FOV (2310) on a path that will take the vehicle to sensor 3, then the external sink handover 1210 of tracking node 1 routes an OSM to tracking node 3 (330) so that the vehicle track can be continued as the vehicle enters the sensor 3 FOV (2330). If the vehicle was predicted to enter sensor 3 FOV (2330), the external sink handover 1210 estimates when the vehicle crossed the registration point for sensor 1 and attaches this time tag along with the ID of sensor I to the OSMs 1-3 data flow **313*b***.

OSMs, produced by other tracking nodes, that have been determined or that can be associated with a roadway path that will take the vehicle or object within the FOV of sensor 1 are transferred on the data flow from that sensor's tracking node to tracking node 1. These data items enter the external data source handover 1220 of tracking node 1, which places these new objects into the database where they can later be involved in the tracking activity as they come within the sensor 1 FOV. The external source handover 1220 is also responsible for updating these objects with the latest link time information transferred from the link time estimation process 1230 so that the time of arrival within the sensor 1 FOV can be predicted.

The link time estimate is developed in the link time estimation process 1230. The link time estimate estimates how long an object takes to proceed from the FOV of one sensor to the FOV of another, for example where an object proceeds from the FOV of sensor 1 to the FOV of sensor 3. When that object is sent to tracking node 3 (330) through the OSMs 1-3 data flow **313*b*, the external source handover of tracking node 3 attaches the latest link time estimate to the object. As the link time estimate is improved, the external source handover of tracking node 3 uses it to update the vehicle's predicted time of arrival in the sensor 3 FOV. In this manner the database retrieval system can retrieve these objects at the time that the object would appear in the sensor 3 FOV for correlation with OSMs 3 from sensor 3**.

The link time estimation process 1230 generates handover retrieval gates transferred through the handover retrieval gate data flow 531 and receives handover gated objects through the handover gated objects data flow 513 to generate the link time estimate associated with that data. It also receives the signal states 271 which are useful if link time is being influenced through area control 270. The detailed functionality of the link time estimation process is described below.

Link Time Estimation 1230

Figure 13:
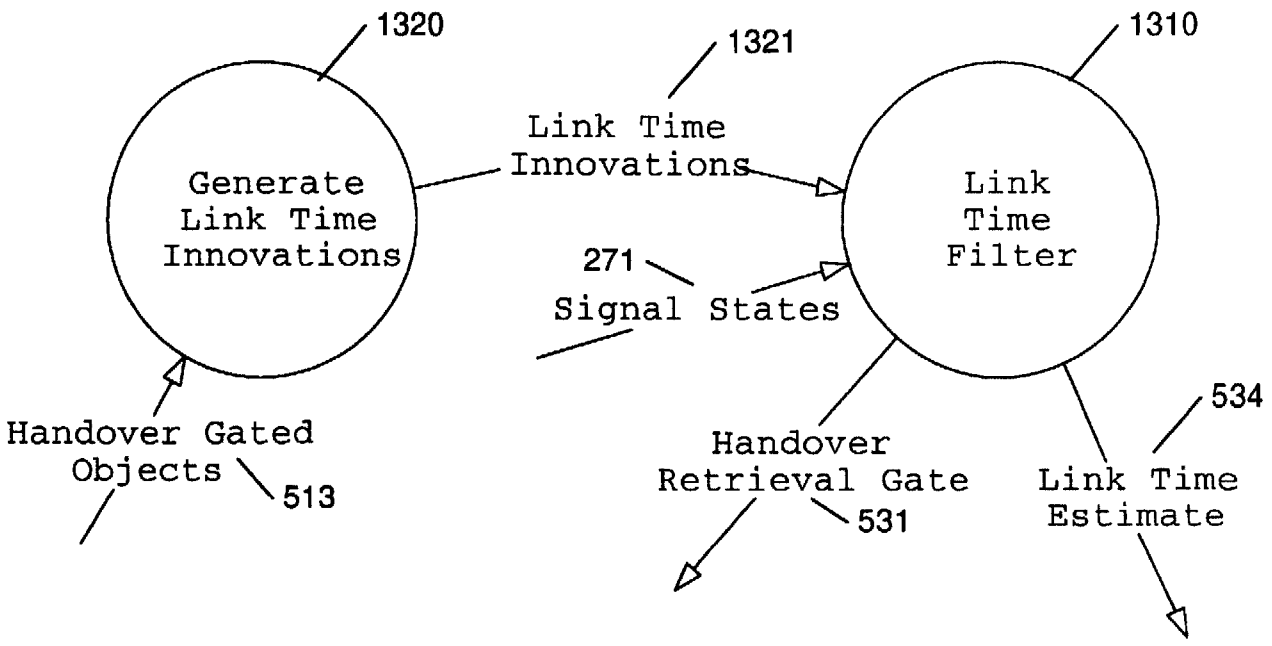
FIG. 13 is a data flow diagram of a link time estimation process of the external tracking node interface of FIG. 12.

Referring now to FIG. 13, there is shown a data flow diagram for link time estimation 1230. Link time estimation 1230 can be implemented in a similar manner as was used for the local tracking process shown in FIG. 8. This is because link time is a measure of the time elapsed in a vehicle's movement from one sensor's FOV to a second sensor's FOV, where as track time is a measure of the time elapsed in a vehicle's movement from one point to another in a single sensor's FOV. Link time estimation utilizes two functions. The first function, the link time filter 1310, performs the link time filtering based on link time innovations. The other process, generate link time innovations 1320, generates these link time innovations. The generate link time innovations process 1320 transfers the link time innovations to the link time filter 1310 through a link time innovations data flow 1321. Together, these two processes implement a Kalman-like predictor-corrector cycle.

Link Time Filter 1310

Figure 14:
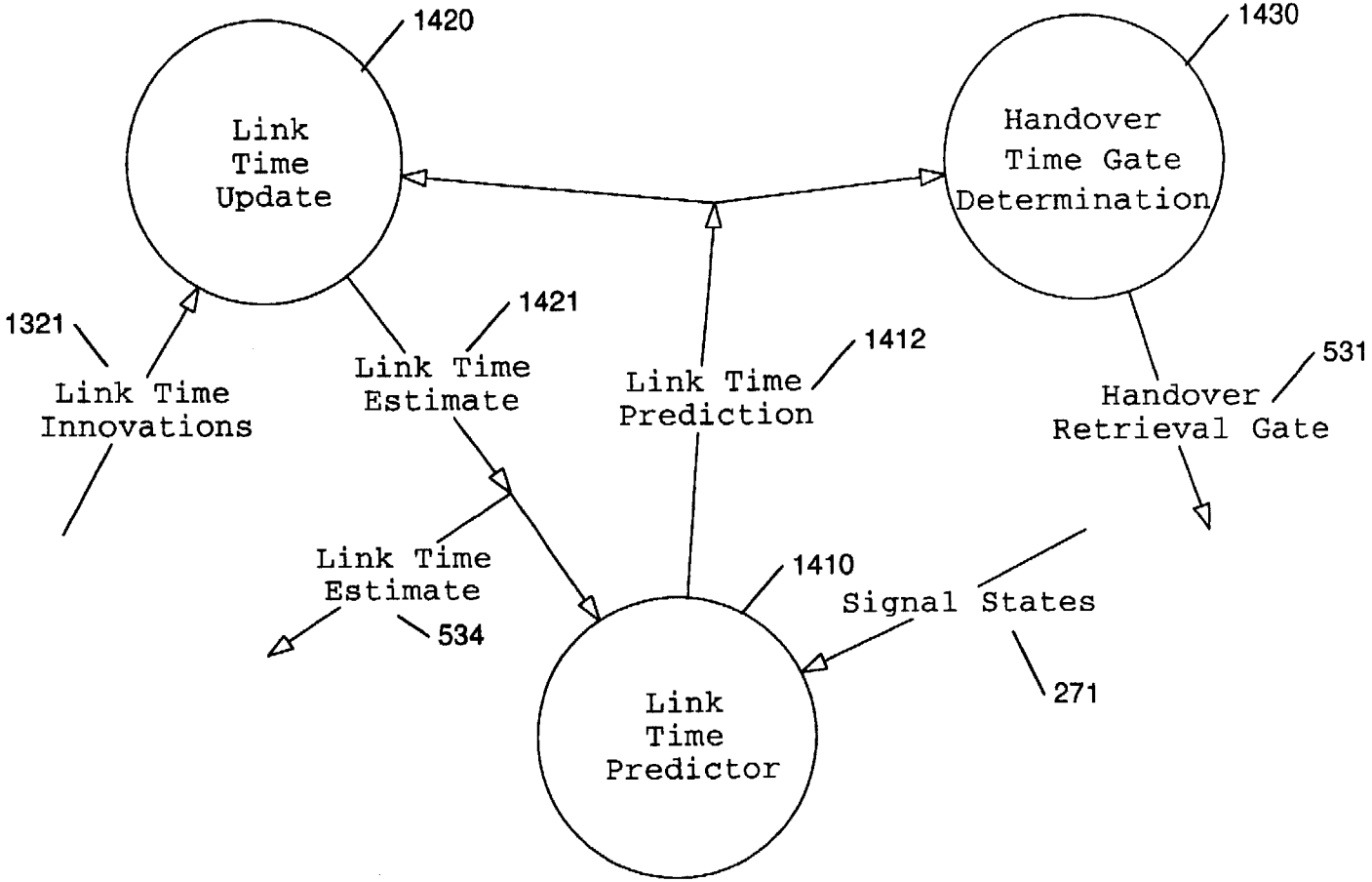
FIG. 14 is a data flow diagram of a link time filter process of the link time estimation process of FIG. 13.

Referring now to FIG. 14, there is shown a data flow diagram for the link time filter 1310. Comparing this diagram with the local track filter of FIG. 9 shows that the same basic steps of the local track filter 810 are also implemented in the link time filter 1310. Link time is predicted by a link time predictor 1410 based on past link time estimates utilizing a dynamic model, and the signal states transferred through the signal states data flow 271 where appropriate. Use of dynamic models is described in W. Leutzbach, *Introduction to the Theory of Traffic Flow;* 1988; Springer-Verlag; Berlin, Germany; Section 11.2.6.2.6 which is incorporated herein by reference. The predicted link time, including link time variances, is sent both to a link time update process 1420 and a handover time gate determination process 1430 through a link time prediction data flow 1412.

The handover time gate determination process 1430 utilizes the predicted link time and variances to develop a retrieval specification for retrieving handover data from the database. The retrieval gates are transferred by the handover retrieval gate data flow 531 to the database manager 510. A simple time gate based on the predicted link time plus or minus several standard deviations can be used for the handover time gate determination process 1430. Time gates are described in S. Blackman, *Multiple-Target tracking with Radar Applications;* 1984; Artech House; Norwood, Mass.; Chapter 4 which is incorporated herein by reference. Next, the database manager 510 transfers the handover gated objects to the generate link time innovations process 1320, as described above. Subsequently, the generate link time innovations process 1320 generates link time innovations and transfers them to the link time update process 1420 through the link time update process data flow 1321. The link time update process 1420 performs the link time update using a predictor-corrector strategy based on the predicted link time corrected by the measured innovations. Thus the link time filter is similar to the local track filter (FIG. 9) described earlier.

Generate Link Time Innovations 1320

Figure 15:
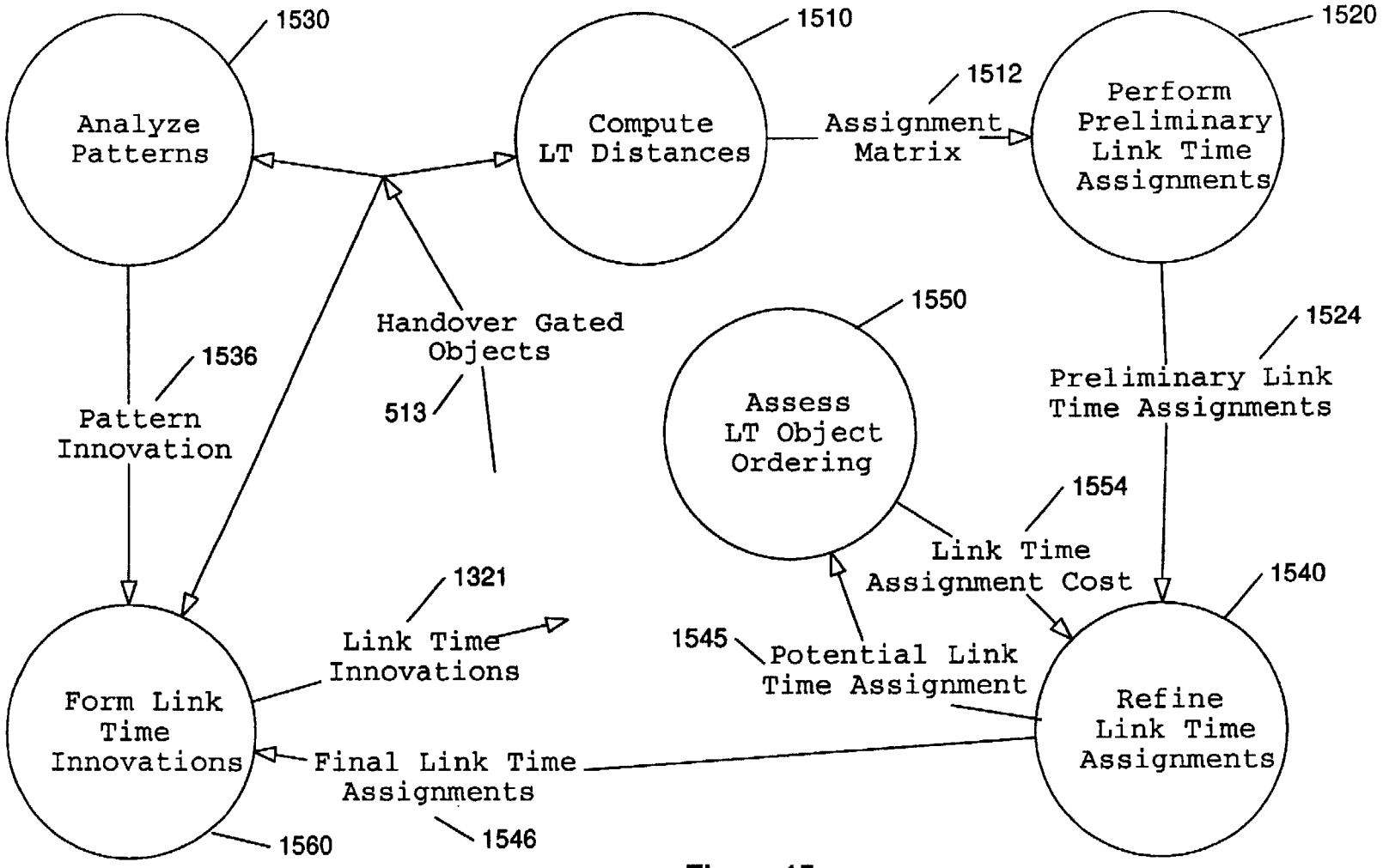
FIG. 15 is a data flow diagram of a generate link time innovations process of the link time estimation process of FIG. 13.

Referring now to FIG. 15, there is shown a data flow diagram of the generate link time innovations process 1320. This process 1320 produces the link time innovation needed for estimating the link time by the link time filter 1310 and shown in FIG. 14. The processing approach of the generate link time innovations process 1320 is similar to the generate track innovations process shown in FIG. 11 which is employed to generate the track innovations. A major difference is that pattern analysis is performed in generating the track innovations in the generate link time innovations process 1320.

As discussed above, the objects found in the database matching the handover retrieval gate specification generated by the link time filter 1310 and FIG. 14 arrive on the handover gated objects data flow 513. Objects in the handover gated objects data flow 513 originate from the tracking node on the other side of the link through which the vehicle is travelling and contain the time tag corresponding to when the object crossed the registration point for the sending sensor. Another set of objects retrieved correspond to objects within this sensor's FOV (i.e. sensor 1 FOV) that are currently under track in tracking node 1 (310). Link time information is developed by correlating these two information streams.

The generate link time innovations process 1320 includes: a compute link time distances process 1510; a perform preliminary link time assignments process 1520, an analyze patterns process 1530, a refine link time assignments process 1540, an assess link time object ordering process 1550, and a form link time innovations process 1560.

To estimate link time, first handover gated objects, (i.e. objects relating to the vehicle from the different sensors) are associated. This is performed based on a distance computation similar to the function performed by the generate assignment matrix process 1110 (FIG. 11). The handover gated objects are received by the compute link time distance process 1510 which outputs an assignment matrix for the objects through an assignment matrix data flow 1512. The compute link time distance process 1510 computes distance information to derive order information, and utilizes this order information as is done in the generate assignment matrix process 1110.

A preliminary assignment between these object sources is performed by a perform preliminary link time assignments process 1520 based on the assignment matrix. The same assignment approach as was used in the generate track innovations process 820 and FIG. 11 can be used by the perform preliminary link time assignments process 1520. Since the number of potential assignments is not large, an optimal assignment algorithm can be used without significant computational cost. Such algorithms are described in J. Munkres, Algorithms for the Assignment and Transportation Problems; SIAM J. Control; Volume 5, March, 1957, pp 32–38 which is incorporated herein by reference. As in the generate track innovations process 820, due to lane changing and other mechanisms which can affect the object order, the assignments must be refined to account for changes in the object's order. This functionality is accomplished in the refine link time assignments process 1540 in conjunction with the assess link time object ordering process 1550. This refinement can be accomplished through a multiple hypothesis tracking approach similar to that used in the generate track innovations process (FIG. 11). Hence, the assess link time object ordering process 1550 assesses whether or not the object ordering is correct as initially determined in the perform preliminary link time assignments process 1520 or if subsequently refined link time assignments (in the refine link time assignments process 1540) are a better representation of the flow. The refine link time assignments process 1540 receives the preliminary link time assignments data flow 1524 from the perform preliminary link time assignments process 1520 through a preliminary link time assignments data flow. Potential link time assignments are transferred by a potential link time assignment data flow 1545 to the assess link time object ordering process 1550, which passes its assessment of the potential assignment track to the refine link time assignments process 1540 through a link time assignment cost data flow 1554. The result is a final link time assignments data flow 1546 that is sent to the form link time innovations process 1560.

The final link time assignments data flow 1546 contains information at a vehicle by vehicle level. Other information for generating link time innovations is vehicle platoon or pattern innovations transferred through a pattern innovation data flow 1536. Vehicle platoon tracking is described in E. Pfannerstill, Automatic Monitoring of Traffic Conditions by Reidentification of Vehicles. In Proc. IEEE Conf. on Road Traffic Monitoring, Report 299, 1989, pp. 172–175 which is incorporated herein by reference. Platoons are identifiable clumps or groups of vehicles. Clumps of vehicles can be correlated from one sensor to another to generate link time innovations. The analyze patterns process 1530 performs the pattern or platoon analysis to produce an innovation based on platoon information. This is done by correlating clumps of objects located in sensor 1 FOV with clumps of objects coming from other sensors for which the link time is being estimated. The objects are received by the analyze patterns process 1530 through the handover gated objects data flow 513. The difference between when a clump of objects has been spotted in sensor 1 FOV and when it was predicted to occur from another sensor is the pattern innovation. A sliding window correlation approach can be utilized by the analyze patterns process 1530 to generate the pattern innovation. The analyze patterns process 1530 transfers the pattern innovations through a pattern innovation data flow 1536.

The form link time innovations process 1560 produces a link time innovation data flow 1321. The form link time innovations process 1560 produces this data flow by combining the information in the final link time assignments data flow 1546 and the pattern innovations in the pattern innovation data flow 1536 by first taking the link time assignments for the refine link time assignments process 1540, extracting the time tags for each object assigned from the handover gated objects data flow 513 and forming the innovation from the object time tags. The predicted link time estimate used to compute the innovations is included in the handover gated objects data flow 1540. This forms one set of innovations, those obtained by the object assignments. The pattern innovation from the analyze patterns process 1530 and the assignment and pattern innovation quality, computed in the form link time innovations process 1560, make up the link time innovations data flow 1321.

Overlapping Sensor FOV Tracking Node 420

Figure 16:
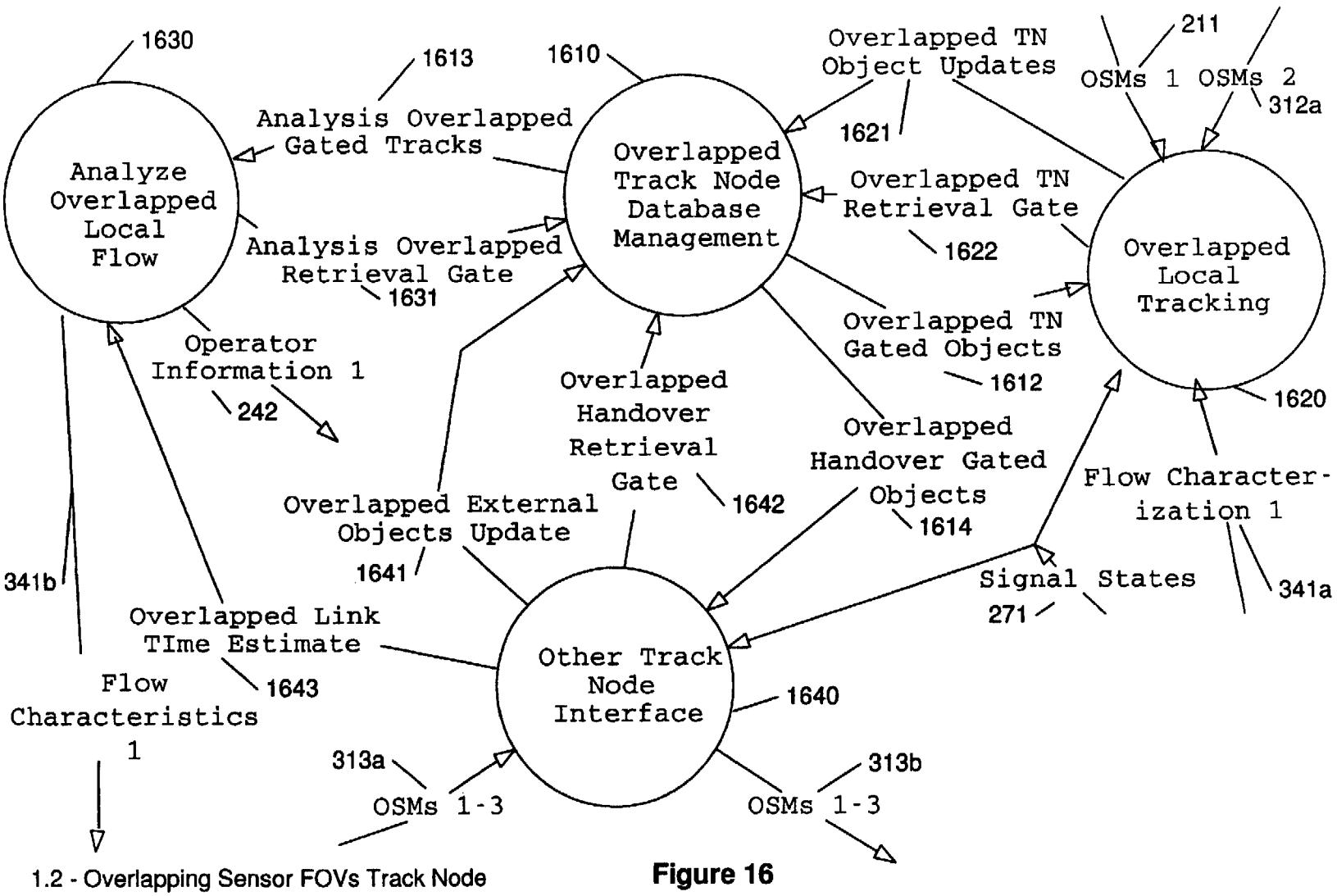
FIG. 16 is a data flow diagram of an overlapping sensor FOVs tracking node of the tracking node of FIG. 4.

Referring now to FIG. 16, there is shown a data flow diagram of the overlapping sensor FOVs tracking node 420. This process 420 addresses the case where two sensors have FOVs which are overlapping or are in close relationship to each other. An example of this is when several sensors are used to monitor a merge lane as in FIG. 23. Overlapped sensor FOVs are treated by the wide area surveillance system according to the present invention as a "group" in the sense that a single tracking function is used to process all OSMs from the overlapped sensors. This is accomplished by assigning one tracking node to the tracking activity and the other overlapped tracking nodes to relay points which send OSMs to the assigned tracking node. In FIG. 23, it is shown that sensor 1 and sensor 2 have overlapped FOVs. For the sake of an example, it will be assumed that tracking node 1 (310) has been assigned the tracking activity and tracking node 2 (320) relays OSMs from SSI 2 to tracking node 1 (310).

The processing approach for tracking node 1 (310) is similar to the case where the sensors have separated FOVs, with minor exceptions. Like with the separated sensor FOVs tracking node 410 (FIG. 4 and FIG. 5), there are four processes making up the overlapped sensor FOVs tracking node 420. These include a database function 1610 which is the heart of this tracking node, an overlapped local tracking process 1620, an interface to other nodes 1640, and an analysis of the local flow process 1630. Corresponding functions are found in the separated sensor FOVs tracking node 410. The functionality of the analyze overlapped local flow process 1630 is identical to the analyze local flow process 540 and the database manager 1610 is identical to the tracking node database manager 510 described with respect to FIG. 5.

Minor differences exist between the overlapped local tracking process 1620 and the local tracking process 520 (FIG. 5). Similarly, minor differences exist between the other tracking node interface 1640 and the external tracking node interface 530 (FIG. 5). The primary difference is that OSMs produced by SSI 2 are routed directly into the overlapped local tracking process 1620, along with the OSMs from the SSI 1. Tracking node 2 (320) is simply a routing mechanism for this example. OSMs 2 go into tracking node 2 (320) and are immediately routed on OSMs 1-2 (312) to tracking node 1 (310) which reassigns them (see FIG. 4) as OSMs 2 at the input to the overlapped local tracking process 1620. The functionality of the overlapped local tracking process 1620 is otherwise the same as that of the local tracking process 520, with the exception that there are two sources of OSMs instead of a single source.

The other process on this diagram, the other tracking node interface 1640, has the same functionality as the external tracking node interface 530, with the exception that the OSMs 1-2 (312) data flow has not been included since it is transferred into the overlapped local tracking process 1620.

Overlapped Local Tracking 1620

Figure 17:
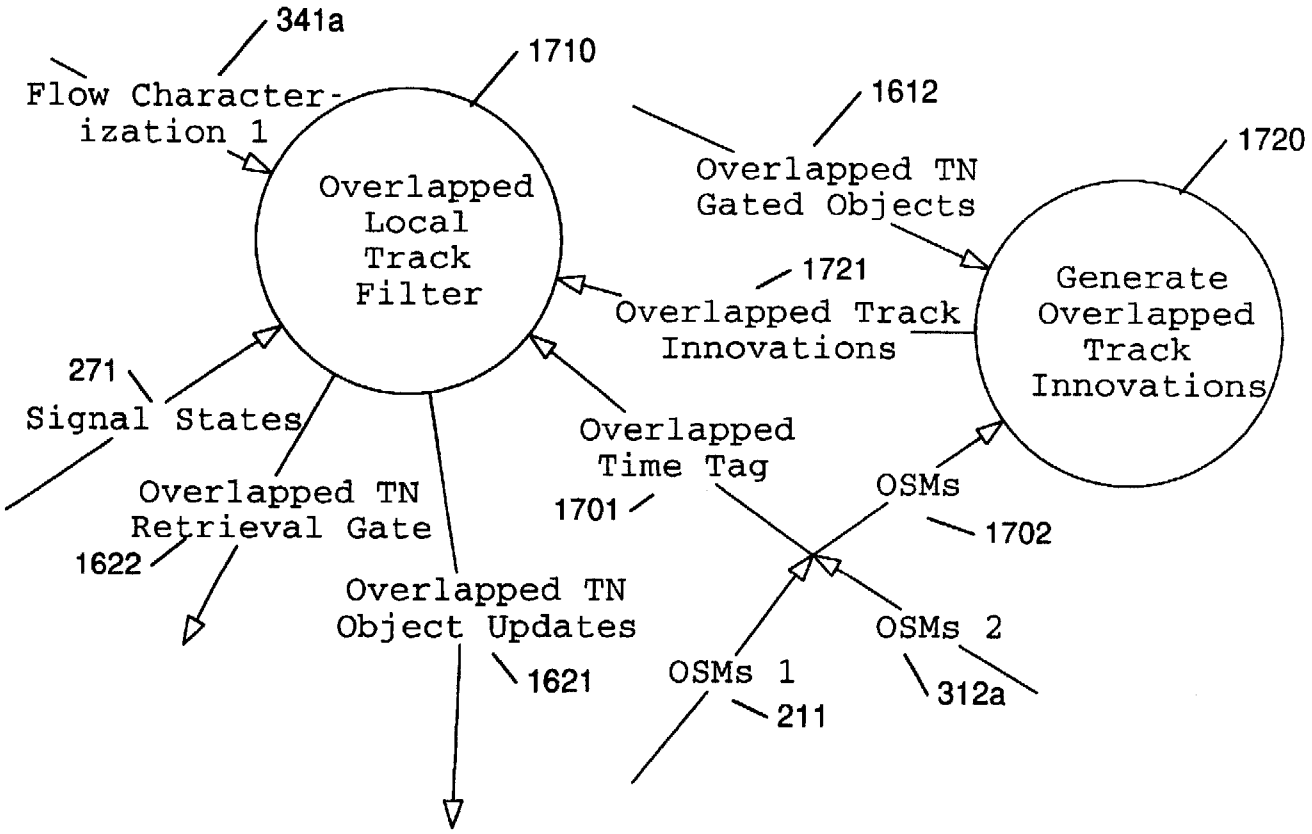
FIG. 17 is a data flow diagram of an overlapped local tracking process of the overlapping sensor FOVs tracking node of FIG. 16.

Referring now to FIG. 17, there is shown a data flow diagram of the overlapped local tracking process 1620. This process 1620 includes: an overlapped local tracking filter 1710, and a generate overlapped track innovations process 1720. The overlapped local track filter 1710 has exactly the same functionality and produces the same data as the local track filter 810 (FIG. 8). The generate overlapped track innovations process 1720 is also the same functionality as the generate track innovations process 820 (FIG. 8), except that the all of the overlapped OSMs from tracking node 2 are transferred into this process rather than just OSMs 1.

In an intersection, complex vehicle paths are likely. It would not be uncommon for a vehicle to have several possible future paths. If for example the vehicle was entering the intersection it could go straight, turn left, turn right, or make a U4urn. The overlapped local tracking process 1620 assigns a model to each of these alternatives (multiple models) and uses the multiple hypothesis filter tracking approach.

Other Tracking Node Interface 1640

Figure 18:
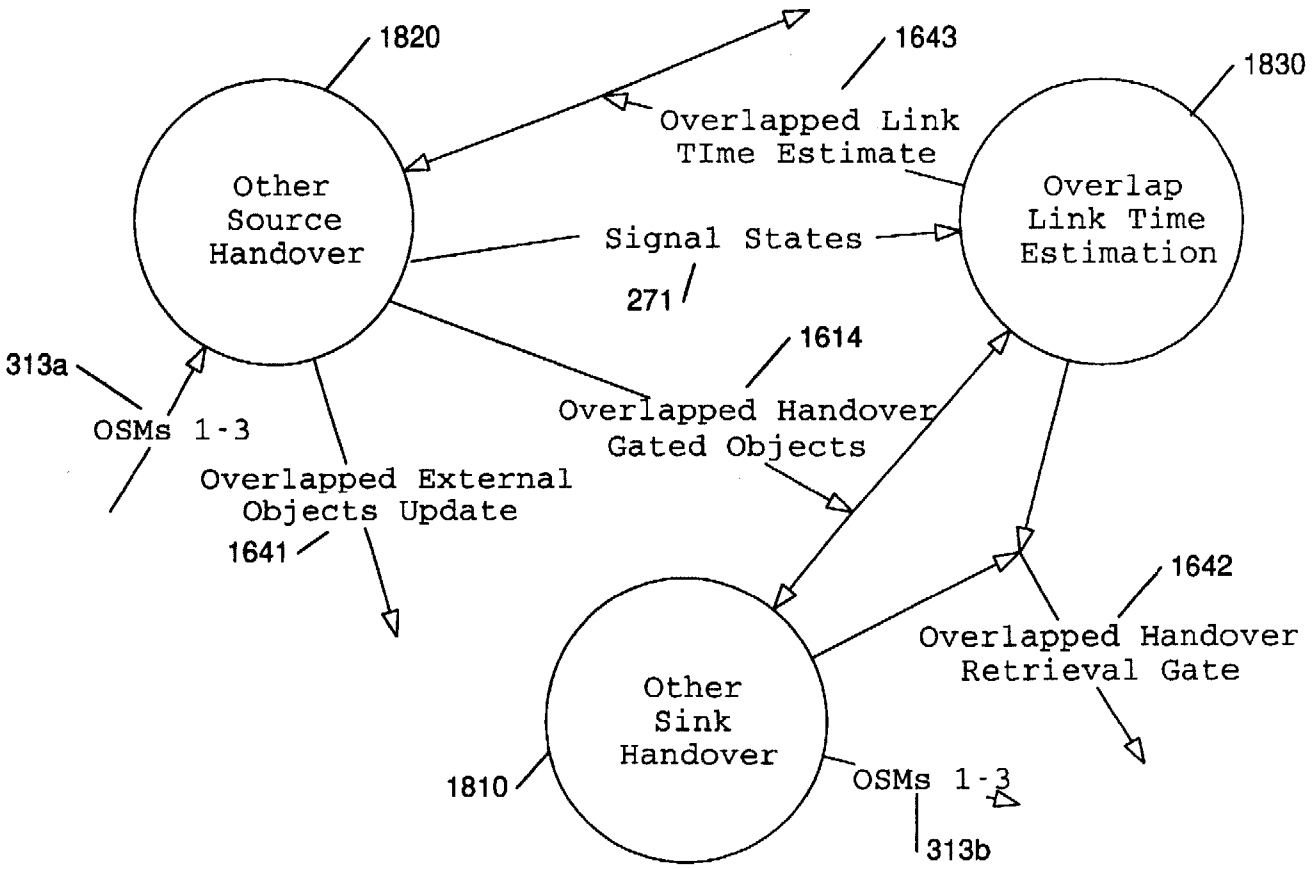
FIG. 18 is a data flow diagram of an other tracking node interface process of the overlapping sensor FOVs tracking node of FIG. 16.

Referring now to FIG. 18, there is shown a data flow diagram for the other tracking node interface 1640. This process includes: an other sink handover 1810, an other source handover 1820, and an overlap link time estimator 1830. The functionality for these three processes are almost identical to the functionality of the three processes in FIG. 12, with the following exceptions. The OSMs 1 from-2 data flow (312) is absent because the sensor 2 FOV overlaps sensor 1 FOV. Consequently, there is not a need for external sink and source handovers with tracking node 2. No other significant difference exists between the other source handover 1820 and the external source handover 1220 (FIG. 12).

Similarly, no significant differences, except for the absence of the OSMs 1-2 data flow (312) exist between the other sink handover 1810 and the external sink handover 1210 (FIG. 12). A very similar statement can be made about the overlapped link time estimator 1830. Functionally, no significant differences exist between the overlapped link time estimator 1830 and the link time estimator 1230 (FIG. 12). However, link time estimation between sensor 1 and sensor 2 is not computed since the FOVs of these two sensors overlap.

Analyze Wide Area Flow 340

Figure 19:
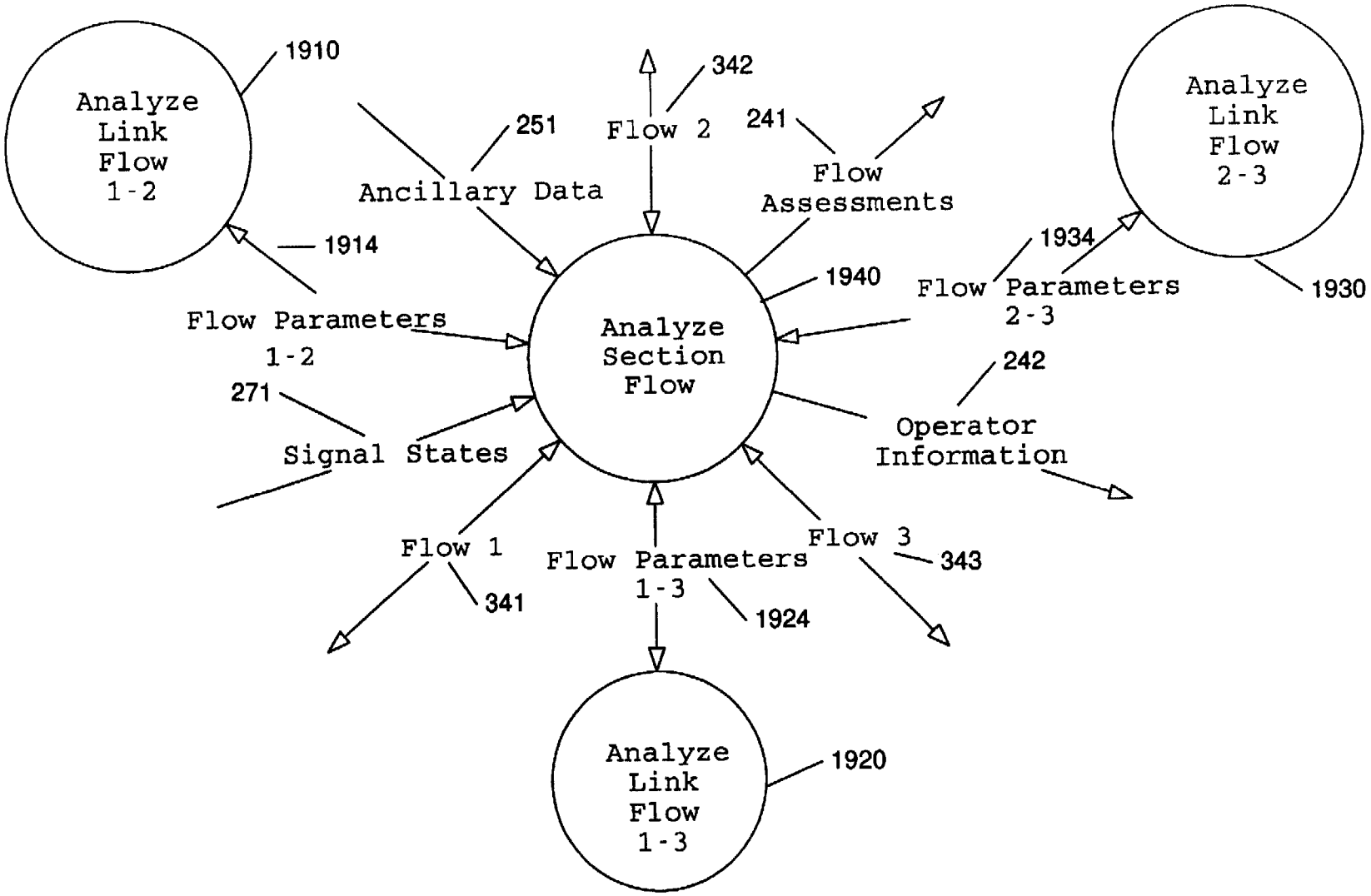
FIG. 19 is a data flow diagram of an analyze wide area flow process of the MATS of FIG. 3.

Referring now to FIG. 19, there is shown a data flow diagram of the analyze wide area flow process 340, which corresponds to the top MATS layer 140. A division is made between analysis of links that occurs between sensors, and analysis of sections of roadway including the links. For example, an analyze link flow 1-3 process 1910 provides flow analysis of the link between sensor 1 and sensor 3; similarly an analyze link flow 2-3 process 1930 provides the analysis of the link flow between sensor 2 and sensor 3. Thus, flow analysis of links is partitioned geographically which simplifies interfaces and reduces system integration problems. An analyze section flow process 1940 provides data interchange between the plural link flow analysis components 1910, 1920, 1930. For example, a flow parameters 1-2 data flow 1914 provides data to flow analysis of the link between sensor 1 and sensor 2.

At a higher level, the analyze section flow process 1940 provides network-wide analysis of the roadway's sections. Partitioning links from roadway sections is done since links could require a relatively simple flow model due to short distance between sensors, hence reducing complexity. On the other hand, numerous sensors might be used to monitor a large section of roadway, requiring a complex flow model.

Flow information from the tracking nodes flows 341, 342 and 343 enters the analyze wide area flow process as Flow 1, Flow 2 and Flow 3 corresponding to tracking node 1 (310), tracking node 2 (320), and tracking node 3 (330). Flow information developed by the tracking nodes is situation dependent but could include statistics such as the average velocity in each lane, the vehicle densities on each lane, the link time estimate on links leading to the tracking node, and the percentage of trucks in each lane. Flow 1 contains flow statistics developed locally within the sensor 1 FOV, etc.

The analyze link flow 1-3 process 1920 communicates at the network-wide level represented by the analyze section flow process 1940 through the flow parameters 1-3 data flow 1924. The flow parameters 1-3 data flow 1924 also carries any ancillary data 251 or Signal State 271 information needed to model and characterize the flow on a particular link. This information is developed in the analyze section flow process 1940. Similarly, flow data developed at the analyze link flow level is communicated as flow parameters back to the analyze section flow process 1940. This data is utilized in the section models of the analyze section flow process 1940 to develop both operator information and flow assessments for area signal control 270. Flow parameters from the analyze link flow processes 1910, 1920, 1930 to the analyze section flow process 1940 could include lane capacity estimates, traffic incidents detected, and percentage of vehicles leaving one sensor site and arriving at the other sensor site.

Analyze Link Flow 1-3 1920

Figure 20:
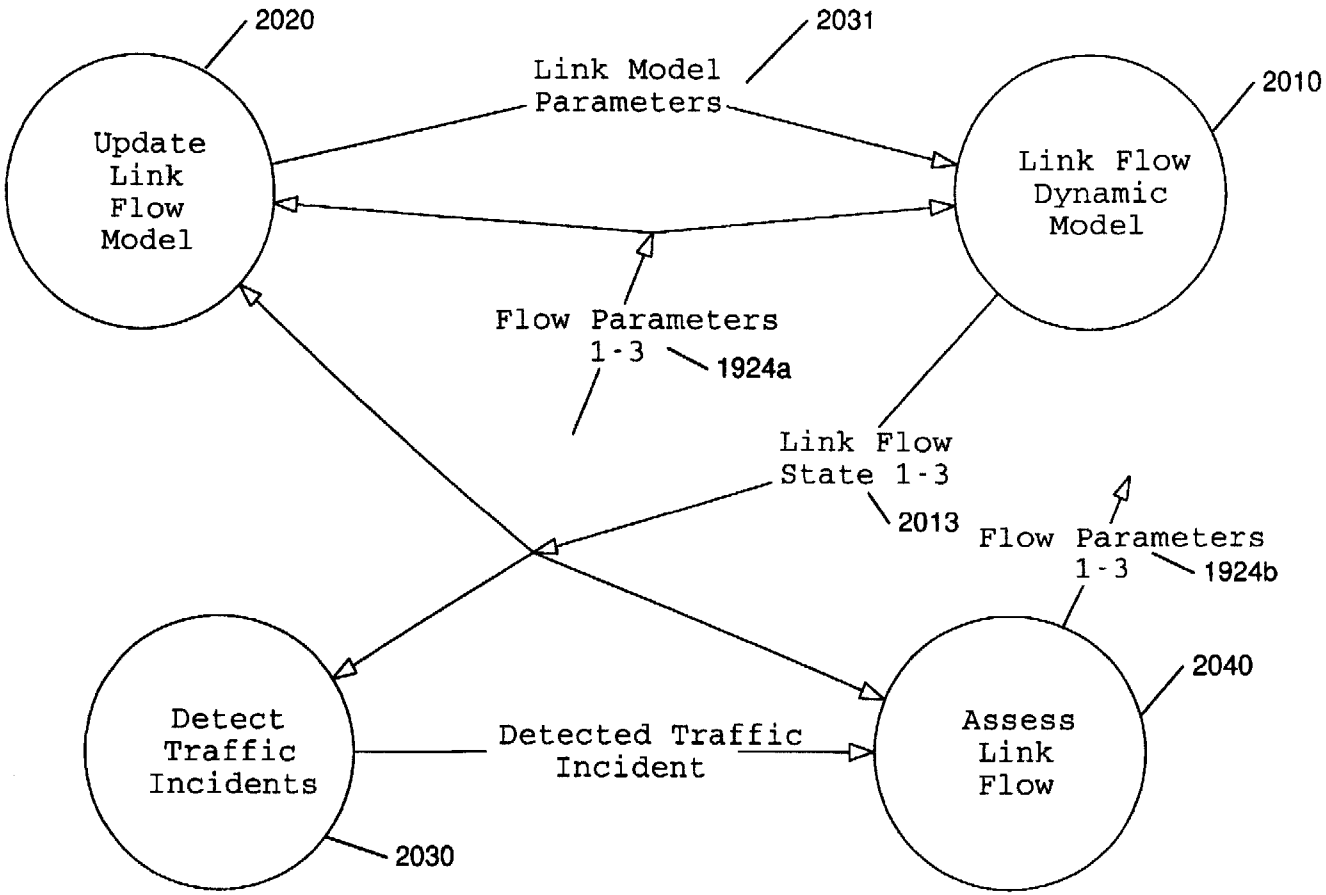
FIG. 20 is a data flow diagram of an analyze link flow process of the analyze wide area flow process of FIG. 19.

Referring now to FIG. 20, there is shown a data flow diagram of the analyze link flow 1-2 process 1910. Note that the analyze link flow 2-3 process 1930 and the analyze link flow 1-3 process 1910 have analogous functions to those included in the analyze link flow 1-2 process 1910, and therefore only the analyze link flow 1-2 process 1910 will be described.

The design of the analyze link flow 1-2 process 1910 is based on on-line dynamic modeling. A dynamic parametric model is formulated for the link flow, captured in a link flow dynamic model 2010, and the model's parameters are adjusted on-line until the model 2010 matches the data in the flow parameters 1-2 data flow 1914*a*. An update link flow model process 2020 updates the link flow model through on-line tuning or adjustment of the model's parameters so that the model is kept consistent with the measured data. Data developed in tracking node 1 (310) and tracking node 2 (320) are utilized to tune the model. The update link flow model process 2020 monitors in real time the state of the link flow model 2010 on a link flow state 1-2 data flow 2013 and tunes the link model parameters so that the flow characteristics embodied in the link flow state 1-2 data flow 2013 closely correspond to the local flow information extracted by tracking node 2 (320) and tracking node 3 (330).

A number of well-known methods and algorithms exist in the literature for model tuning. Several are described in P. Maybeck, *Stochastic models, estimation, and control;* 1979; Academic Press; New York, N.Y.; Chapters 9, 10, and 12 of Volume 2 which is incorporated herein by reference. A common method uses an extended Kalman filter. Model parameters in the link flow dynamic model 2010 are included in the state variables. An extended Kalman filter implemented in the update link flow model process 2020 is used to estimate link flow model parameters.

For this example, the link flow state provides a representation of the flow within the link between sensor 1 FOV and sensor 2 FOV. Consequently, a detect traffic incidents process 2030 may detect flow disruptions or traffic incidents upon the link. The signal processing literature contains many well known algorithms well suited to implement the function of the detect traffic incidents process 2030. The detected traffic incident information is transferred to an assess link flow process 2040 along with the link flow state 1-2 for assessment. This assessment takes place in the asses link flow process 2040 and produces the flow parameters 1-2 communicated through the flow parameters data flow 1914*b* to the section level in the traffic flow analysis.

Analyze Section Flow 1940

Figure 21:
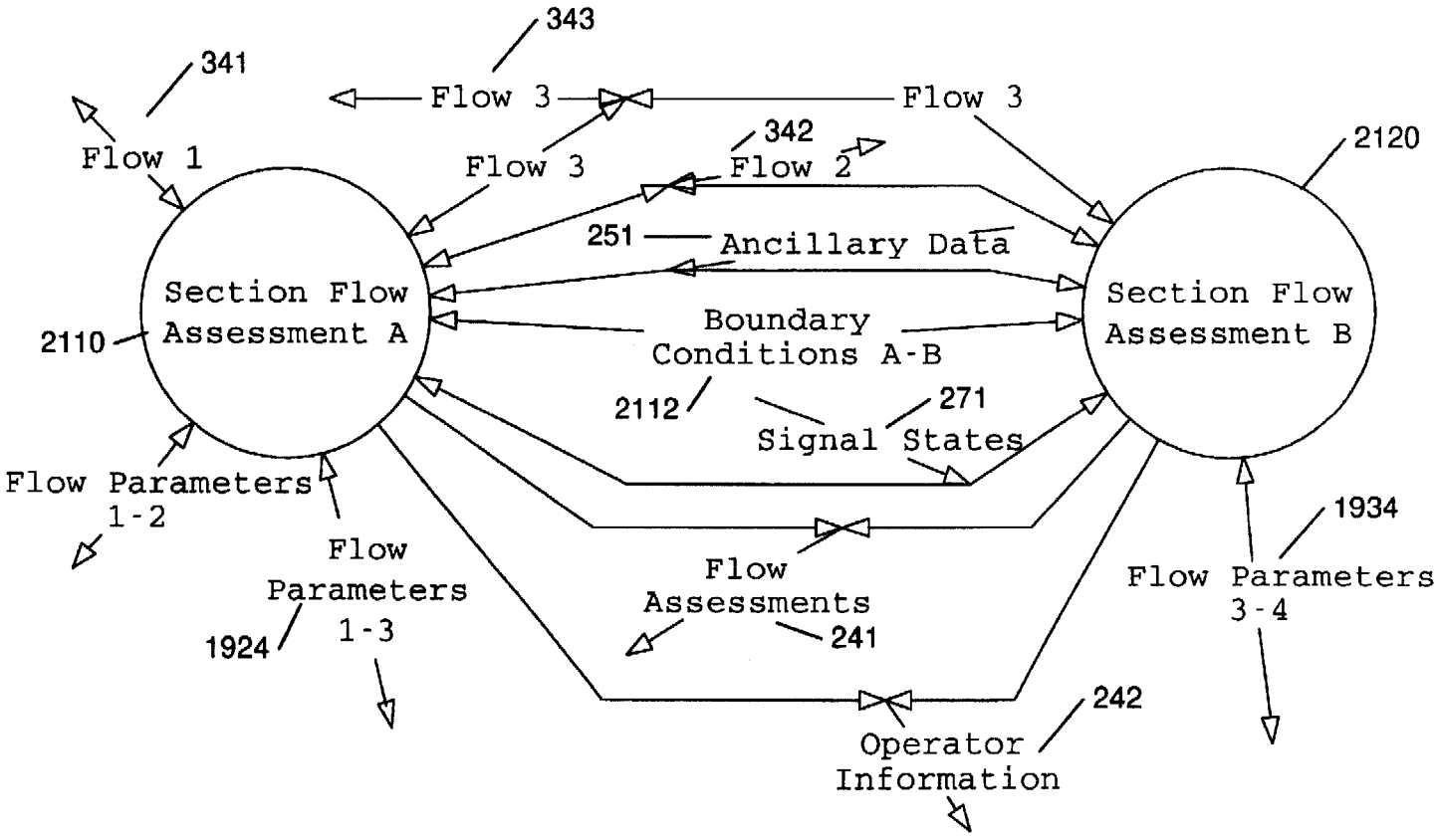
FIG. 21 is a data flow diagram of an analyze section flow process of the analyze wide area flow process of FIG. 19.

Referring now to FIG. 21, there is shown a data flow diagram of the analyze section flow process 1940. In particular, this figure shows that there is a function associated with each major section of the roadway. For example, consider a section of roadway containing sensor 1, sensor 2, and sensor 3, and consider this section to be separable from another section of roadway which folds back between sensor 3 and sensor 2. The important point here is that each major section of roadway will have a process associated with it in the analyze section flow process 1940. A section flow assessment A process 2110 corresponds to the first section and a section flow assessment B process 2120 corresponds to the other section in this example.

The section flow assessment A process 2110 for section A derives information from the link flow assessment between sensor 1 and sensor 2 on the flow parameters 1-2 data flow 1914 and from tracking node 1 (310), tracking node 2 (320), and tracking node 3 (330) on Flow 1 (341), Flow 2 (342), and Flow 3 (343) respectively. In summary, the section flow assessment A process 2110 interchanges data with the lower level functions. It operates on a macro level at the top MATS layer 140. Note also that the boundary conditions between section A and section B are interchanged on a boundary conditions A–B data flow 2112. This allows sections of roadways to be linked, allowing the system to be used on very large highways networks.

Section Flow Assessment A 2110

Figure 22:
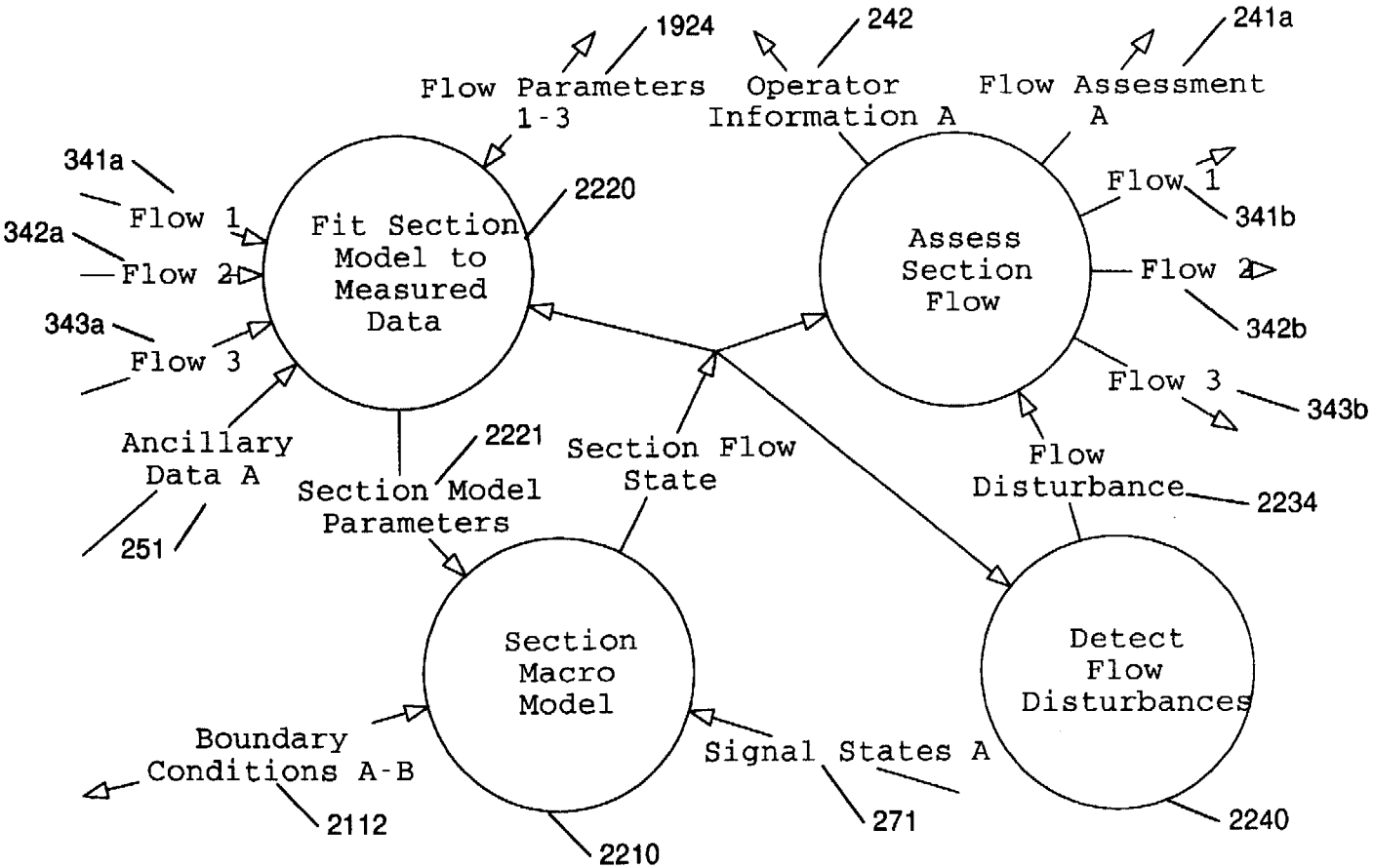
FIG. 22 is a data flow diagram of a section flow assessment process of the analyze section flow process of FIG. 21.

Referring now to FIG. 22, there is shown a data flow diagram of the section flow assessment A process 2110. All of the section flow assessment processes are identical. Therefore, only the section flow assessment A process 2110 is described. The section flow assessment A process includes: a fit section model to measured data process 2220, a section macro model process 2210, an assess section flow process 2230, and a detect flow disturbances process 2240.

The structure of the section flow assessment A process is very similar to the analyze link flow 1-2 process 1910 and FIG. 20. The primary difference between these two processes is the level of the flow model utilized. Link flow can typically use a simple model since the link between two closely spaced sensors is has a simpler flow model than the model needed to characteristics an entire section of roadway. The macro model for the section flow embedded in the section macro model process 2210 is often complex in order to handle the complexity of flow patterns along the entire section of roadway. A partial differential equation macro model is typical of flow models used in this process 2210.

Like the link flow dynamic model 2010, the section macro model 2210 is updated in real time through the fit section model to measured data process 2220. The fit section model to measured data process 2220 receives data transferred from the flow 1 data flow (341*a*), the flow 2 data flow (342*a*), the flow 3 data flow (343*a*), the ancillary data flow 251, and the flow parameters 1–3 data flow 1924. As with the update link flow model process 2020, the model parameters of the section flow assessment can be tuned by embedding them in the state variables and using an extended Kalman filter to tune the models parameters. These parameters are transferred through a section model parameters data flow 2221 to the section macro model process 2210. The section flow state is monitored for flow disturbances or incidents by the detect flow disturbances process 2240 which is similar to the detect traffic instances 2030. The parameterization and flags for flow disturbance are communicated to an assess section flow process 2230 on a flow disturbance data flow 2234. The assess section flow process 2230 performs the flow assessment function which extracts flow information required by the area signal control 270, the operator, and by the low layers of the processing structure. The assess section flow process 2230 generates data transferred to other process as described above through the operator information data flow 242 to the operator interface 260, the flow assessment data flow 241 a to the area signal control 270, the flow 1 data flow 341*b* to tracking node 1, the flow 2 data flow 342*b* to tracking node 2, and the flow 3 data flow 343*b* to tracking node 3.

Additional Description of Micromodels

As described above, in accordance with the present invention, the local tracker 520 (FIG. 5) and 1620 (FIG. 16) is constructed using a predictor/corrector algorithm, such as a Kalman filter. In this system, a plurality of sensors is used for periodic vehicle detection. The sensors are coupled to processors which periodically extract vehicle detection information. This vehicle detection information is then provided to another processor which tracks the detected vehicles.

To track the detected vehicles with a Kalman filter, a computer is used to predict the vehicle's location at about the time the next sensor measurement is made. The error between each vehicles' predicted location and the measured location is used to correct the prediction.

It has been found that a tracking system's performance will improve if the quality predictions of vehicle locations are improved. A good quality prediction method also tends to lower the cost of the tracking system since a sensor's output can be processed at a lower rate. As mentioned, the GM micromodel provides a good prediction for freeways in free flow or congested flow conditions. A better vehicle location predictor micromodel is provided in accordance with another aspect of the invention, described below, which is particularly suited for tracking vehicles in complex environments such as interchanges and intersections.

Figure 36:
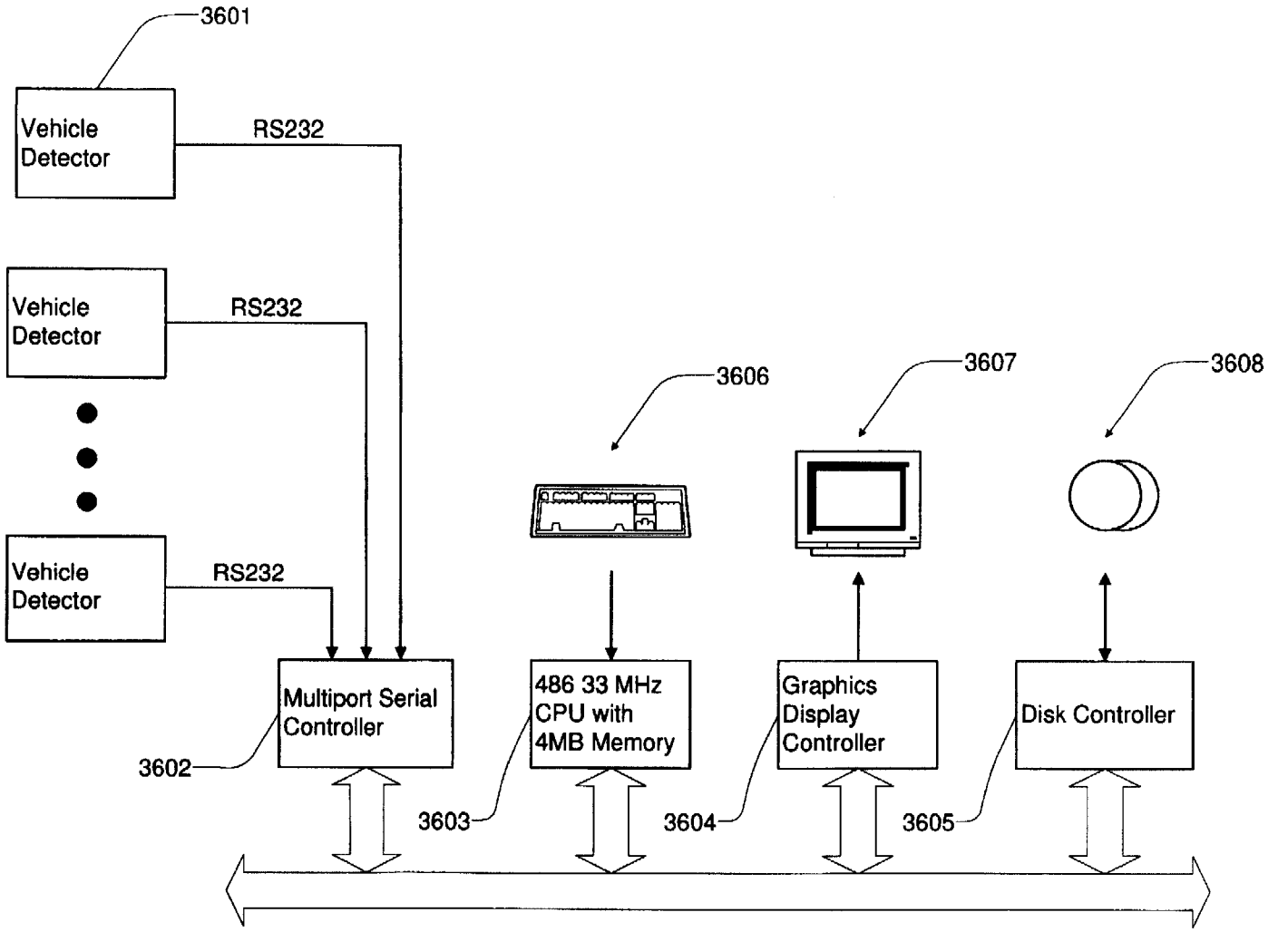
FIG. 36 is a diagram of a computer system embodying the invention.

The tracking systems of the invention may be embodied with off-the-shelf computer hardware which is coupled and programmed as described below. FIG. 36 shows one configuration suitable for implementing the local tracker in accordance with this aspect of the invention. A PC having an Intel i486 microprocessor running at 33 MHz with 4 megabytes of main memory 3603 preferably has a software embodiment of the micromodel of the invention running thereon. Computer peripherals include a graphic display controller 3604 coupled to a display 3607, a disk controller 3605 coupled to a disk drive 3608, and a keyboard 3606. The display 3607 is especially useful for display graphical representations of vehicular flow, as described below.

Vehicle detections are made by vehicle detectors 3601. If the vehicle detectors comprise smart sensor interfaces, then a relatively low bandwidth is needed to transmit objects and fingerprints to the computer 3603. In such case, the vehicle detectors 3601 are preferably interfaced to the computer 3603 through serial ports 3602. Preferably, as described above, detection takes place periodically and cyclically.

Figure 24:
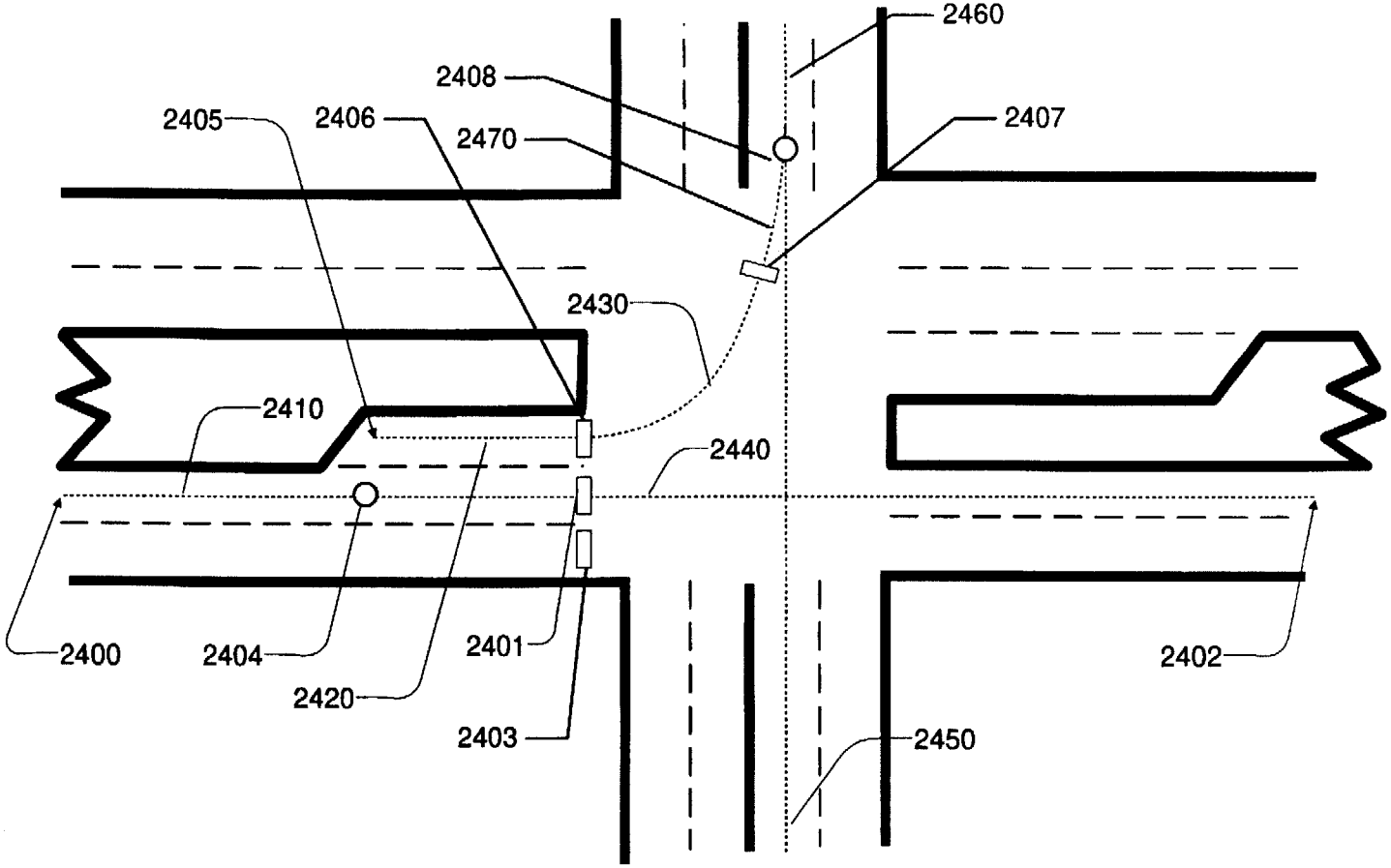
FIG. 24 is a diagram of an intersection with some segments and points identified.

In accordance with this aspect of the invention, a roadway, such as that shown in FIG. 24, is described in terms of segments and points. A segment is a defined section of roadway on which vehicles have dynamically consistent behavior. A point is a position on a segment which governs vehicle behavior in moving from one segment to another. By defining the segments and points in the manner described below, the micromodel, taking into account specified segments and points, can be used for reduction of a vehicle's kinematics.

Referring now to FIG. 24, some of these segment and point types may be better understood. The intersection shown in FIG. 24 is primarily defined by a number of lane segments 2410, 2420, 2430, 2440, 2450, 2460, 2470. A lane segment is a type of segment which has a starting point and an endpoint. A number of specialty segments 2401, 2403, 2406, 2407 are used to represent specific behavior associated with a roadway event. These include signaled stop bars 2401, 2406, a signaled stop and go 2403 and a transition segment 2407. Lane segments have a non-zero length. Specialty segments, such as the signaled stop bar and the signaled stop and go have zero length. Transition segments may also have zero length. Zero length segments correspond to geographic locations on the roadway.

For reference, a number of locations 2400, 2402, 2405 are also identified. Location 2400 and location 2401 are the start and end for lane segment 2410. Another lane segment 2440 extends from location 2401 to location 2402. Lane segments can be spliced together to generate a lane of arbitrary length. Vehicles on a lane segment preferably travel in a direction from the starting location to the end location. Vehicle dynamics are preferably invariant on a lane segment. Therefore, by using multiple lane segments for a lane, the traffic engineer can tune theoretical vehicle kinematics to roadway conditions.

An example of such tuning would be the use of three or four lane segments to describe a curved section of roadway. One lane segment would precede the curve (e.g., lane segment 2420), one lane segment would cover the curve (e.g., lane segment 2430), and the final lane segment would follow the curve (e.g., lane segment 2470). After the final curve segment 2470, the curve joins the through lane segment 2460. The parameters of the lane segments covering the curve are preferably picked to reflect vehicle slowing associated with the curve. Note, in this manner, lane segments enable the traffic engineer to easily describe geometric affects on traffic flow. The parameters preferably associated with a lane segment are listed in Table 1 along with the parameters for the other segments and points.

A transition segment is normally located at the junction of two lane segments and carries the same parameters as the lane segment that preceded it. Thus, transition segment 2407 is located at the junction of lane segments 2430 and 2470 and carries most of the same parameters as lane segment 2430. A transition segment is used to eliminate or hold off the influence of the approaching lane segment.

Inclusion of transition segments can be useful for curved lane segments such as lane segment 2430. It has been found that most drivers will slow down upon entering a curve, but maintain a fairly constant velocity through the curve. Upon exiting the curve and entering a straightaway, the driver will feel more secure and begin to accelerate to a higher speed. For example, when a vehicle leaves lane segment 2430 and enters lane segment 2470, it typically accelerates. Without a transition segment, as the vehicle traverses the curve 2430 and approaches the straightaway lane segments 2460, 2470 the micromodel will predict that the vehicle will begin to accelerate while still in the curve 2430. Transition segment 2407 serves to hold the vehicle's velocity constant along lane segment 2430, preventing the behavior of the straightaway lane segments 2460, 2470 from interfering with the correct prediction of constant velocity along curved lane segment 2430.

Signaled stop bar segments, such as segments 2401, 2406, have zero length and are used to represent the effect of a signal on a vehicle's kinematics. Signaled stop bar 2401 is used to halt traffic on lane segment 2410 if the corresponding signal phase indicates a stop condition. This is accomplished by setting the velocity associated with signaled stop bar 2401 to zero if the signal's phase indicates a stopping condition. If the corresponding signal phase indicates a proceed condition, then signaled stop bar 2401 adopts the parameters of lane segment 2440, so that the signaled stop bar 2401 effectively disappears. If a vehicle has stopped at signaled stop bar 2401 and the corresponding signal's phase changes to proceed, then the stopped vehicle will accelerate to the velocity set for lane segment 2440.

A signaled stop and go segment has zero length and is used to represent the effect of a signal on a vehicle's kinematics when a free right turn rule is applicable. It is the same as a signaled stop bar except that a vehicle on a trajectory leading to a right turn can proceed to its next lane segment after coming to a zero velocity condition near this segment. A signaled stop and go segment is shown in FIG. 24 as 2403. A signaled stop and go would normally be used, for example, where right-turn-on-red applies.

In addition to segments, the roadway is described by points. FIG. 24 includes two points, a split point 2404 and a merge point 2408. Points govern vehicle interlane behavior.

Split points, such as split point 2404, are points at which traffic flow can split into two streams. Split point 2404 shows the point where some vehicles will proceed from lane segment 2410 through signaled stop bar 2401 and some will split off onto lane segment 2420 to make a left turn though signaled stop bar 2406. A split point is associated with a particular lane segment and is parameterized by the probability that a vehicle will split from the through flow. Hence, for example, there may be a 75% probability associated with the split point that a vehicle at split point 2404 will continue straight, and a 25% probability that the vehicle will enter the left turn lane segment 2420. A vehicle that splits from the through lane segment (such as lane segment 2410) maintains its same velocity but is transferred to the new lane segment (such as lane segment 2420) specified by the split point. Once on the new lane segment the vehicle's kinematics are controlled by the new lane segment. A split point can be located anywhere within a lane segment.

Merge points are the inverse of split points and indicate where a first flow of traffic meets and merges with a second, through flow. For example, vehicles on lane segment 2470 (starting at location 2407 and ending at location 2408) are transferred to the through lane segment 2460 once they cross merge point 2408. A merge point is associated with a particular lane segment and a location on a lane segment which receives the merged traffic. When a vehicle is transferred to through lane segment 2460 the vehicle starts with the velocity that it had on lane segment 2470, but the vehicle's dynamics and subsequent velocity become governed by through lane segment 2460. Merge point 2408 governs when through lane segment 2460 begin to influence a vehicle on lane segment 2470.

Figure 25:
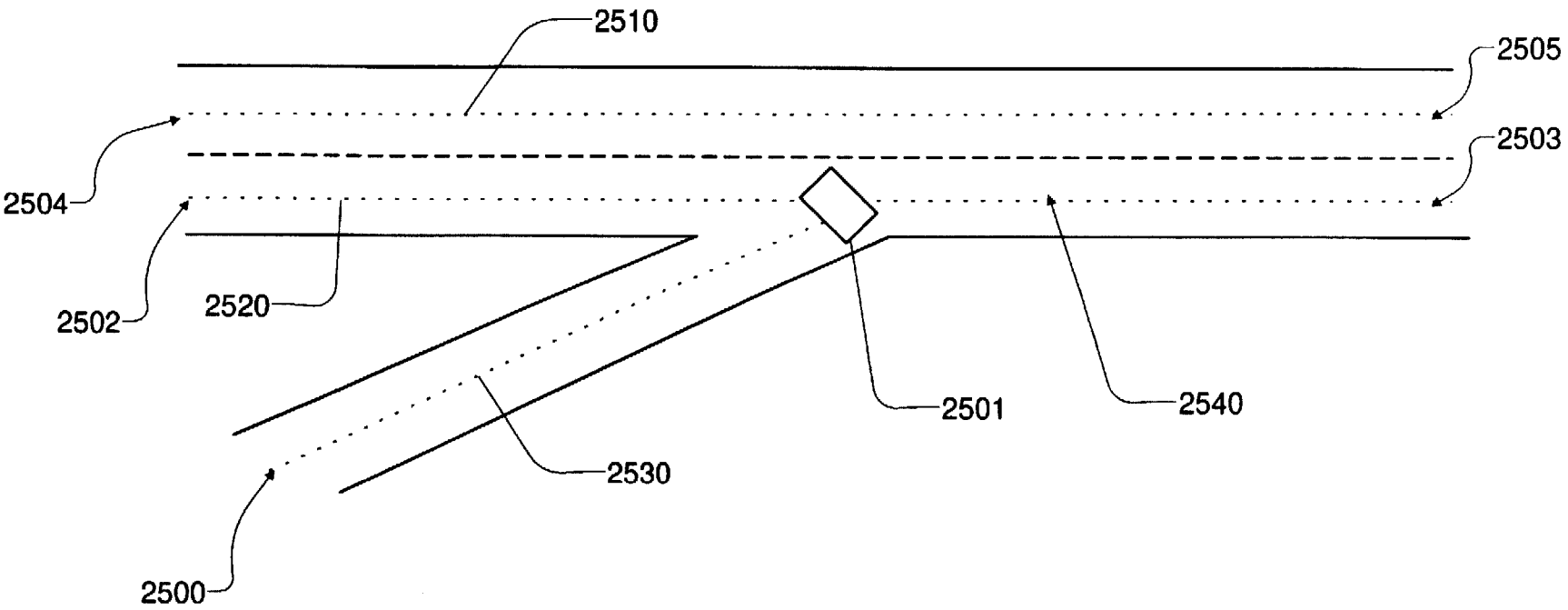
FIG. 25 is a diagram showing a freeway on ramp.

Referring now to FIG. 25, there is described an additional segment type, a yield segment 2501. The roadway of FIG. 25 represents a typical freeway on ramp. The roadway includes lane segments 2510 (defined by locations 2504 and 2505), 2520 (defined by locations 2502 and 2501), 2530 (defined by locations 2500 and 2501) and 2540 (defined by locations 2501 and 2503). Yield segments are similar to merge points but are used to indicate the possibility of simultaneous traffic on both lane segments. When this occurs a merging rule is employed in the yield segment to resolve conflicts. Yield segment 2501 is used to influence vehicles on lane segment 2530 which will merge into traffic from lane segment 2520 into lane segment 2540, based upon the existence of vehicles in the through lane 2520. A yield segment can be viewed as a merge point with a merging rule. The yield segment has zero length and carries a velocity defined by the merge rule.

Figure 38:
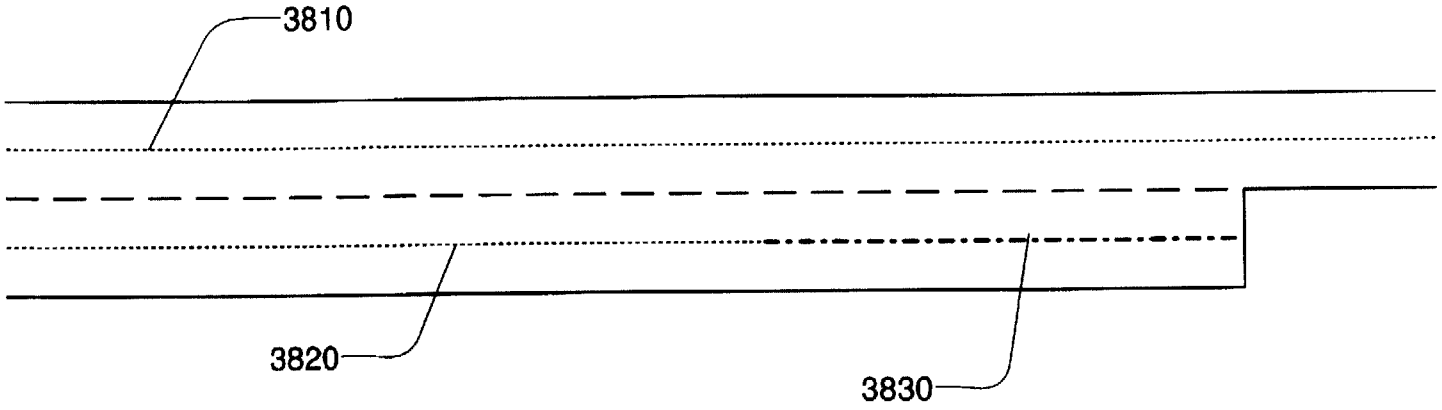
FIG. 38 is a diagram showing a section of freeway with one lane coming to an end.

Referring now to FIG. 38, there is shown a roadway where one of two lanes ends. The roadway includes lane segments 3810 and 3820 and merge segment 3830. Merge segments govern behavior on a first lane but impact one or more other lanes because vehicles on the merge lane are inserted into the other lane(s). Merge segment 3830 is used to model merging behavior of vehicles along this stretch of roadway. In Table 1, a parameter associated with a merge segment is the lane segment to which vehicles will merge. In the example of FIG. 38, vehicles on lane segment 3820 will merge in merge segment 3830 into through lane segment 3810.

One other type of segment is a stop and go segment, which is not shown in the drawings. The dynamics associated with the stop and go segment are the same as the signaled stop and go, except that the signal phase is permanently set to the stop condition. Such a segment would be located at intersections having stop signs or a flashing red signal.

Nearly any roadway may be described in terms of the segment and point types described above. In addition to the locations of the segments and points, there are parameters associated with each segment and point. Table 1 lists segment types and point types along with the parameters preferably associated with them. These parameters govern a vehicle's typical movement as it transitions down the lane segments.

In H. Goldstein, *Classical Mechanics*, Addison-Wesley, Reading, Mass. (1950) (incorporated herein by reference), it is shown how to model a particle's kinematics by specifying its acceleration. A similar method is used in accordance with the invention to describe the kinematics of vehicles in complex roadways. In the following discussion an expression is given for a vehicle's acceleration in terms of the parameters of Table 1 and the location and velocity of other vehicles within an interchange.

To facilitate the discussion, the concept of a gap is defined. The car gap between vehicles ($gap_c$) is given as the distance between the front of a vehicle and the rear of the vehicle preceding (leading) it. Note, the GM car following micromodel uses headway instead of gap. The micromodel of the invention uses gap because it is believed to produce a higher quality representation. This micromodel also uses lane gap ($gap_l$) which is defined as the distance between a vehicle and the next segment. The car gap is used in modeling the influence of other vehicles on a given vehicle's kinematics. The lane gap is used in modeling the influence of the roadway geometric events on a given vehicle's kinematics.

If a first vehicle is a long distance from a second, preceding vehicle, then the car gap is very large and the first vehicle's kinematics are not significantly influenced by the second vehicle. Also, if the first vehicle is a long distance from a roadway geometric event such as a stop sign (yielding a large lane gap) then the vehicle kinematics are not significantly influenced by the roadway geometric event. "Lane Influence Point" is defined for this micromodel as that lane gap where the influence of a roadway geometric event starts to have a significant influence on the vehicles kinematics. "Headway Influence Point" is defined similarly for the car gap.

Figure 26:
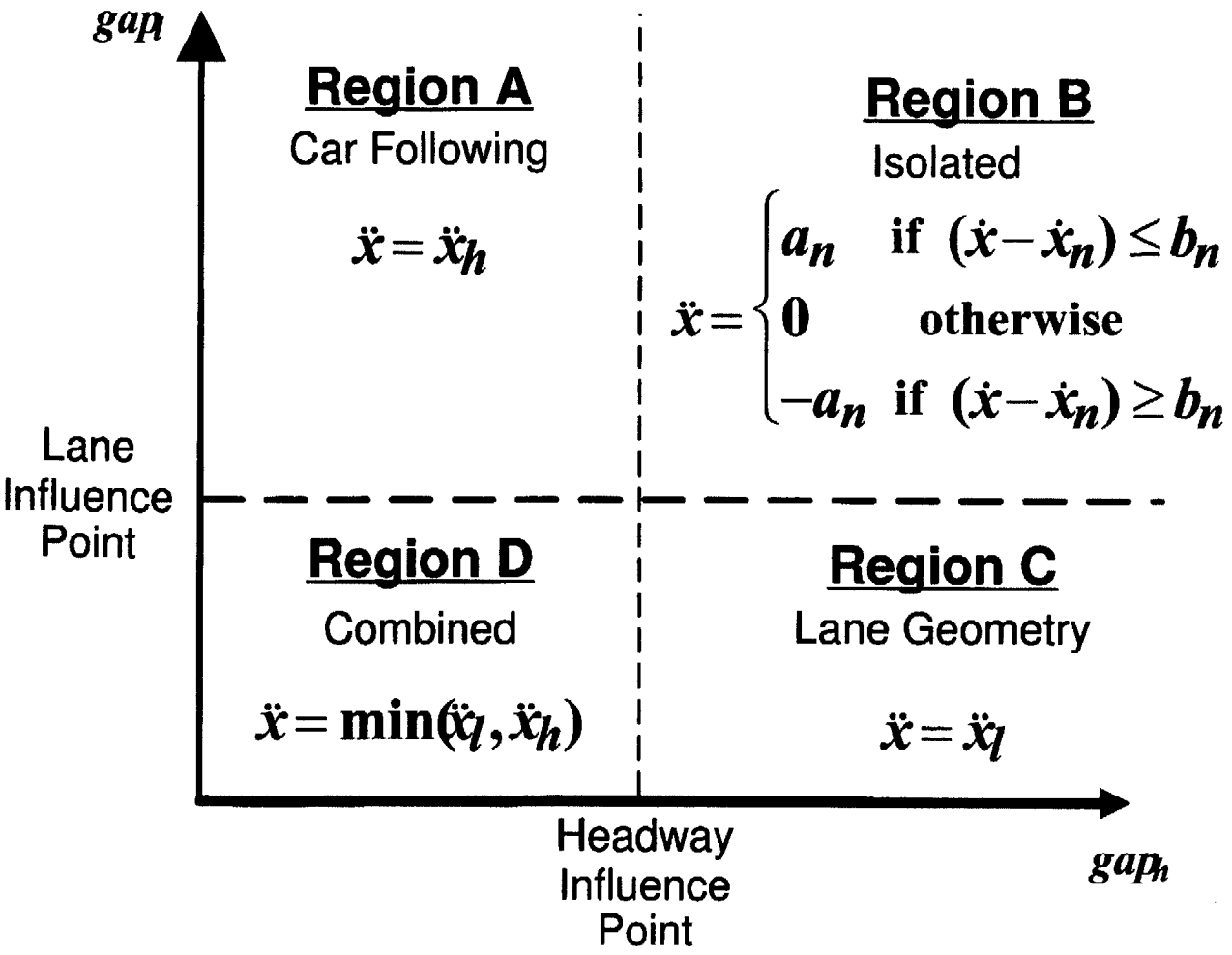
FIG. 26 is a graph showing the influence of inter-vehicle headway and lanes on a vehicle's acceleration.

Relating the car gap and the lane gap with the Lane Influence Point and the Headway Influence Point forms four regions as shown in FIG. 26. These are labeled as Region A, Region B, Region C, and Region D. An expression for a vehicle's acceleration is provided for each of these regions.

Figure 37:
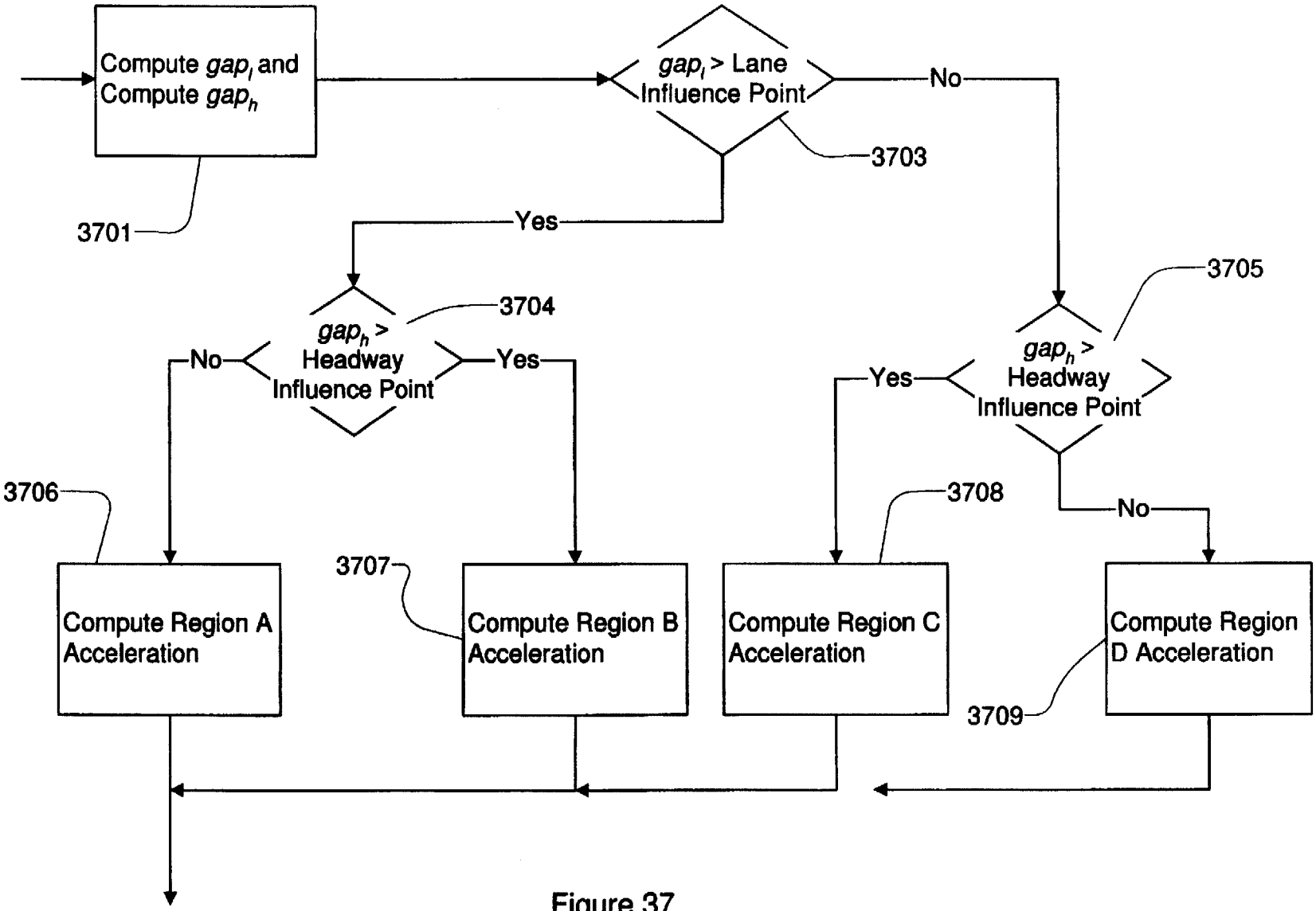
FIG. 37 is a flow chart for computation of a vehicle's acceleration in accordance with the invention.

FIG. 37 shows the processing flow implementing vehicle acceleration based on car and lane gap. First, the lane gap and the car gap are computed (step 3701). Next, the lane gap and car gap are compared to the Lane Influence Point and the Headway Influence Point, respectively (steps 3703, 3704 and 3705).

If the lane gap is larger than the Lane Influence Point and the car gap is not larger than the Headway Influence Point, then the vehicle is considered to be in the known car following mode—Region A (step 3706). Region A, called the car following region, has large lane gap and short car gap, and, hence, the car gap controls the vehicle kinematics. Lane segment 3810 (FIG. 38) is an example of a lane segment wherein lane gap will be large, since there are no geometric events which influence the traffic on the lane segment 3810. The GM car following micromodel does a good job of representing vehicle kinematics in this region, and it is used as a basis for the acceleration expression. In this region, the vehicle acceleration is given by $$\ddot{x}(t)=\ddot{x}_h(t)=\alpha\frac{[\dot{x}_{Ld}(t-r_t)-\dot{x}(t-r_t)]}{gap_h(t-r_t)}$$

where $x(t)$=vehicle's position at time t, $\ddot{x}_h(f)$=car gap acceleration term, $gap_h(t)$=car gap, $r_t$=driver reaction time, and $x_{Ld}$=position of leading vehicle.

If the lane gap is larger than the Lane Influence Point and the car gap is larger than the Headway Influence Point, then the vehicle is considered to be isolated—Region B (step 3707). Region B, called the isolated region, has large lane gap and large car gap, hence, neither the car gap nor the lane gap controls vehicle kinematics. Such a situation might arise where a vehicle is on lane segment 3810 and there is no preceding vehicle. In this region the vehicle acceleration is given by $$\ddot{x}(t)=\begin{cases} a_n & \text{if } (\dot{x}(t)-\dot{x}_n)\leq b_n \\ 0 & \text{otherwise} \\ -a_n & \text{if } (\dot{x}(t)-\dot{x}_n)\geq b_n \end{cases}$$

where $\dot{x}_n$=nominal velocity associated with this lane segment, $a_n$=lane segment acceleration, and $b_n$=limit on variation of lane velocity.

According to this formula, if the vehicle is going slower than traffic usually travels in the lane segment, then the vehicle is predicted to accelerate at a rate $a_n$. If the vehicle is going faster than traffic usually travels in the lane segment, then the vehicle is predicted to slow at a rate $-a_n$. The threshold for deciding if the vehicle will speed up or slow down is $b_n$, the limit on variation of lane velocity. If the vehicle is traveling at the nominal velocity associated with the lane segment (or within the limit on variation $b_n$), then it is assumed that the vehicle will continue at the same velocity.

If the lane gap is not larger than the Lane Influence Point and the car gap is larger than the Headway Influence Point, then the vehicle is considered to be in a lane geometry mode—Region C (step 3708). Region C, called the lane geometry region, has a short lane gap and large car gap, and, hence, the lane gap controls the vehicle kinematics. This situation arises for vehicles in complex roadways as shown, for example in FIG. 24, when there are no preceding vehicles in the same lane segment. The vehicle acceleration in this region has a similar form to the expression in the GM model. In this region the vehicle's acceleration is given by $$\ddot{x}(t)=\ddot{x}_l(t)=\frac{1}{2}\,|\dot{x}_{Is}-\dot{x}(t)|\left\{\frac{[\dot{x}_{Is}-\dot{x}(t)]}{gap_l(t)}\right\}$$

where $gap_l(t)=x_{Is}-x(t)$, $x_{Is}$=starting position of the next segment, $\dot{x}_{Is}$=speed parameter of the next segment, and $\ddot{x}_l(f)$=lane gap acceleration term.

If the lane gap is not larger than the Lane Influence Point and the car gap is not larger than the Headway Influence Point, then the vehicle is considered to be in a combination of car following and lane geometry modes (step 3709). Region D, called the combined region, has a short lane gap and short car gap, and, hence, a combination of the lane gap and the car gap influence the vehicle kinematics. For this invention, the minimum function is used to combine the effects of the car gap and lane gap, yielding $\ddot{x}=\min(\ddot{x}_h,\ddot{x}_l)$.

Special segment types employ additional rules which may influence the parameters. If a vehicle is approaching a yield segment then a merging rule is used to modify the acceleration equations. A simple merging rule modifies the velocity associated with the yield segment and through this the acceleration equations. If a vehicle on the through lane segment is predicted to be within a spacing distance of the location on the through lane segment corresponding to the yield segment at the same time the vehicle is predicted to arrive at the yield segment, the velocity associated with the yield segment is set to zero. Otherwise, the velocity of the yield segment is set to the velocity of the through lane segment. The effect of this mechanism is to cause a vehicle approaching a yield segment to wait for a space to merge into.

For example, consider the case where a first vehicle on lane segment 2530 (FIG. 25) is predicted to arrive at yield segment 2501 at the same time as a second vehicle which is on through lane segment 2520. Yield segment 2501 would be given a velocity of zero, thereby causing the first vehicle to decelerate in accordance with the acceleration equations set forth above. Yield segment 2501 would continue to have zero velocity until sufficient space behind the second vehicle exists. At that time the velocity of yield segment 2501 would be reset to the velocity of lane segment 2520, thereby allowing the first vehicle to merge behind the second vehicle.

For a vehicle operating on a merge segment (such as merge segment 3830, FIG. 38) a merging rule is used to modify the acceleration equations above. First, the sufficiency of intervehicle spacing in the lane segment 3810 into which traffic will merge is checked. A vehicle can only merge if there is sufficient spacing between vehicles already in the lane segment 3810. Next, the closest sufficient spacing behind the merging vehicle's location is selected. The lane gap ($gap_l$) in the above equations is modified to equal the distance between the merging vehicle and the middle of the closest sufficient spacing. This typically causes the merging vehicle to slow for the merge. When the merging vehicle is parallel to this sufficient spacing the merge takes place by inserting the merging vehicle from the merge segment 3830 into the other lane segment 3810. When the merging vehicle is inserted into the through lane segment 3810 it carries the same velocity as it had in the merge segment 3830.

The above description provides a frame work of a micromodel predicting vehicle kinematics for roadways including complex interchanges. Most common traffic roadway geometric events have been included in the discussion above. The equations can be modified to account for other traffic situations. Other geometric events may be added and are within the scope of the invention. The equations have been designed for ease of implementation and speed of calculation, but they can be expanded and modified for improved accuracy if required.

By including roadway geometric events, a traffic monitoring system in accordance with the invention is able to predict vehicular behavior not only in congestion but also through complex interchanges. This is an improvement over simple car following models like the GM micromodel which is limited to flow on freeways and does not include curves, merges and stop signals. Thus, a traffic monitoring system in accordance with the invention can perform tracking and real-time simulation of vehicles in complex interchanges.

This invention, by partitioning vehicular behavior into a number a cases, allows use of a simple expression to describe the vehicle acceleration for each case. The result is a simple description of the vehicle's kinematics. Simple expressions result in computer implementations resulting in few lines of computer code and requiring small amounts of the computer's time line even for complex interchanges. This enables the micromodel of the invention to be utilized in vehicle tracking systems and in real-time simulations.

Since segments and points can be laid out on a plan view of a roadway, including interchanges and intersections, and easily related to roadway geometric events like stop signs, a traffic engineer can quickly specify an appropriate micromodel for an interchange. The traffic engineer works with drawings and entities that are familiar, hence increasing the usability of the micromodel of the invention.

TABLE 1

Micromodel Parameters

| Roadway Geometry Event | Parameter | Description |
|---|---|---|
| Lane Segment (general parameters) | start location | where vehicles enter lane segment |
| | end location | where vehicles leave lane segment |
| | $\alpha$ | GM model parameters |
| | $r_t$ | driver reaction time |
| | $a_n$ | lane segment acceleration |
| | $\dot{x}_{l_n}$ | lane segment nominal velocity |
| | $b_n$ | limit on variation of lane velocity |
| Merge Segment | start location | where vehicles enter lane segment |
| | end location | where vehicles leave lane segment |
| | next lane | lane that vehicles will merge into |

TABLE 1-continued

Micromodel Parameters

| Roadway Geometry Event | Parameter | Description |
|---|---|---|
| | next lane location | location in next lane corresponding to start location |
| | spacing size | acceptable gap between vehicles for merge |
| | $\dot{x}_{l_n}$ | lane segment nominal velocity |
| | other parameters | same as next lane |
| Transition Segment | start location | where vehicles enter lane segment |
| | end location | where vehicles leave lane segment |
| | other parameters | same as preceding lane segment |
| Signaled Stop Bar Segment | location | lane location of event |
| | signal phase | stop or proceed |
| | $\dot{x}_{l_n}$ | zero if signal phase is stop; same as next segment if signal phase is proceed |
| | other parameters | same as next segment |
| Signaled Stop and Go Segment | location | lane location of event |
| | signal phase | stop or proceed |
| | $\dot{x}_{l_n}$ | zero if signal phase is stop; same as next segment if signal phase is proceed or if vehicle has stopped |
| | other parameters | same as next segment |
| Stop and Go Segment | location | lane location of event |
| | $\dot{x}_{l_n}$ | zero if vehicle has not stopped; same as next segment if vehicle has stopped |
| | other parameters | same as next segment |
| Yield Segment | location | lane location of event |
| | next lane | lane that vehicles will merge into |
| | next lane location | location in next lane of the yield point |
| | other parameters | same as next lane |
| Split Point | location | lane location of event |
| | other lane | lane that vehicles can split into |
| | other lane location | location in other lane of split point |
| | probability of split | probability that a vehicle will split to other lane |
| Merge Point | location | lane location of event |
| | next lane | lane that vehicles will merge into |
| | next lane location | location on next lane corresponding to merge point |

Additional Description of Multiple Hypothesis Tracking

There was described above a multiple hypothesis tracking method with respect to the lower level of the MATS. According to another aspect of the invention, there is provided a method for generation and control of multiple hypothesis tracking which lends itself especially well to vehicle tracking.

Figure 35:
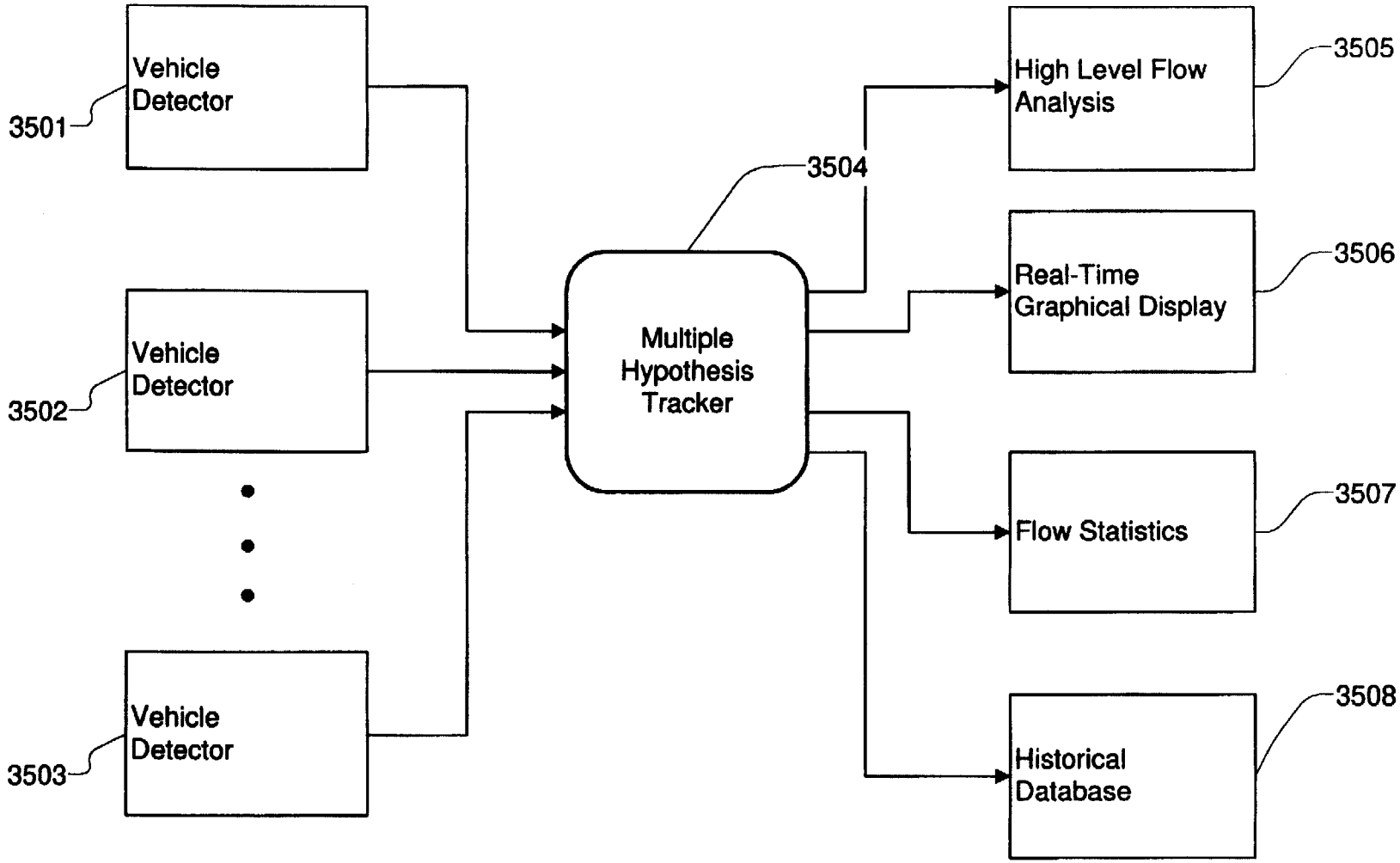
FIG. 35 is a data flow diagram for the multiple hypothesis tracker of the invention.

FIG. 35 shows a tracking system in accordance with the invention comprising a system similar to that shown in FIGS. 2 and 36. The tracking system of FIG. 35 includes a multiple hypothesis tracker 3504, which may be a part of multisensor advanced tracking system 240 (FIG. 2). The multiple hypothesis tracker 3504 is coupled to a number of vehicle detectors 3501, 3502, and 3503, which are preferably smart sensor interfaces 210, 220, 230 (FIG. 2) coupled to video cameras. However, the vehicle detectors may be less intelligent devices such as loops. As described above, the field of view for the sensors can be overlapped or be free of overlap. If the fields of view are free of overlap, it is preferred that the fields of view be close enough for the data association process to produce a reasonable probability of correct assignment.

The multiple hypothesis tracker 3504 determines vehicle paths identified by time, lane number, position, velocity and other kinematic quantities. This path information forms the basis for understanding traffic flow. From the path information a number of useful measurements can be obtained. FIG. 35 shows a number of functions (measurements) that can be based on the path information developed by the multiple hypothesis tracker 3504. These include high level flow analysis 3505, real-time graphical display of vehicle movement and traffic flow 3506, flow statistics 3507 and the development of a historical database 3508.

Common flow statistics 3507 such as vehicle counts, average vehicle velocity, and turning movements may be obtained directly from the vehicle path information. High level flow analysis 3505 of vehicle paths, for example lane changes, is also useful in detecting abnormal flow situations arising from a traffic incident. Other high level flow measurements derivable from vehicle path information include vehicle weaving behavior.

The multiple hypothesis tracking method of the invention is particularly suited for detecting and tracking vehicles through lane changes. In roadway interchanges and intersections, a vehicle can take any of many paths, so tracking becomes more complex. Because a vehicle lane change typically takes place over a number of detection cycles, a simple single stage decision approach could easily miss the lane change or even eliminate the vehicle track as a false alarm. The multiple hypothesis tracking method of the invention is capable of incorporating a number of vehicle detections prior to making a lane change decision. This can greatly improve the performance of lane change detection.

When tracking vehicles in complex interchanges and intersections, path decisions generally must be made. For example, it often must be decided if a vehicle took a through path or a turn path. A tracking system employing a single stage decision approach could perform poorly. Multiple hypothesis tracking according to this method solves this problem by delaying decisions until enough vehicle detection data is available so that the decision can be made with high quality.

Typical multiple hypothesis tracking systems are complex and require substantial computational resources. In accordance with the invention, the tracking approach is partitioned into well defined components, thereby reducing complexity. Computation requirements are limited in accordance with the invention by preventing the number of hypotheses from expanding and by terminating hypotheses as quickly as possible.

The state sequence for multiple hypothesis tracking contains the following steps:

1. detect an occurrence or situation requiring multiple hypotheses;
2. generate hypotheses and initiate any new tracks associated with the generated hypotheses;
3. continue the tracks associated with the hypotheses as new data becomes available;
4. check the stopping rule for termination of hypothesis; and
5. if the stopping rule is satisfied terminate the tracks that identified only with the rejected hypothesis.

Unlike typical multiple hypothesis tracking used in radar applications, the multiple hypothesis tracker of the invention detects situations requiring multiple hypotheses differently. Typically, the multiple hypothesis situation arises when it is not possible to perform data association of high quality. In contrast, in accordance with the invention, multiple hypothesis tracking commences upon well defined events. These events include:

1. a track passes a predefined hypothesis generation point;
2. the data association process (as described above) produced an unassigned vehicle detection; or
3. the data association process was unable to assign a detection to a track.

According to the invention, tracks are continued similarly as in typical multiple hypothesis tracking. The processing sequence for track continuation is:

1. tracks are predicted to the time of the measurement;
2. data association is performed to assign the predicted tracks with the measurements (detections); and
3. a Kalman-like update is performed for the track.

After each cycle of the tracking process, the stopping rule is checked to see if any hypotheses can be eliminated. Stopping rules are described in M. H. DeGroot, *Optimal Statistical Decisions*, pp. 324–379 McGraw-Hill, New York, N.Y. (1970) which is incorporated herein by reference. Continuation of a hypothesis requires processing resources. Hence, hypotheses are terminated as quickly as possible to minimize computational loading. In general, a stopping rule checks for two conditions: (1) is the information gathered sufficient to generate a quality decision? and (2) will information gathered in the future be of benefit in making the decision? The multiple hypothesis tracking method of the invention utilizes both conditions for its stopping rule.

After the stopping rule has been satisfied, a winning hypothesis is selected. All tracks associated with the winning hypothesis are accepted as normal tracks to be continued. Other tracks associated with the rejected hypotheses (i.e., those not included in the winning hypothesis) are terminated and flushed from further consideration.

The multiple hypothesis method of the invention avoids the problem caused by large numbers of hypotheses by starting multiple hypotheses based upon local events. Tracks not included in a local event are not included in the multiple hypothesis process, thereby reducing and limiting the computational cumbersomeness of the process.

It has been recognized that vehicles tend to be positioned in a manner which permits multiple hypothesis tracking for local events. That is, specific areas of potential confusion can be identified (i.e., separated and localized) before tracking begins. Each area of potential confusion is preferably separated to localize confusion, allowing independent handling of each confusion by the multiple hypothesis approach. The tracking environment can thus be partitioned into a set of independent local events and isolated tracks.

The multiple hypothesis tracking approach corresponding local events that are to roadway geometric events such as left turns is first described below. Following this, the description is expanded to include other local events.

Figure 27:
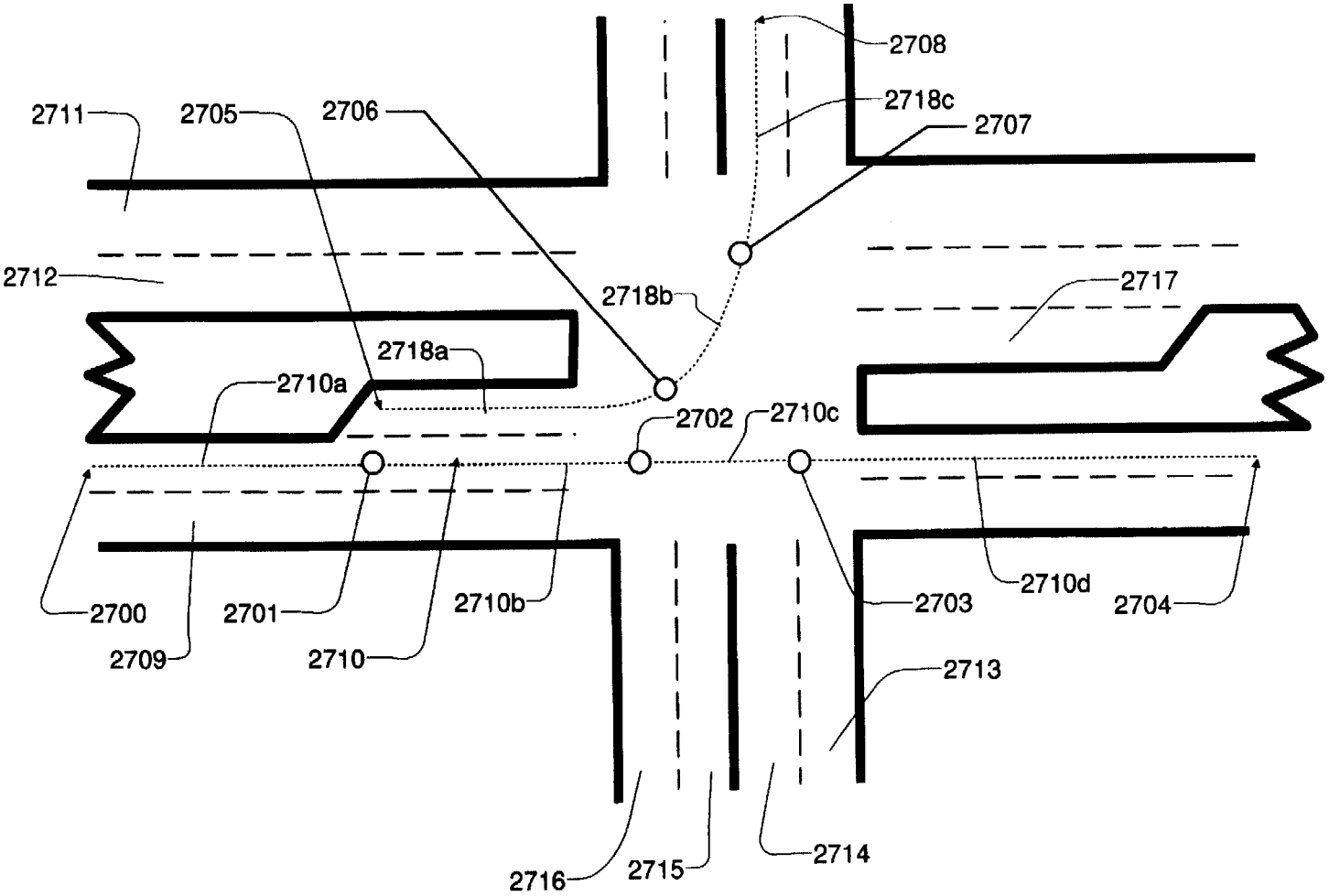
FIG. 27 is a diagram of an intersection with some hypothesis and decision points identified.

FIG. 27 is a diagram of a roadway intersection. The intersection includes a number of through lanes 2709, 2710 (comprising segments 2710*a*, 2710*b*, 2710*c*, 2710*d*), 2711, 2712, 2713, 2714, 2715 and 2716 and turning lanes 2717, 2718 (comprising segments 2718*a*+2718*b*+2718*c*). It should be understood that the intersection includes flow control devices such as signals and stop signs. The particular layout of the intersection and types of flow controls are not important to this description.

One example of a local event is a vehicle approaching a location where a left turn can take place. The intersection of FIG. 27 includes location 2701 where a left turn might begin. At location 2701, a vehicle track could proceed on the through lane 2710 or change to the left turn lane 2718. Thus, for a track at location 2701, there is confusion, and location 2701 is identified as a hypothesis generation point. A hypothesis generation point is a local geometric event which triggers generation of multiple hypotheses. Hypotheses corresponding to a local event belong to a multiple hypothesis group. Thus, a local event can be thought of as spawning a hypothesis group. In the left turn example, the hypothesis group consists of two hypotheses: one corresponding to a vehicle proceeding straight and the other hypothesis corresponding to a left turn.

If a vehicle track proceeds from location 2700 and passes through hypothesis generation point 2701 on lane segment 2710*a*, multiple hypotheses are generated at the time the track passes point 2701. It should be noted that this description refers to vehicle tracks, rather than to the vehicles themselves. This is because the method of the invention applies to vehicle movement as obtained from smart sensor interfaces in real time as well as by real-time and other simulators.

Two other types of points are relevant to the method—decision hold off points and decision points. A decision hold off point is a point located after a hypothesis point. A hypothesis generation point and a decision hold off point define a lane segment on which there cannot be sufficient certainty for the stopping rule to determine a winning hypothesis. Locations 2702 and 2706 are decision hold off points. A vehicle passing hypothesis generation point 2701 could move from lane segment 2710b (defined by locations 2701 and 2702) to lane segment 2718*a* (defined by locations 2705 and 2706). Thus, so long as the vehicle is on this lane segment 2710*b*, the stopping rule should not be checked.

However, once a vehicle goes past a certain location, it typically cannot change paths. Such a location is a decision point. A decision point is located after a decision hold off point. A decision hold off point and a decision point define a lane area on which there might be sufficient certainty for the stopping rule to determine a winning hypothesis. Locations 2703 and 2707 are decision points. A vehicle passing decision hold off point 2702 cannot (legally) move from lane segment 2710*c* (defined by locations 2702 and 2703) to lane segment 2718*b* (defined by locations 2706 and 2707). A similar case applies to lane segment 2718*b* defined by locations 2706 and 2707. Thus, so long as the vehicle is detected on either of this lane segments 2710*c*, 2718*b*, the stopping rule should be checked.

In the preferred embodiment, a hypothesis generation table is implemented in software and operative within the computer 3603 (FIG. 36). Rows in this table correspond to the local events. Columns in the hypothesis generation table contain the information needed to generate the hypotheses included in the hypothesis group and information needed to initiate tracks dictated by the hypotheses. The table also contains the a priori probabilities for each of the hypotheses in the hypothesis group.

When a track passes a hypothesis generation point, the row corresponding to this point is found in the hypothesis generation table. This table entry provides the hypotheses making up the hypothesis group and any additional tracks to be initiated to support the hypothesis group. The table also provides initiation rules for the additional tracks.

Figure 28:
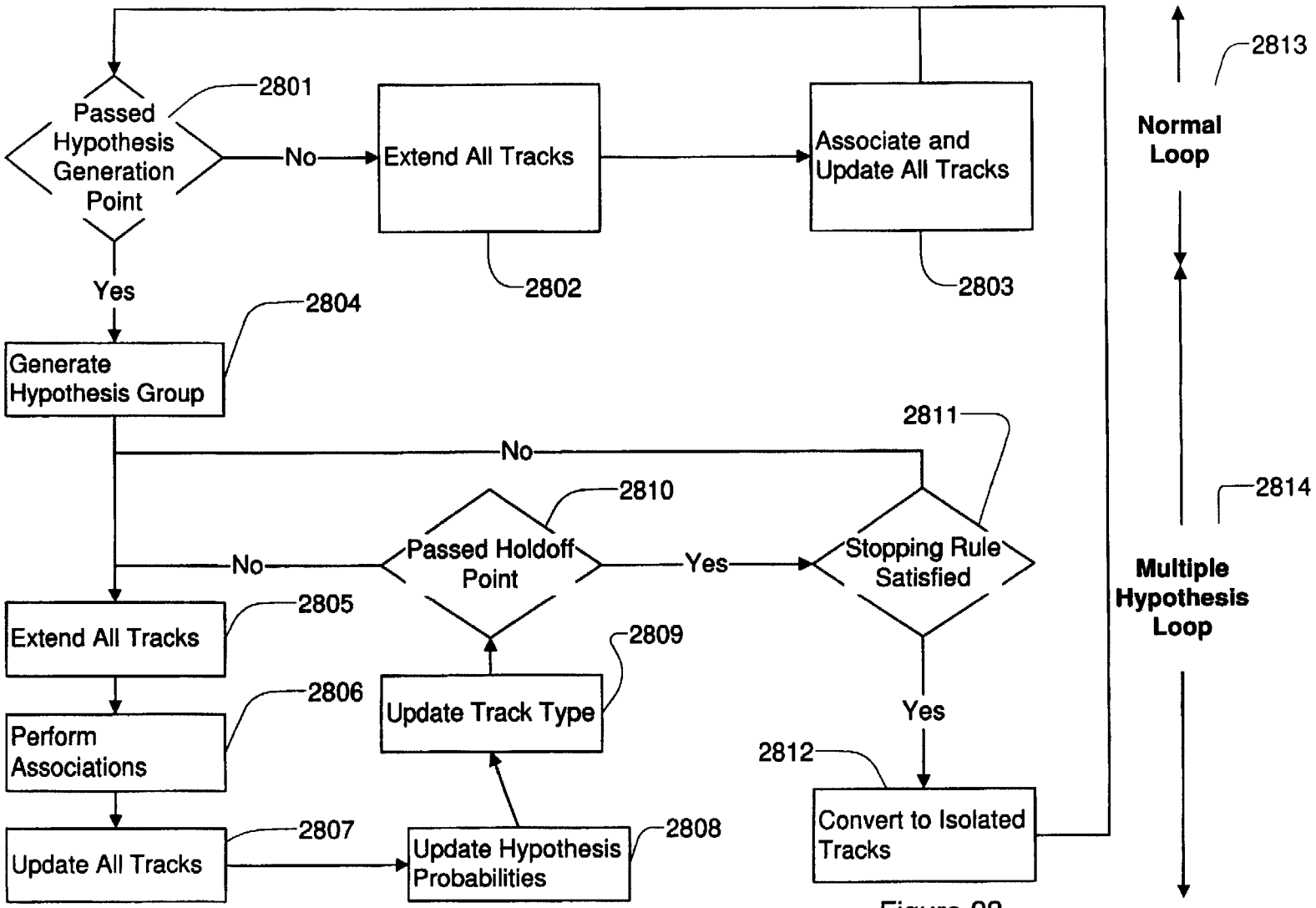
FIG. 28 is a flow chart of multiple hypothesis tracking in accordance with the invention for geometric events.

FIG. 28 shows an embodiment of the multiple hypothesis method of the invention. The figure shows two processing loops: a normal loop 2813 and a multiple hypothesis loop 2814. Many of the processing blocks shown in FIG. 28 are common to the classical multiple target tracker; others are specialized to vehicle tracking. The normal loop 2813, a standard multitarget tracking loop, is executed until a track passes a hypothesis generation point which transitions the process to the multiple hypothesis loop 2814. This normal loop 2813 comprises extending all tracks 2802, and associating and updating all tracks 2803.

If a track passes a hypothesis generation point, however, processing changes to the multiple hypothesis loop 2814. The first step in the multiple hypothesis loop 2814 is generation of groups of hypotheses 2804 based upon the presented conditions. For example, for the hypothesis generation point 2701 in FIG. 27, an additional track will be initiated at a location 2705 on the left turn lane 2718. The hypothesis generation table would define the initial track state to be equivalent to the track state of the track that passed hypothesis generation point 2701. That is, the hypothetical track on lane 2718 would carry the same velocity as the hypothetical track on lane 2710 after passing the hypothesis generation point 2701.

After this, all tracks are extended 2805, including any tracks initiated by the hypotheses generation process.

In general, one hypothesis in the hypothesis group will have the largest probability of being correct. All tracks corresponding to this hypothesis are labeled primary. Other tracks included in this hypothesis group are labeled possible. All tracks not included in a hypothesis group are labeled isolated. For real-time display and control, isolated and primary tracks are preferably output for use by the display and control subsystems. At any specific time, primary tracks will correspond to the best decision so these are preferred for display over the other hypothetical tracks.

Next, association is performed (step 2806). Association is performed through a two stage process: gating, then assignment. In the gating process, tracks are gated with the detections. If it is possible that a detection could arise from a track then they gate together. Gating for vehicle tracking is different than gating for radar (e.g., aircraft) tracking in that the former is more complex. For example, consider a track on lane segment 2410 entering the intersection of FIG. 24. The track will stop at the stop bar 2401 when the intersection's signal phase indicates a stop condition. This track would not gate with detections interior to the intersection because the vehicle under track could not have caused these detections. When the signal phase is proceed then the track could gate with detections interior to the intersection. For this example, gating is dependent on the signal phase. No such signal phases are seen to be present in radar aircraft tracking.

Assignment is based on the best match between a track and gated detections. The likelihood measure, as known in the art, can be used to measure how well a track pairs with a detection. A number of approaches exist for determining a good assignment of the detections with the tracks. A simple approach for multiple hypothesis tracking is to first assign all isolated tracks using the likelihood measure. Detections assigned to isolated tracks are removed from further consideration. Next tracks for the hypothesis groups are considered. The assigned detection for each track included in a hypothesis group is determined by selecting the gated detection with the largest likelihood measure. The assigned track-detection pairs are used in track and hypothesis probability updating.

Although the above assignment approach is considered suboptimal, it performs well enough for most vehicle tracking environments. This is a simple, computationally quick approach which will work adequately for vehicle tracking. Higher performance assignment approaches may also be included within the tracking method of the invention.

After association 2806 is complete, the tracker updates all the tracks 2807. The hypothesis probabilities for a hypothesis group are preferably updated following association using Bayes' rule. Preferably, the hypothesis generation table is filled with the rules/formulas implementing the Bayesian update for the hypothesis group corresponding to a hypothesis generation point. The hypothesis probabilities Bayes update formulas are preferably selected off-line from a library at the time that the roadway geometry is defined and are loaded into the hypothesis generation table.

Like the stopping rule, the hypothesis probability update formula (step 2808) can depend on vehicle location. For example, in FIG. 27, a track passing the hypothesis generation point 2701 preferably produces two hypothesis groups. One group correlates to the track continuing on the through lane 2710, the other to the track moving to the left turn lane 2718. The tracks corresponding to these hypotheses can transition from the through lane 2710 to the left turn lane 2718 anywhere between locations 2701 and 2702 (lane segment 2710*b*). If the track reaches decision hold off point 2702, it will almost assuredly follow the through lane 2710. If the track reaches decision hold off point 2706, then it will almost assuredly follow the turn lane 2718.

This behavior is reflected in the hypothesis probabilities update mechanism 2808 by adapting the mechanism for the location of the vehicle. Thus, if a detection between locations 2701 and 2702 is assigned to a track on lane 2710, the corresponding hypothesis probabilities would not be altered in the same manner as if a detection between locations 2702 and 2703 were assigned to lane 2718. This is because the latter case—the vehicle being detected on the through lane 2710 beyond the turn lane 2718—strongly favors a decision that the vehicle is on the through lane 2710 as opposed to the turn lane 2718.

The stopping rule (step 2811) is checked on each tracking cycle to determine if the hypothesis group or individual hypothesis should be terminated. However, a significant difference between the multiple hypothesis tracking method of the invention and typical multiple hypothesis tracking methods is the use of geometric information in the stopping rule. This is due to the fact that vehicles, unlike aircraft and many other objects, travel in well defined paths. For example, in FIG. 27, the vehicle will either proceed forward from location 2700 through location 2701 to locations 2702, 2703 and 2704 or it will proceed from location 2700 through location 2701 to locations 2706, 2707 and 2708.

After a track has passed the decision hold off point 2702, 2706, the current values of the hypothesis probabilities are used for the stopping rule. The stopping threshold value for this hypothesis group is obtained from the hypothesis generation table. At the end of each tracking cycle the stopping rule is checked 2811 by comparing the largest hypothesis probability for the hypothesis groups to the stopping threshold. If the probability exceeds the stopping threshold then the stopping rule is satisfied and the hypothesis group is terminated. When the stopping rule is satisfied the processing flow proceeds to step 2812.

If a track associated with a hypothesis group travels outside the field of interest (an area where vehicle detections can be accomplished) then all hypotheses in the hypothesis group containing this track are terminated except for the one having the largest probability. If at this point there is only one hypothesis left then it is termed the winner and the stopping condition is considered as satisfied.

To limit the amount of computational requirements, tracking of a hypothesis group in accordance with the invention ceases at decision points. This is because sufficient data should exist by the time that the track reaches the decision points to choose the winning hypothesis.

After the stopping rule has been satisfied the hypothesis group is terminated (step 2812). All tracks associated with the winning hypothesis are labeled as primary tracks. All non-primary tracks associated with the hypothesis group are deleted. Tracks labeled as primary are relabeled as isolated. This completes the multiple hypothesis loop 2814.

In addition to turns, other geometric events are possible. These other geometric events can be implemented in the same manner as the hypothesis generation point corresponding to a turn. In general, a hypothesis generation point is a point at which a track's path is uncertain.

Events other than roadway geometry events can generate a hypothesis group. Non-roadway geometry events can occur when an unassigned track or an unassigned detection is found by the data association process.

Hypothesis associated with non-geometric events include:

H1. a lane change from a higher numbered lane;

H2. a lane change from a lower numbered lane;

H3. a false detection;

H4. a new track;

H5. a missed detection; and

H6. a terminated track.

Figure 34:
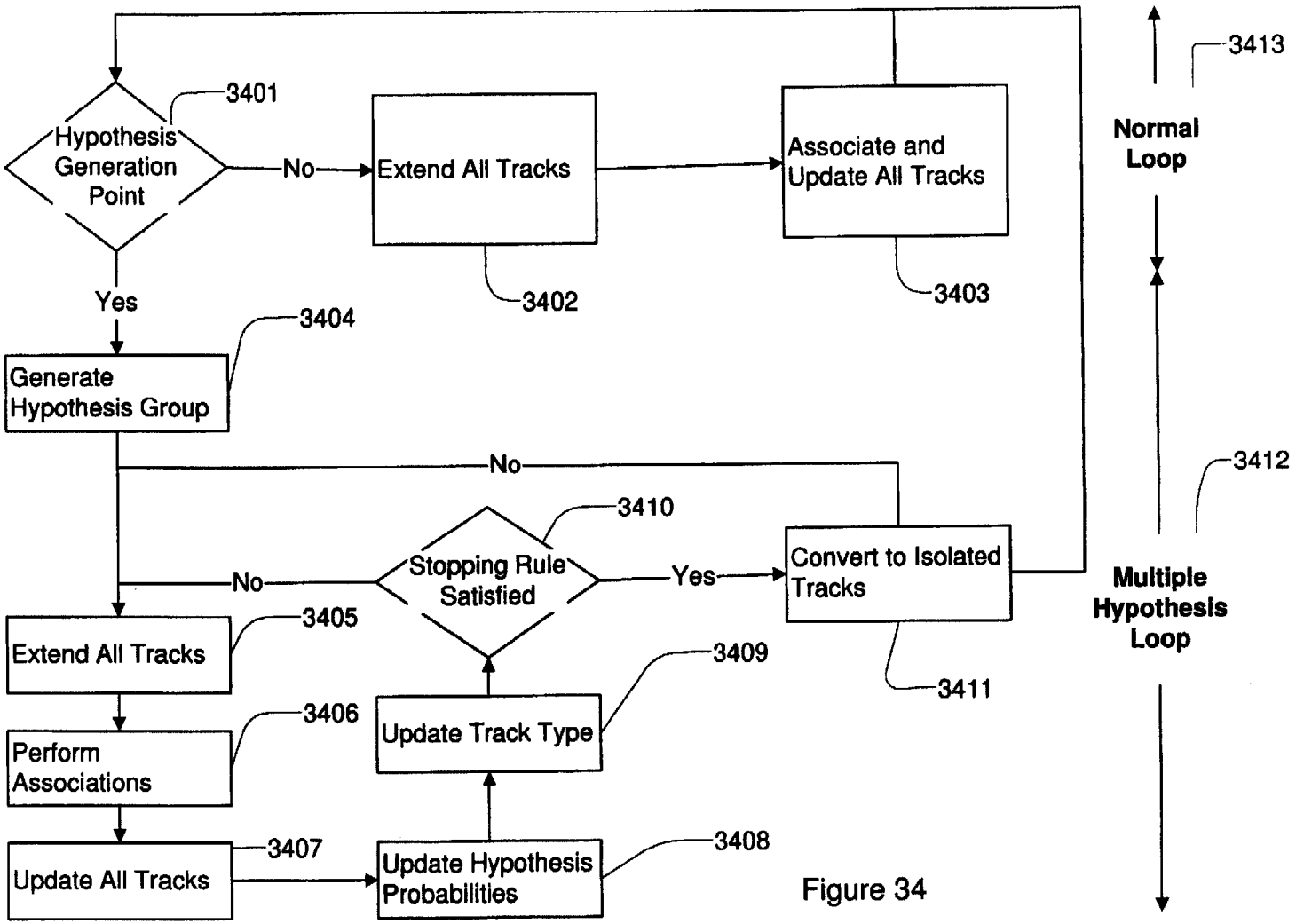
FIG. 34 is a flow chart of multiple hypothesis tracking in accordance with the invention for non-geometric events.

FIG. 34 shows the flow diagram for these other events. If in process 3403 an unassigned track or an unassigned detection is found the multiple hypothesis loop is entered 3401. Most of the processing steps shown in FIG. 34 are similar to the processing steps shown in FIG. 28, and the multiple hypothesis loop 3412 generally follows a typical multiple hypothesis loop. However, due to particular features of roadways and vehicular behavior which have been recognized, the typical multiple hypothesis method has been improved to provide earlier hypothesis selection and to reduce complexity.

Unassigned detection events in most cases lead to generation of hypotheses corresponding to H1, H2, H3 and H4. Unassigned track events in most cases lead to generation of hypotheses corresponding to H1, H2, H5 and H6. As with the roadway geometry events, the hypothesis generation table stores the hypotheses and other information needed to generate and maintain hypothesis groups for non-geometric events.

The hypothesis probability update formulas for the H3, H4, H5, and H6 hypotheses are similar to classical multiple hypothesis tracking and are based on the false alarm rate and probability of detection for the vehicle detector. The hypothesis probability update formulas corresponding to H1 and H2 are considered unique to the multiple hypothesis vehicle tracking problem.

Figure 29A:
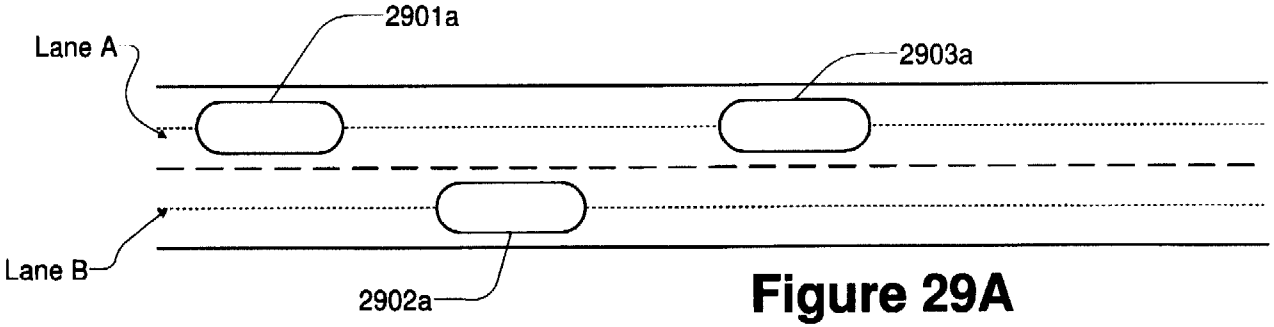
FIGS. 29A, 29B and 29C are progressive diagrams of vehicle movement along a lane segment.
Figure 29B:
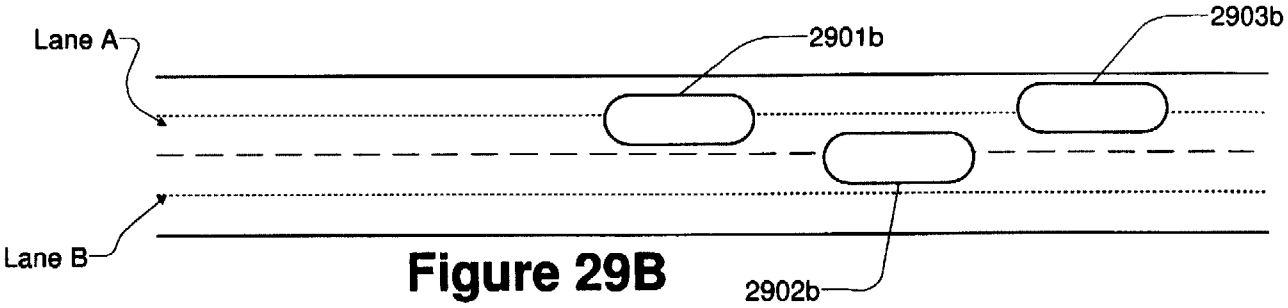
Figure 29C:
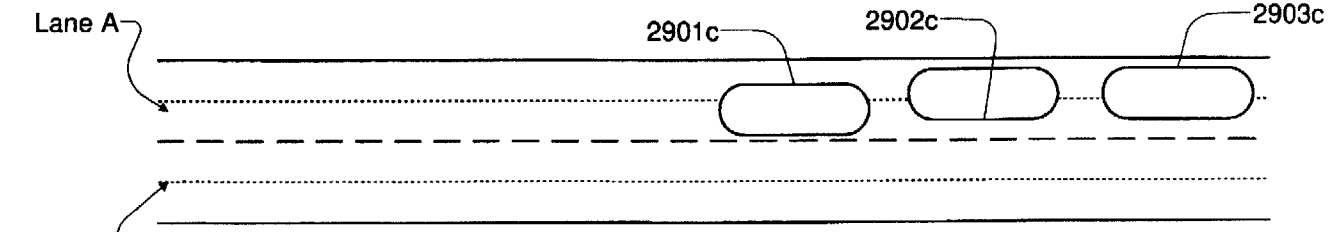

To illustrate updating the hypothesis probabilities associated with H1 and H2, consider a lane change shown in FIGS. 29A, 29B and 29C. A vehicle 2902*a* starts from lane B in FIG. 29A, proceeds to 2902*b* between lanes A and B in FIG. 29B, and completes the lane change at 2902*c* on lane A in FIG. 29C. Other vehicles 2901*a*, 2903*a*, 2901*b*, 2903*b*, 2901*c*, 2903*c* may also be present. The lane change can take place over a number of seconds which preferably corresponds to a number of vehicle detection cycles.

Figure 30:
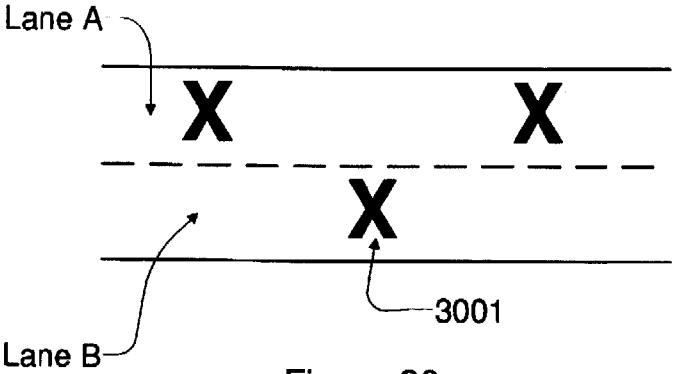
FIGS. 30–33 are diagrams showing the hypotheses generated in accordance with the invention under the circumstances shown in FIG. 29B.
Figure 31:
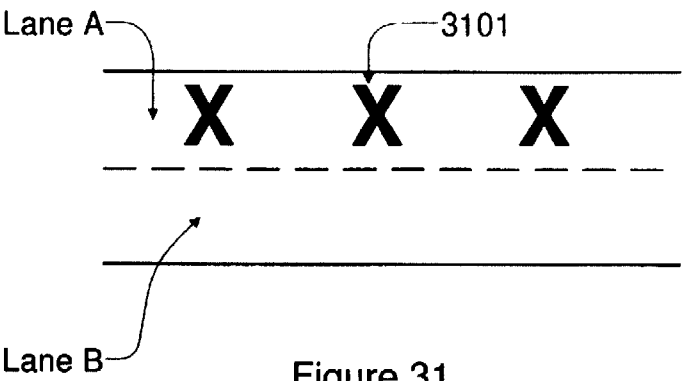

FIGS. 30–33 represent possible vehicle detections for the vehicles shown in FIG. 29B. FIG. 30 shows a detection 3001 in lane B at the start of a lane change and FIG. 31 shows a detection 3101 in lane A at the completion of the lane change.

Figure 32:
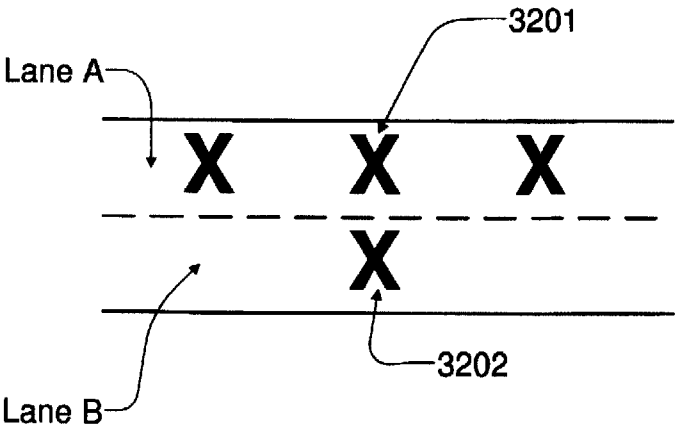
Figure 33:
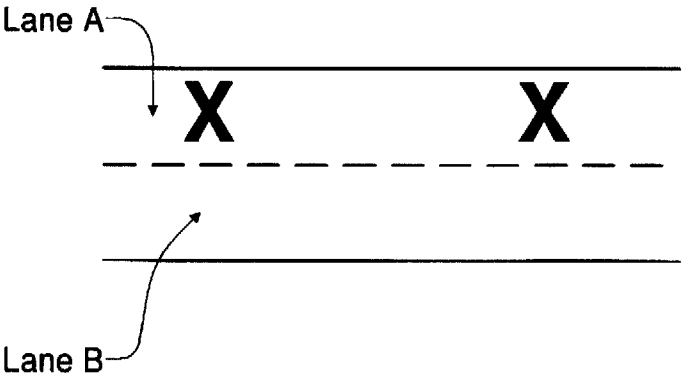

FIGS. 32 and 33 show the type of detections that are possible during the lane change when the vehicle 2902*b* is between lanes. In FIG. 32, the vehicle generates two detections (3201 and 3202) by straddling the lane, thereby triggering a detector response in both lanes. In FIG. 33, the vehicle does not trigger a detection in either lane. Depending on the detector type and the vehicle type it is possible to obtain either response form the detection system, hence the hypothesis probability update preferably addresses the outcomes of FIG. 32 and FIG. 33.

From within the multiple hypothesis loop 3412, a stopping threshold is obtained from the hypothesis generation table and compared to the highest hypothesis probability within the appropriate hypothesis group (step 3410). If the probability is larger than the threshold value the stopping rule is satisfied; otherwise it is not. If a track proceeds outside the field of interest of the vehicle detection mechanism, the stopping condition is handled similarly to hypothesis groups generated from roadway geometry events. The stopping rule for the hypothesis group not generated by a roadway geometry event is not influenced by roadway geometry.

To limit the computational requirements of the multiple hypothesis tracker an additional threshold may be obtained from the hypothesis generation table. This threshold sets the number of successive vehicle detections that can be included in the lifetime of this hypothesis group. If the number of successive vehicle detections exceeds this threshold then the stopping rule is considered satisfied.

Vehicle path information developed by the tracking system can be used to provide traffic system operators with a real-time understanding of the performance of a complex interchange. This can be accomplished by generating graphic icons on the display 3607 (FIG. 36) whose movement correspond to vehicle paths. Preferably, the icons are overlaid upon a schematic of the interchange. Where the tracking system is drawing vehicle information from live or simulated-live vehicle detectors 3601, the icons preferably move in real-time. From such a display, the traffic system operator could understand the traffic situation. This real-time graphical display 3607 supported by the tracker enables the traffic operator to control the traffic systems in real-time, as if he were physically located at the interchange.

Real-time simulation is another application for a traffic micromodel and multiple hypothesis tracking. Real-time simulation may provide traffic system operators with a visual description of the conditions on the roadway. In a real-time simulation, vehicles may be represented by icons which move upon a computer screen in a similar manner to the real vehicles upon the roadway. However, such displays are typically impractical for depicting heavy traffic or traffic over large areas. The micromodel of the present invention and multiple hypothesis tracking are used to continuously provide vehicle location information for the computer display. This allows the measurement system to provide data at a slower, more manageable rate. In essence, the micromodel and multiple hypothesis tracking fill in the gaps between measurements.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

I claim:

1. A traffic surveillance system comprising:

a first sensor positioned to sense vehicular traffic in a predetermined first field;

a first local traffic processor coupled to the first sensor for identifying vehicles within the field of the first sensor by periodically sampling the first sensor and extracting vehicle locations and identification information;

a second sensor positioned to sense vehicular traffic in a second predetermined field where said second predetermined field is separated from said first predetermined field;

a second local traffic processor coupled to the second sensor for identifying vehicles within the field of the second sensor by periodically sampling the second sensor and extracting vehicle locations and identification information; and a wide area traffic flow processor coupled to each local traffic processor for receiving the vehicle location and identification information from each local traffic processor and tracking the identified vehicles;

wherein the wide area traffic flow processor utilizes a predictor algorithm to predict each identified vehicle's location, and utilizes the vehicle location and identification information to correct the predictor model thereby functioning to monitor traffic consisting of all the identified vehicles.

2. A traffic surveillance system as set forth in claim 1, wherein the wide area traffic flow processor predicts each vehicle's location at approximately the same time as the local traffic processor is sampling the sensor.

3. A traffic surveillance system comprising:

a first sensor positioned to sense vehicular traffic in a predetermined first field;

a first local traffic processor for identifying vehicles within the first field and periodically generating vehicle locations and identification information concerning the vehicles in the first field;

a second sensor Dositioned to sense vehicular traffic in a predetermined second field;

a second local traffic processor for identifying vehicles within the second field and periodically generating vehicle locations and identification information concerning the vehicles in the second field; and a wide area traffic flow processor coupled to the first and second local traffic processors for receiving the vehicle location and identification information from the local traffic processors and tracking the identified vehicles, the wide area traffic flow processor reporting predictions of where the vehicles will be at the next period;

wherein the wide area traffic flow processor models the kinematics of the vehicles individually, and utilizes new vehicle location and identification information to correct the prediction mechanism.

4. A traffic surveillance system as set forth in claim 3, wherein the wide area traffic flow processor generates a micromodel of vehicle behavior, the micromodel being a GM car following micromodel.

5. A traffic surveillance system as set forth in claim 4, wherein the predictor algorithm further incorporates lane gap calculations, the lane gap calculations modelling the influence of roadway geometric events.

6. A traffic surveillance system as set forth in claim 5, wherein the roadway geometric events include movement from a straight lane segment to a curved lane segment.

7. A traffic surveillance system as set forth in claim 5, wherein the roadway geometric events include movement from a curved lane segment to a straight lane segment.

8. A traffic surveillance system as set forth in claim 5, wherein the roadway geometric events include changing traffic control signal conditions.

9. A traffic surveillance system as set forth in claim 3, wherein the roadway geometric events include requirements to stop at defined locations.

10. A traffic surveillance system as set forth in claim 3, wherein the roadway geometric events include availability of a lane into which an identified vehicle may merge.

11. A traffic surveillance system as set forth in claim 3, wherein the roadway geometric events include availability of a new lane segment into which an identified vehicle may move.

12. An apparatus for tracking vehicles in a roadway comprising a programmed computer system, the roadway including first and second lanes, wherein the first lane includes a segment which is substantially parallel to a segment of the second lane such that a vehicle could move directly therebetween, the beginning of the substantially parallel segments defining a hypothesis generation point, and the end of the substantially parallel segments defining a decision hold off point in each lane, there being further defined a first decision point in the first lane beyond the decision hold off point and a second decision point in the second lane beyond the decision hold off point, the program being selectively operable to effect the process of:

obtaining a vehicle's location on the first lane segment within a predetermined distance of the hypothesis generation point in a first period;

generating a hypothetical track corresponding to the vehicle continuing on the first lane and a hypothetical track corresponding to the vehicle moving to the second lane;

generating a probability of correctness for the hypotheses;

obtaining the vehicle's location in a second period after the first period;

updating the probabilities based upon the vehicle's location in the second period;

determining if the vehicle's location is past the decision hold off point, and if so, then determining whether one of the probabilities has reached a threshold, and if so, then eliminating the track associated with the hypothesis which did not reach the threshold, and otherwise updating the tracks with the vehicle's location in the second period and continuing with the method at the updating probabilities step.

13. A programmed computer system as set forth in claim 12, further comprising a display, wherein the program includes instructions for displaying representations of the tracked vehicles on the display.

14. A programmed computer system as set forth in claim 13, wherein a simulation of the roadway is displayed on the display, and the representations of the tracked vehicles are overlaid on the displayed roadway simulation.

15. A method of tracking vehicles comprising:

obtaining current vehicle location and generating a vehicle track from the location of the vehicle;

extending the vehicle track based upon the current location of the vehicle;

associating and updating all vehicle tracks;

for each vehicle track:

performing a first test of whether the vehicle track has reached a hypothesis generation point, and if not then continuing with the method at the vehicle location obtaining step, and otherwise:

extending all vehicle tracks;

performing associations between vehicle tracks;

updating all vehicle tracks;

updating hypothesis probabilities for the vehicle tracks;

updating vehicle track types;

testing if the vehicle tracks have passed a hold off point, and if not then continuing with the method at the extending all vehicle tracks step, and otherwise testing if a stopping rule has been satisfied, and if not then continuing with the method at the extending all vehicle tracks step, and otherwise continuing with the method at the first test step.

16. A method as set forth in claim 15, further comprising the step of display icons representative of the tracked vehicles on a display coupled to the computer.

17. A method of tracking a first vehicle on a roadway, the roadway comprising a first lane segment contiguous with a second lane segment, and a plurality of geometric events having predetermined locations, the method comprising:

(a) obtaining the first vehicle's location on the first lane segment in a first time period, and the first vehicle's location on the first lane segment in a second time period;

(b) predicting a track of the first vehicle as an extension of the first vehicle's locations in the first and second time periods;

(c) determining if geometric events are in the first vehicle's track, and if present, identifying the geometric events;

(d) determining if a second vehicle is preceding the first vehicle, and, if present, obtaining the second vehicle's kinematics;

(e) determining the lane gap, the car gap, the lane influence point and the headway influence point for the first vehicle;

(f) if the lane gap is greater than the lane influence point and the car gap is greater than the headway influence point, then extending the first vehicle's track without taking into account the geometric events or the second vehicle's kinematics;

(g) if the lane gap is greater than the lane influence point and the car gap is not greater than the headway influence point, then extending the first vehicle's track without taking into account the geometric events while taking into account the second vehicle's kinematics;

(h) if the lane gap is not greater than the lane influence point and the car gap is greater than the headway influence point, then extending the first vehicle's track taking into account the geometric events and not taking into account the second vehicle's kinematics;

(i) if the lane gap is not greater than the lane influence point and the car gap is not greater than the headway influence point, then extending the first vehicle's track taking into account the geometric events and the second vehicle's kinematics.

18. A method of tracking a first vehicle on a roadway as set forth in claim 17, further comprising displaying the first vehicle's predicted location on a display.

19. A method of tracking a first vehicle on a roadway as set forth in claim 17, wherein a nominal velocity is associated with the first lane segment, and if the lane gap is greater than the lane influence point and the car gap is greater than the headway influence point, then predicting that the first vehicle's velocity will approach the nominal velocity.

20. A method of tracking a first vehicle on a roadway as set forth in claim 17, wherein if the lane gap is greater than the lane influence point and the car gap is not greater than the headway influence point, then predicting the first vehicle's kinematics from the GM micromodel.

21. A method of tracking a first vehicle on a roadway as set forth in claim 17, wherein the second lane segment is a continuation of the first lane segment and a nominal velocity is associated with the second lane segment, and if the lane gap is not greater than the lane influence point and the car gap is greater than the headway influence point, then predicting that the first vehicle's kinematics will approach the nominal velocity.

22. A method of tracking a first vehicle on a roadway as set forth in claim 17, wherein if the lane gap is not greater than the lane influence point and the car gap is not greater than the headway influence point, then predicting that the first vehicle's will accelerate at the lesser of the acceleration from the first vehicle's velocity in the first period necessary to approach the nominal velocity of the second lane segment and the acceleration from the first vehicle's velocity in the first period to approach the velocity of the second vehicle.

23. A method of tracking a first vehicle on a roadway as set forth in claim 17, wherein the second lane segment begins at a location noncontiguous of the first lane segment, the first lane segment ends at the second lane segment and the second lane segment continues, and the geometric events include a yield segment located at the junction of the first and second lane segments, the method further comprising, in the extending step, if the predicted track of the first vehicle includes the yield segment then moving the first vehicle into the second segment when there is sufficient space.

24. A method of tracking a first vehicle on a roadway as set forth in claim 23, wherein a nominal velocity is associated with the second lane segment, and if a second vehicle on the second lane segment is predicted to be within a predetermined spacing distance of the yield segment at the same time the first vehicle is predicted to arrive at the yield segment, then the velocity associated with the yield segment is set to zero, and otherwise the velocity of the yield segment is set to the nominal velocity of the second lane segment.

25. A method of tracking a first vehicle on a roadway as set forth in claim 17, wherein the first lane segment is parallel to the second lane segment and the first lane segment ends at a location where the second lane segment continues, and the geometric events include a merge segment continuing from the first lane segment and ending at a location along the second lane segment, and if the predicted track of the first vehicle includes the merge segment, then the method further comprising:

waiting a number of periods of time until the track of the first vehicle is predicted to be in the merge segment;

determining the sufficiency of intervehicle spacing in the second lane segment along and behind the first vehicle;

selecting the location of closest sufficient spacing on the second lane segment for the first vehicle to merge into the second lane segment;

determining the lane gap to be equal to the distance between the first vehicle and the middle of the closest sufficient spacing;

waiting a number of periods of time until the first vehicle is parallel to the location on the second lane segment of the sufficient spacing, and predicting the first vehicle to merge into second lane at the same velocity as the first vehicle had in the merge segment.

26. A method of tracking a first vehicle on a roadway as set forth in claim 17, wherein the first lane segment ends at the beginning of the second lane segment and a signal is located at the junction of the first and second lane segments, a nominal velocity is associated with the second lane segment, and the geometric events include a signalled stop bar segment located at the junction of the first and second lane segments, and if the predicted track of the first vehicle includes the signalled stop bar segment then determining the state of the signal, and if the signal phase indicates a stopping condition then setting the velocity of the signalled stop bar segment to be zero, and if the signal phase indicates a proceed condition then setting the velocity of the signalled stop bar to be the nominal velocity of the second lane segment.

27. A method of tracking a first vehicle on a roadway as set forth in claim 17, wherein the second lane begins at a location noncontiguous of the first lane segment, the first lane segment ends at the second lane segment and the second lane segment continues, the first lane segment is curved and the second lane segment is straight, the geometric events include a transition segment located at the junction of the first and second lane segments, and if the predicted track of the first vehicle includes the transition segment then predicting that the first vehicle will maintain its velocity through the first lane segment and will begin to accelerate after passing the transition segment.

28. A traffic surveillance system comprising:

plural local traffic processors each for identifying vehicles within a field and periodically generating vehicle locations and identification information, the fields including first and second lanes having at least one segment each which are substantially parallel such that a vehicle could move directly therebetween, the beginning of the substantially parallel segments defining a hypothesis generation point, and the end of the substantially parallel segments defining a decision hold off point in each lane, there being further defined a first decision point in the first lane beyond the decision hold off point and a second decision point in the second lane beyond the decision hold off point; and a wide area traffic flow processor coupled to the local traffic processors for receiving the vehicle location and identification information from the local traffic processors and tracking the identified vehicles, the wide area traffic flow processor reporting predictions of where the vehicles will be at the next period, and being selectively operable to effect the process of:

obtaining a vehicle's location on the first lane segment within a predetermined distance of the hypothesis generation point in a first period;

generating a hypothetical track corresponding to the vehicle continuing on the first lane and a hypothetical track corresponding to the vehicle moving to the second lane;

generating a probability of correctness for the hypotheses;

obtaining the vehicle's location in a second period after the first period;

updating the probabilities based upon the vehicle's location in the second period;

determining if the vehicle's location is past the decision hold off point, and if so, then determining whether one of the probabilities has reached a threshold, and if so, then eliminating the hypothetical track associated with the hypothesis which did not reach the threshold, and otherwise updating the hypothetical tracks with the vehicle's location in the second period and continuing with the method at the updating probabilities step;

wherein the wide area traffic flow processor models the kinematics of the vehicles individually, and utilizes new vehicle location and identification information to correct the prediction mechanism.

29. A traffic surveillance system comprising:

plural local traffic processors each for identifying vehicles within a field and periodically generating vehicle locations and identification information, the fields including first and second contiguous lane segments and plural geometric events; and a wide area traffic flow processor coupled to the local traffic processor for receiving the vehicle location and identification information from the local traffic processor and tracking the identified vehicles, the wide area traffic flow processor reporting predictions of where the vehicles will be at the next period and being selectively operable to effect the process of:

obtaining a first vehicle's location on the first lane segment in a first time period, and the first vehicle's location on the first lane segment in a second time period;

predicting a track of the first vehicle as an extension of the first vehicle's locations in the first and second time periods;

determining if geometric events are in the first vehicle's track, and if present, identifying the geometric events;

determining if a second vehicle is preceding the first vehicle, and, if present, obtaining the second vehicle's kinematics;

determining the lane gap, the car gap, the lane influence point and the headway influence point for the first vehicle;

if the lane gap is greater than the lane influence point and the car gap is greater than the headway influence point, then extending the first vehicle's track without taking into account the geometric events or the second vehicle's kinematics;

if the lane gap is greater than the lane influence point and the car gap is not greater than the headway influence point, then extending the first vehicle's track without taking into account the geometric events and taking into account the second vehicle's kinematics;

if the lane gap is not greater than the lane influence point and the car gap is greater than the headway influence point, then extending the first vehicle's track taking into account the geometric events and not taking into account the second vehicle's kinematics;

if the lane gap is not greater than the lane influence point and the car gap is not greater than the headway influence point, then extending the first vehicle's track taking into account the geometric events and the second vehicle's kinematics;

wherein the wide area traffic flow processor models the kinematics of the vehicles individually, and utilizes new vehicle location and identification information to correct the prediction mechanism.

* * * * *